US011370634B2

(12) United States Patent
Katayama

(10) Patent No.: US 11,370,634 B2
(45) Date of Patent: Jun. 28, 2022

(54) SHEET PROCESSING APPARATUS AND IMAGE FORMING SYSTEM

(71) Applicant: Takuya Katayama, Yamanashi-ken (JP)

(72) Inventor: Takuya Katayama, Yamanashi-ken (JP)

(73) Assignee: CANON FINETECH NISCA INC., Misato (JP)

( * ) Notice: Subject to any disclaimer, the term of this patent is extended or adjusted under 35 U.S.C. 154(b) by 0 days.

(21) Appl. No.: 17/133,918

(22) Filed: Dec. 24, 2020

(65) Prior Publication Data

US 2021/0221639 A1 Jul. 22, 2021

(30) Foreign Application Priority Data

Dec. 26, 2019 (JP) ..... JP2019-236598
Dec. 22, 2020 (JP) ..... JP2020-212475

(51) Int. Cl.

| | |
|---|---|
| ***B65H 45/04*** | (2006.01) |
| ***B41J 13/10*** | (2006.01) |
| ***B41J 13/076*** | (2006.01) |
| ***B65H 45/16*** | (2006.01) |
| ***B41J 13/00*** | (2006.01) |

(52) U.S. Cl.

CPC ..... *B65H 45/04* (2013.01); *B41J 13/0036* (2013.01); *B41J 13/076* (2013.01); *B41J 13/103* (2013.01); *B65H 45/164* (2013.01)

(58) Field of Classification Search

CPC ..... B65H 45/164

See application file for complete search history.

(56) References Cited

U.S. PATENT DOCUMENTS 3,901,501 A * 8/1975 Kistner ..... B65H 45/18 493/444
4,419,088 A * 12/1983 Nemec ..... B65H 45/18 493/444

FOREIGN PATENT DOCUMENTS

JP 2012-056674 A 3/2012
JP 2012111607 A * 6/2012

* cited by examiner

*Primary Examiner* — Jennifer Bahls
(74) *Attorney, Agent, or Firm* — Manabu Kanesaka

(57) ABSTRACT

In order to enable a sheet to be properly guided to a nip portion in performing folding processing, a sheet processing apparatus for performing folding processing on a sheet is provided with a rotating body pair which nips the sheet by a nip portion to rotate, and thereby draws the sheet to perform folding processing, a folding blade that pushes the sheet to the nip portion of the rotating body pair, and a blade guide member including a guide portion for pushing the sheet to the nip portion when the folding blade pushes the sheet to the nip portion, where the folding blade and blade guide member are relatively shifted so that a distance from a push front edge portion to the guide portion when the folding blade pushes the sheet to the nip portion is longer than a distance from the front edge portion to the guide portion.

12 Claims, 33 Drawing Sheets

SHEET PROCESSING APPARATUS AND IMAGE FORMING SYSTEM

TECHNICAL FIELD

The present invention relates to a sheet processing apparatus to perform folding processing on a sheet fed from, for example, an image forming apparatus, and an image forming system provided with the sheet processing apparatus.

BACKGROUND ART

Conventionally, there has been a proposed sheet processing apparatus for performing folding processing on a bunch of sheets in the shape of a booklet, as post-processing of sheets discharged from an image forming apparatus such as a copier, printer, facsimile and complex apparatus thereof. For example, there is a known sheet processing apparatus for folding a predetermined position of a sheet carried out to a sheet stacker from an image forming apparatus to push into a nip portion of a folding roller pair by a push plate, and folding in two, while transporting with the folding roller pair.

Among sheet processing apparatuses for performing folding processing on sheets, as well as two-fold, there is a sheet processing apparatus for performing folding processing in two different portions of a sheet, and executing inward three-fold processing for folding so that an end portion on one side of the sheet exists inside the folded sheet.

In the case of performing the above-mentioned inward three-fold processing, when a push plate pushes a sheet to the nip portion of the folding roller pair to perform second folding processing, an end portion is sometimes turned up on the side to be folded inside the sheet folded in two by first folding processing.

In order to prevent the portion from being turned up, a configuration is proposed where a turn-up preventing member with the shape along an outside diameter of a folding roller is integrally provided on the push plate, and guides the sheet end portion to be folded to the nip portion when the push plate pushes the sheet to perform the second folding processing, and the end portion is thereby prevented from being turned up (Japanese Unexamined Patent Publication No. 2012-056674).

DISCLOSURE OF INVENTION

Problems to be Solved by the Invention

In the above-mentioned Patent Publication No. 2012-056674, the turn-up preventing member is used to perform the second folding processing, and as well as the second folding processing, also in performing the first folding processing (including normal folding processing for folding in two), it is possible to use the turn-up preventing member so as to guide the sheet to the folding roller pair side. However, in the configuration of the above-mentioned Patent Publication No. 2012-056674, it is necessary to reserve a distance to a front edge of the push plate, so that the turn-up preventing member does not hit an outer region of the folding roller, when the push plate is pushed to the vicinity of the nip portion of the folding roller pair. This distance needs to be longer, as the diameter of the folding roller is larger.

Then, in the case where the distance is long between the push plate front edge and the turn-up preventing member, when the push plate starts to push a sheet, timing is delayed at which the turn-up preventing member guides the sheet. In this case, a transport loss of the sheet occurs for a period during which the turn-up preventing member contacts the sheet, and there is the risk that folding and the like occur in the sheet.

The present invention was made in view of the above-mentioned problem, and it is an object of the invention to provide a sheet processing apparatus for enabling a sheet to be properly guided to a nip portion in performing folding processing, and an image forming system provided with the apparatus.

Means for Solving the Problem

A representative configuration according to the present invention to attain the above-mentioned object is provided with a transport path including a guide face to guide a transported sheet, a rotating body pair which nips the sheet transported to the transport path by a nip portion to rotate, and thereby draws the sheet to perform folding processing, a folding blade which includes a front edge portion for pushing the sheet transported to the transport path to the nip portion of the rotating body pair, and is capable of shifting among a first position in which the front edge portion is retracted from the transport path, a second position in which the front edge portion protrudes to the transport path by a predetermined amount, and a third position in which the front edge portion pushes the sheet to the nip portion of the rotating body pair, a blade guide member including a guide portion for pushing one end of the sheet folded by first folding processing so as to bring near to the rotating body pair, when the folding blade pushes the sheet to the nip portion in executing second folding processing, and a shift section which shifts the folding blade and the blade guide member in a push direction for pushing to the nip portion and in a return direction opposite to the push direction, in a sheet processing apparatus for performing the first folding processing on a sheet, subsequently performing the second folding processing in a position different from a fold formed by the first folding processing, and performing folding processing so that one end of the sheet folded by the first folding processing exists inside the folded sheet, where the shift section shifts the folding blade and the blade guide member relatively so that a distance from the front edge portion in the third position to the guide portion is longer than a distance from the front edge portion in the second position to the guide portion.

Further, in the present invention, a sheet processing apparatus for performing folding processing on a sheet is provided with a transport path including a guide face to guide a transported sheet, a rotating body pair which nips the sheet transported to the transport path by a nip portion to rotate, and thereby draws the sheet to perform folding processing, a folding blade which includes a front edge portion for pushing the sheet transported to the transport path to the nip portion of the rotating body pair, and is capable of shifting among a first position in which the front edge portion is retracted from the transport path, a second position in which the front edge portion protrudes to the transport path by a predetermined amount, and a third position in which the front edge portion pushes the sheet to the nip portion of the rotating body pair, a blade guide member including a guide portion for pushing the sheet so as to bring near to the rotating body pair, when the folding blade pushes the sheet to the nip portion in executing the folding processing, and a shift section which shifts the folding blade and the blade guide member in a push direction for pushing to the nip portion and in a return direction opposite to the push direction, where the shift section shifts the folding blade and the blade guide member relatively so that a distance from the front edge portion in the third position to the guide portion is longer than a distance from the front edge portion in the second position to the guide portion.

Advantageous Effect of the Invention

In the present invention, also after guiding the sheet to the vicinity of the rotating body pair by the blade guide member, the folding blade is capable of pushing the sheet. It is thereby possible to properly perform pushing of the sheet to the nip portion and the guide of the sheet.

MODE FOR CARRYING OUT THE INVENTION

Figure 1:
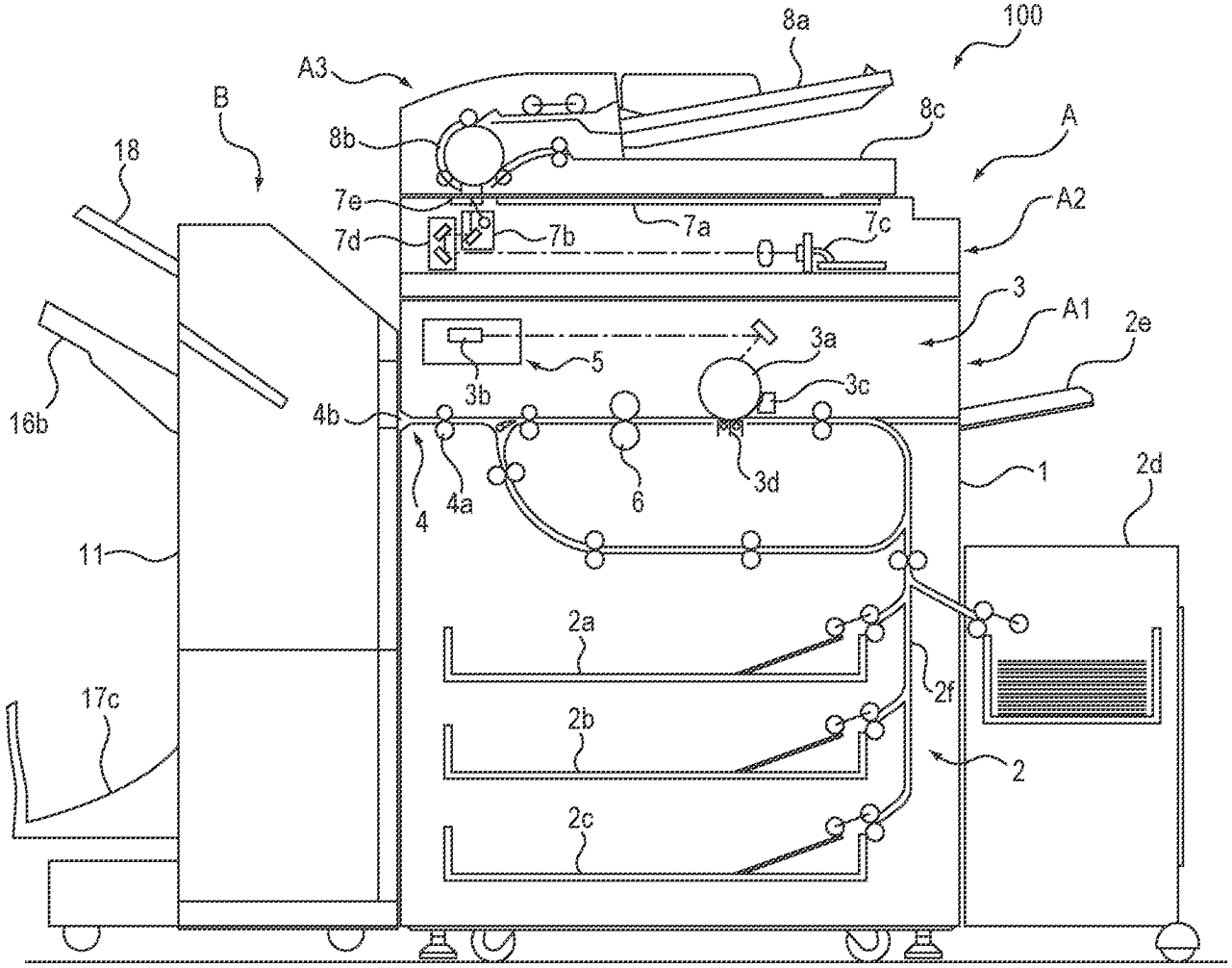
FIG. 1 is an explanatory view of the entire configuration of an image forming system of this Embodiment.

A sheet processing apparatus according to a suitable Embodiment of the present invention and an image forming system provided with the apparatus will be described next with reference to drawings. FIG. 1 schematically illustrates the entire configuration of the image forming system provided with the sheet processing apparatus according to the Embodiment of the invention. As shown in FIG. 1, the image forming system 100 is comprised of an image forming apparatus A and sheet processing apparatus B provided together in the apparatus A.

<Entire Configuration of the Image Forming Apparatus>

The image forming apparatus A is comprised of an image forming unit A1, scanner unit A2 and feeder unit A3. The image forming unit A1 is provided with a paper feed section 2, image forming section 3, sheet discharge section 4 and data processing section 5 inside an apparatus housing 1.

The paper feed section 2 is comprised of a plurality of cassette mechanisms 2*a*, 2*b* and 2*c* for storing image-forming sheets of respective different sizes, and feeds out sheets of the size designated from a main body control section not shown to a paper feed path 2*f*. Each of the cassette mechanisms 2*a*, 2*b* and 2*c* is installed to be detachable from the paper feed section 2, and includes an integral separation mechanism for separating sheets inside on a sheet-by-sheet basis and an integral paper feed mechanism for feeding out the sheet. The paper feed path 2*f* is provided with a transport roller for feeding the sheet supplied from each of the cassette mechanisms 2*a*, 2*b* and 2*c* to the downstream side, and in an end portion of the path, a registration roller pair for aligning a front end of each sheet.

To the paper feed path 2*f* are connected a large-capacity cassette 2*d* and manual feed tray 2*e*. The large-capacity cassette 2*d* is comprised of an option unit for storing sheets of a size consumed in large quantity. The manual feed tray 2*e* is configured to be able to supply particular sheets such as a thick-paper sheet, coating sheet and film sheet difficult to separate and feed.

The image forming section 3 is configured using an electrophotographic scheme in this Embodiment, and is provided with a photosensitive drum 3*a* that rotates, and a light emitting device 3*b* for emitting an optical beam, a developing device 3*c* and cleaner (not shown) arranged around the drum. The section shown in the figure is a monochrome printing mechanism, and is to irradiate the photosensitive drum 3*a* with its circumferential surface charged uniformly with the light corresponding to an image signal by the light emitting device 3*b* to optically form a latent image, and by attaching toner to the latent image with the developing device 3*c*, form a toner image.

In accordance with timing at which the image is formed on the photosensitive drum 3*a*, a sheet is fed to the image forming section 3 from the paper feed path 2*f*, transfer bias is applied from a transfer charging device 3*d*, and the toner image formed on the photosensitive drum 3*a* is thereby transferred onto the sheet. The sheet with the toner image transferred thereto is heated and pressurized when passing through a fuser device 6 to fuse the toner image, is discharged from a sheet discharge opening 4*b* by a sheet discharge roller 4*a*, and is transported to the sheet processing apparatus B described later.

The scanner unit A2 is provided with platen 7*a* for placing an image original document, a carriage 7*b* that performs reciprocating motion along the platen 7*a*, a photoelectric conversion element 7*c*, and a reduction optical system 7*d* for guiding reflected light from the original document on the platen 7*a* by the carriage 7*b* to the photoelectric conversion element 7*c*. The photoelectric conversion element 7*c* performs photoelectric conversion on optical output from the reduction optical system 7*d* into image data to output to the image forming section 3 as an electric signal.

Further, the scanner unit A2 is provided with travel platen 7*e* to read the sheet fed from the feeder unit A3. The feeder unit A3 is comprised of a paper feed tray 8*a* for stacking original document sheets, a paper feed path 8*b* for guiding the original document sheet fed out of the paper feed tray 8*a* to the travel platen 7*e*, and a sheet discharge tray 8*c* for storing the original document sheet passing through the travel platen 7*e*. The original document sheet from the paper feed tray 8*a* is read by the carriage 7*b* and reduction optical system 7*d*, in passing through the travel platen 7*e*.

<Entire Configuration of the Sheet Processing Apparatus>

Next, descriptions will be given to the entire configuration of the sheet processing apparatus B for performing post-processing on the sheet fed from the image forming apparatus A.

Figure 2:
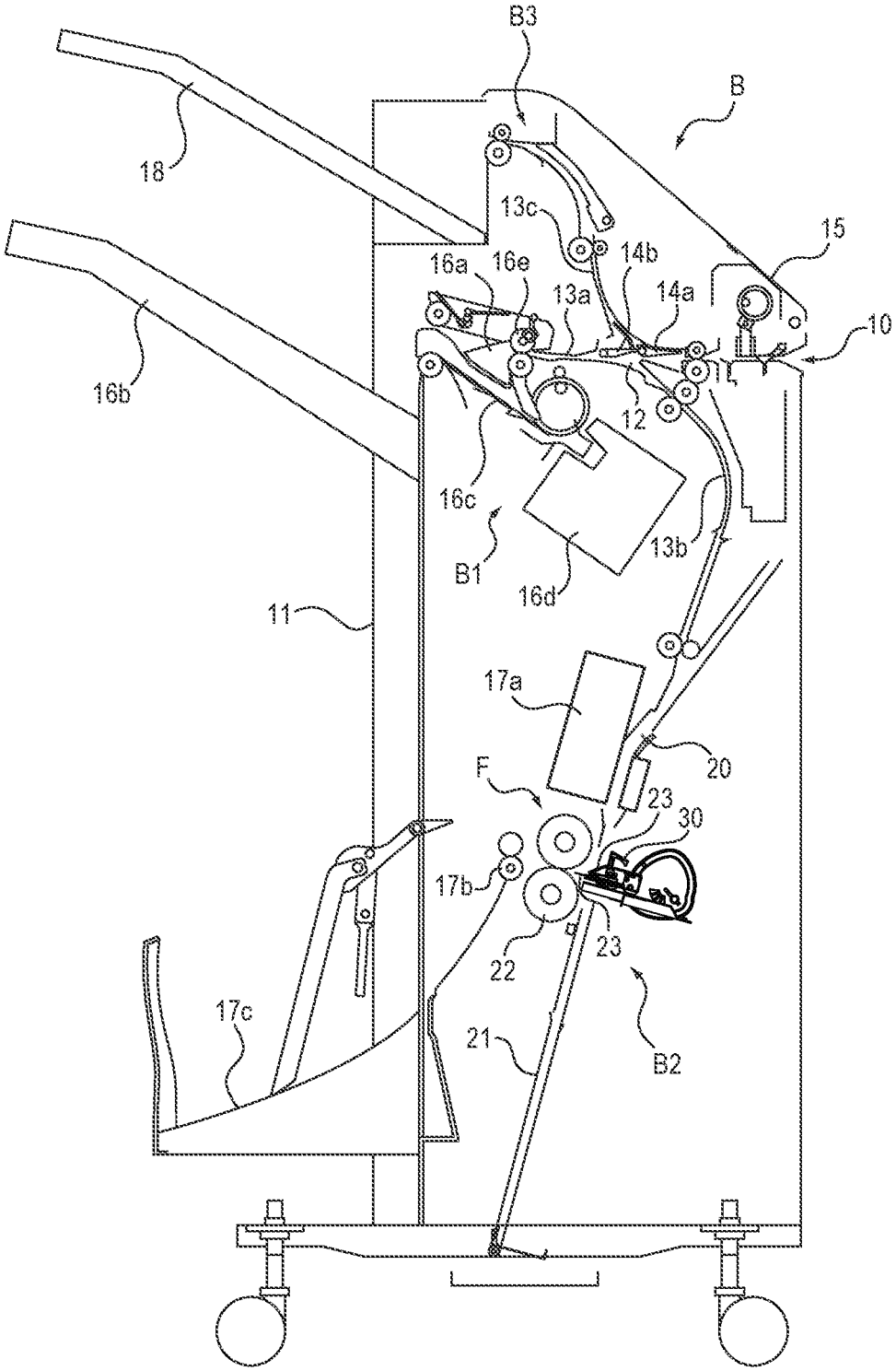
FIG. 2 is an explanatory view of the entire configuration of a sheet processing apparatus in the image forming system.

FIG. 2 is a configuration explanatory view of the sheet processing apparatus B according to this Embodiment. The sheet processing apparatus B is provided with an apparatus housing 11 provided with a carry-in opening 10 to introduce a sheet from the image forming apparatus A. The apparatus housing 11 is positioned and disposed in accordance with the housing 1 of the image forming apparatus A so as to communicate the carry-in opening 10 to the sheet discharge opening 4*b* of the image forming apparatus A.

The sheet processing apparatus B is provided with a sheet carry-in path 12 for transporting a sheet introduced from the carry-in opening 10, a first sheet discharge path 13*a* branched off from the sheet carry-in path 12, a second sheet discharge path 13*b*, a third sheet discharge path 13*c*, a first path switch portion 14*a*, and a second path switch portion 14*b*. Each of the first path switch portion 14*a* and the second path switch portion 14*b* is comprised of a flapper guide for changing a transport direction of a sheet transported in the sheet carry-in path 12.

By a drive section not shown in the figure, the first path switch portion 14*a* switches between a mode for guiding a sheet from the carry-in opening 10 in a direction of the first sheet discharge path 13*a* to transport in a lateral direction without modification and the second sheet discharge path 13*b* to transport downward, and another mode for guiding to the third sheet discharge path 13*c* to transport upward. The first sheet discharge path 13*a* and second sheet discharge path 13*b* are communicated so as to be able to reverse the transport direction of the sheet once introduced to the first sheet discharge path 13*a* to switchback-transport to the second sheet discharge path 13*b*.

The second path switch portion 14*b* is disposed on the downstream side of the first path switch portion 14*a*, with respect to the transport direction of the sheet transported in the sheet carry-in path 12. By a drive section similarly not shown in the figure, the second path switch portion 14*b* switches between a mode for introducing the sheet passing through the first path switch portion 14*a* to the first sheet discharge path 13*a*, and another mode for switchback-transporting the sheet once introduced to the first sheet discharge path 13*a* to the second sheet discharge path 13*b*.

The sheet processing apparatus B is provided with a first processing section B1, second processing section B2 and third processing section B3 which perform respective different post-processing. Further, in the sheet carry-in path 12 is disposed a punch unit 15 for punching a punch hole in the carried-in sheet.

The first processing section B1 is a binding processing section for collecting a plurality of sheets carried out of a sheet discharge opening 16*a* in a downstream end of the first sheet discharge path 13*a* with respect to the transport direction of the sheet transported in the sheet carry-in path 12 to collate and perform binding processing, and discharging to a stacking tray 16*b* provided outside the apparatus housing 11. Further, the first processing section B1 is provided with a sheet transport apparatus 16*c* for transporting the sheet or a bunch of sheets, and a binding processing unit 16*d* for performing the binding processing on the bunch of sheets. In the downstream end of the first sheet discharge path 13*a* is provided a discharge roller pair 16*e* to discharge the sheet from the sheet discharge opening 16*a* and to switchback-transport from the first sheet discharge path 13*a* to the second sheet discharge path 13*b*.

The second processing section B2 is a folding processing section for making a bunch of sheets using a plurality of the sheets switchback-transported from the second sheet discharge path 13*b*, performing the binding processing on the bunch of the sheets, and then, performing folding processing. As described later, the second processing section B2 is provided with a folding processing apparatus F for performing the folding processing on the carried-in sheet or bunch of sheets, and a binding processing unit 17*a* disposed on the immediately upstream side of the folding processing apparatus F along the sheet transport direction of the sheet transported to the second sheet discharge path 13*b* to perform the binding processing on the bunch of sheets. The bunch of sheets subjected to the folding processing is discharged to a stacking tray 17*c* provided outside the apparatus housing 11 by a discharge roller 17*b*.

The third processing section B3 performs jog sorting for sorting sheets fed from the third sheet discharge path 13*c* into a group for offsetting by a predetermined amount in a sheet width direction orthogonal to the transport direction to collect, and another group for collecting without offsetting. The jog-sorted sheets are discharged to a stacking tray 18 provided outside the apparatus housing 11, and a bunch of sheets subjected to offset and a bunch of sheets without being offset are stacked.

Figure 3:
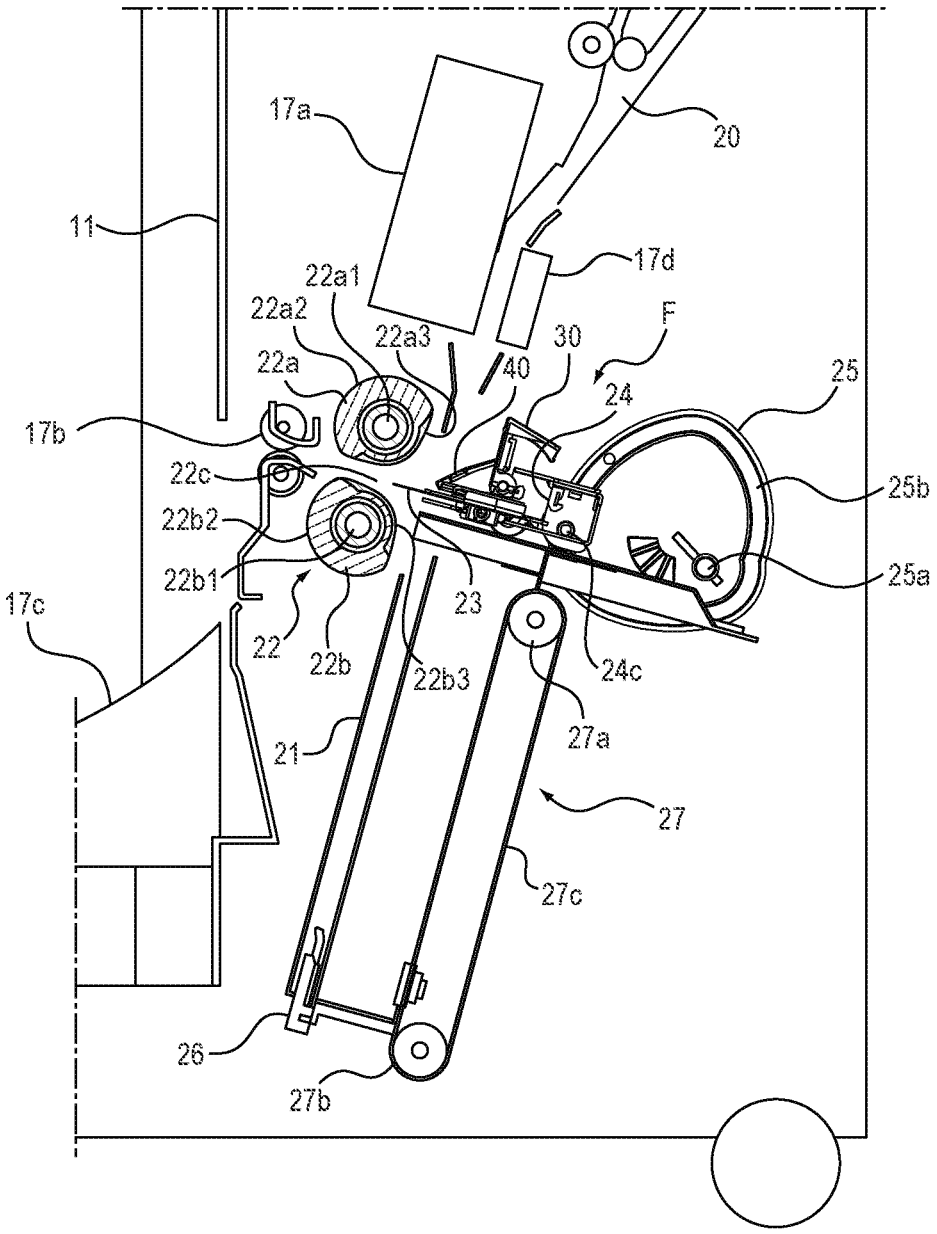
FIG. 3 is a cross-sectional view illustrating a folding processing apparatus of the sheet processing apparatus.

FIG. 3 schematically illustrates the entire configuration of the second processing section B2. As described above, the second processing section B2 is provided with the folding processing apparatus F for folding a bunch of sheets, which are carried in from the second sheet discharge path 13*b*, collected and collated, in two, and the binding processing unit 17*a* for performing the binding processing on a bunch of sheets prior to the folding processing. The binding processing unit 17*a* shown in the figure is a stapler apparatus for hitting a staple to bind the bunch of sheets.

In order to carry the sheet in the folding processing apparatus F, a sheet transport path 20 is connected to the second sheet discharge path 13*b*. With respect to the transport direction of the sheet transported to a sheet stacking tray 21 from the second sheet discharge path 13*b*, on the downstream side of the sheet transport path 20, the sheet stacking tray 21 constituting a part of the sheet transport path is provided to position the sheet undergoing the folding processing to stack. On the immediately upstream side of the sheet stacking tray 21, the binding processing unit 17*a* and its staple receiving portion 17*d* are provided in opposed positions with the sheet transport path 20 sandwiched therebetween.

On one side of the sheet stacking tray 21, a folding roller pair 22 as a folding rotating body pair is arranged to be opposed to one surface of the sheet or a bunch of sheets stacked in the sheet stacking tray. The folding roller pair 22 is comprised of a pair of folding rollers 22*a*, 22*b* with roller surfaces thereof mutually brought into press-contact, and a nip portion 22*c* that is a press-contact portion thereof is disposed toward the sheet stacking tray 21. The folding rollers 22*a*, 22*b* are disposed parallel on the upstream side and downstream side along a carry-in direction of the sheet carried in the sheet stacking tray 21 from the upstream side above to the downstream side below, with respective distances from the sheet stacking tray 21 being approximately equal. In addition, in the present invention, a rotating portion of the folding rotating body pair is not limited to the folding rollers 22*a*, 22*b* of this Embodiment, and is capable of being comprised of a rotating belt and the like. Further, the folding roller pair 22 is capable of being configured by arranging a plurality of folding rollers (rotating bodies) continuously in series along a shaft direction of each of the folding rollers 22*a*, 22*b*.

In each of the folding rollers 22*a*, 22*b* of the folding roller pair 22 of this Embodiment, as shown in FIG. 3, with the rotation shaft center of each of rotation shafts 22*a*1, 22*b*1 as the center, roller circumferential surfaces thereof have first roller surfaces 22*a*2, 22*b*2 with certain radiuses R1, and second roller surfaces 22*a*3, 22*b*3 with distances from the rotation shaft centers of the rotation shafts smaller than the radius R1 of the first roller surface, respectively. As in the normal roller surface, the first roller surfaces 22*a*2, 22*b*2 are formed of rubber materials and the like with a relatively high coefficient of friction. In contrast thereto, the second roller surfaces 22*a*3, 22*b*3 are formed of plastic resin materials and the like with a coefficient of friction smaller than the coefficient of the first roller surfaces 22*a*2, 22*b*2.

The rotation shafts 22*a*1, 22*b*1 of the folding rollers 22*a*, 22*b* are driven to rotate by a common drive section such as a drive motor. By this means, it is possible to always synchronize rotation positions of the first roller surfaces 22*a*2, 22*b*2 and the second roller surfaces 22*a*3, 22*b*3 mutually.

On the opposite side to the folding roller pair 22 across the sheet stacking tray 21, a folding blade 23 is disposed. The folding blade 23 is supported by a blade carrier 24 with its front edge directed toward the nip portion 22*c* of the folding roller pair 22. The blade carrier 24 is provided to be able to travel by a shift section comprised of a cam member and the like, in a direction traversing the sheet stacking tray 21 at an approximately right angle i.e. in a direction crossing the transport direction of the sheet transported to the sheet stacking tray 21 from the second sheet discharge path 13*b*.

In the front-back direction i.e. the shaft line direction of the folding roller in FIG. 3, on opposite sides with the blade carrier 24 therebetween, cam members 25 (only one is shown in the figure) comprised of a pair of mutually mirror symmetrical eccentric cams are provided in opposed positions. The cam member 25 rotates by a drive section such as a drive motor around a rotation shaft 25*a* provided in the eccentric position as the center. In the cam member 25, a cam groove 25*b* is formed along its outer edge.

The blade carrier 24 is provided with a cam pin 24*c* that is fitted into the cam groove 25*b* slidably as a cam follower.

When the cam member 25 is rotated by the drive motor, the blade carrier 24 reciprocates and travels in directions for approaching and separating from the sheet stacking tray 21. By this means, as shown in FIG. 3, it is possible to shift the folding blade 23 linearly to be able to proceed and retract, between an initial position that is a position in which a front edge of the folding blade 23 does not enter the sheet transport path formed of the sheet stacking tray 21, and a maximum push position in which the front edge is nipped by the nip portion 22*c* of the folding roller pair 22, along a push path for connecting between both positions.

In a lower end of the sheet stacking tray 21 is disposed a regulation stopper 26 for bringing the front end of the carried-in sheet in the transport direction into contact therewith to regulate. The regulation stopper 26 is provided to be able to move up and down along the sheet stacking tray 21 by a sheet up-and-down mechanism 27.

The sheet up-and-down mechanism 27 of this Embodiment is a conveyor belt mechanism which is disposed on the back side of the sheet stacking tray 21, below the blade carrier 24 when the carrier is in the initial position that is a position in which the front edge of the folding blade 23 does not enter the sheet transport path formed of the sheet stacking tray 21, and which is comprised of a pair of pulleys 27*a*, 27*b* respectively disposed near an upper end and lower end of the sheet stacking tray 21 along the tray 21, and a conveyor belt 27*c* looped between both of the pulleys. The regulation stopper 26 is fixed onto the conveyor belt 27*c*. By rotating the pulley 27*a* or 27*b* on the drive side by a drive section such as a drive motor, the regulation stopper 26 moves up and down between a lower end position and a desired height position shown in FIG. 3, and is thereby capable of shifting the sheet or bunch of sheets along the sheet stacking tray 21.

Figure 4:
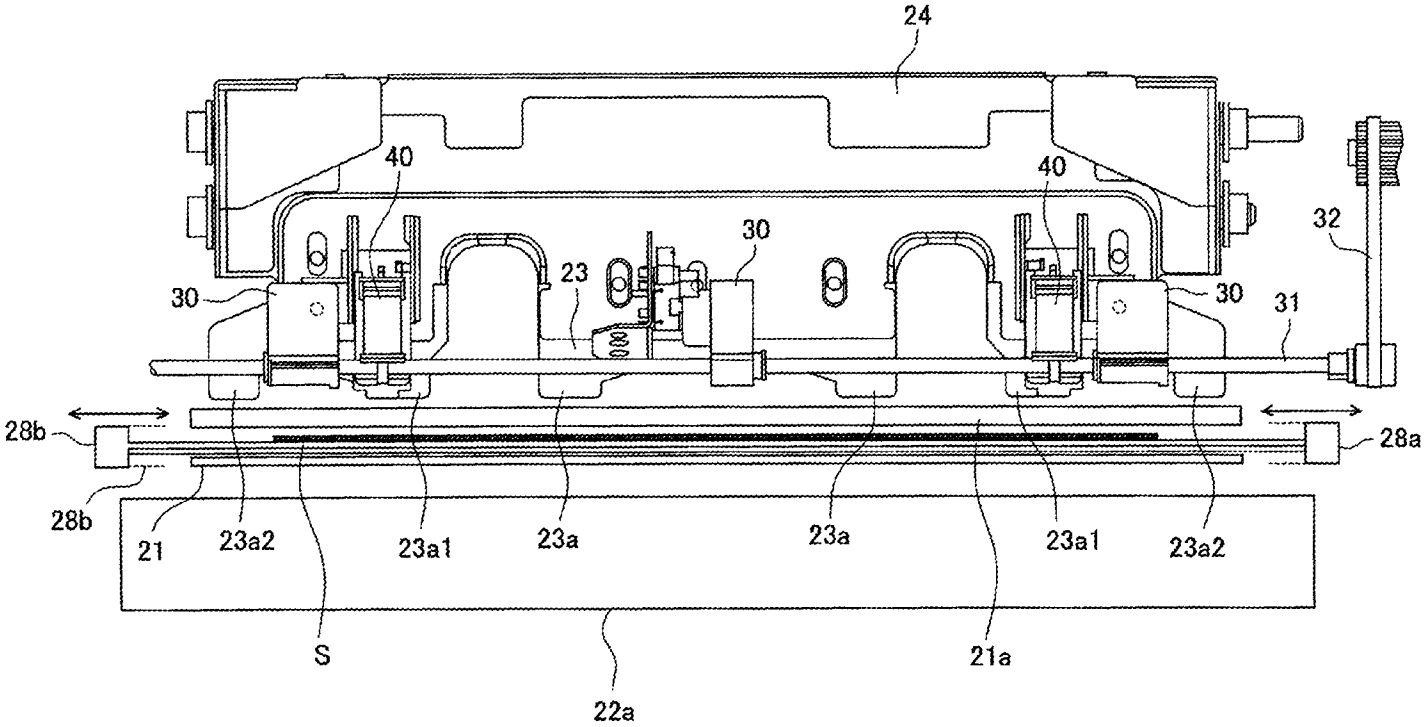
FIG. 4 is a plan view illustrating a sheet folding processing apparatus.

Moreover, the folding processing apparatus F of this Embodiment is further provided with a sheet side-portion alignment mechanism to align side edges of the sheet carried in the sheet stacking tray 21 to perform alignment. As shown in FIG. 4, the sheet side-portion alignment mechanism includes a pair of sheet side-portion alignment members 28*a*, 28*b* disposed symmetrically on opposite sides of the sheet stacking tray 21 in the sheet width direction (direction orthogonal to the sheet transport direction). In addition, FIG. 4 is a plan schematic view obtained by viewing the folding processing apparatus F from above. The sheet side-portion alignment members 28*a*, 28*b* are held to be capable of shifting to be able to relatively approach and separate in the sheet width direction. With respect to the sheet which is transported to the sheet stacking tray 21 and of which the front end strikes the regulation stopper 26, the sheet side-portion alignment members 28*a*, 28*b* are shifted, and thereby align positions of the sheet in the width direction.

<Inward Three-Fold Processing>

The sheet processing apparatus B of this Embodiment is capable of performing inward three-fold processing on the sheet transported to the sheet stacking tray 21 that is the sheet transport path, by the folding processing apparatus F. The inward three-fold processing is processing for folding in three so that an end portion on one side of a sheet folded by first folding processing is folded inside the sheet folded by second folding processing, when the sheet is folded in two by the first folding processing and the second folding processing is performed on the sheet in a portion different from a first fold position. Herein, schematic operation in performing the inward three-fold processing by the folding processing apparatus F of this Embodiment will be described with reference to FIGS. 5A to 11B. FIGS. 5A to 11B illustrate, in cross-sectional schematic views, motion of each section according to a flow of a sheet S when the inward three-fold processing is executed.

Figure 5B:
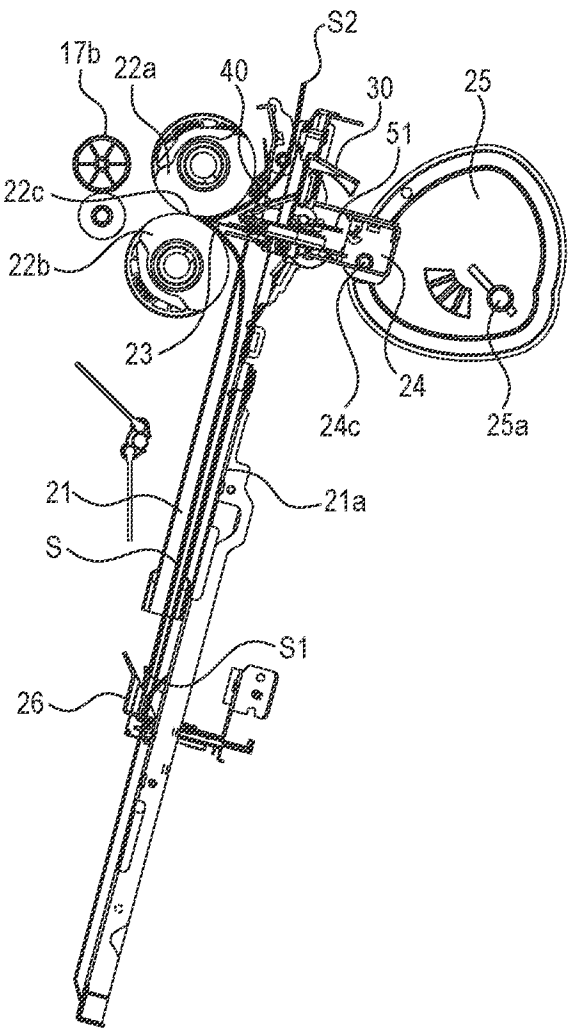
FIGS. 5A and 5B are cross-sectional explanatory views of inward three-fold operation on a sheet.
Figure 5A:
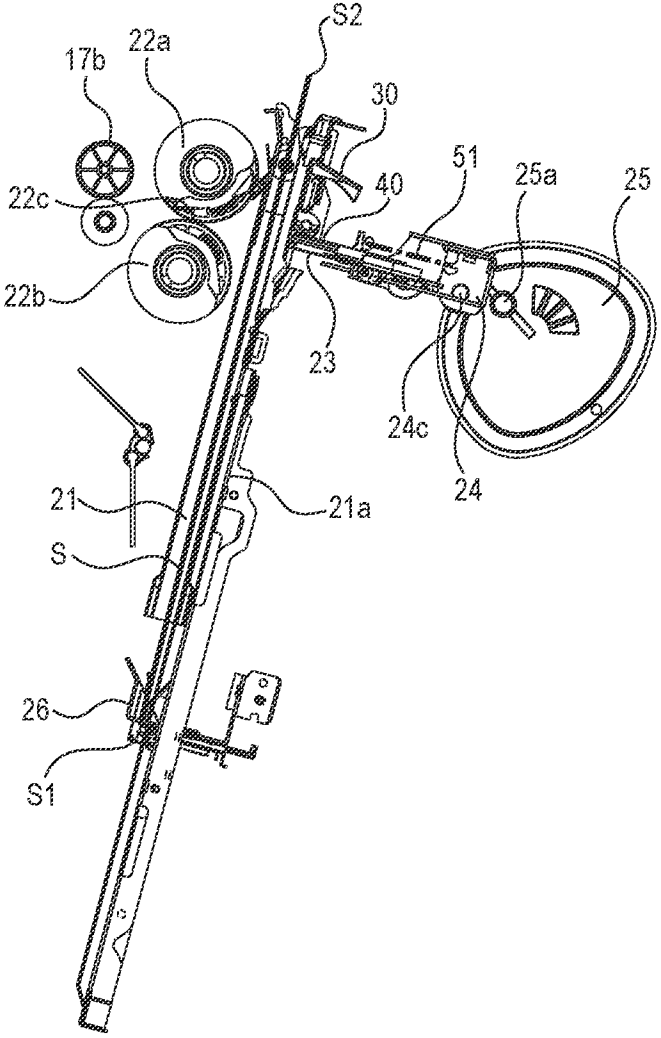

The sheet stacking tray 21 of this Embodiment is formed, while being inclined with respect to the vertical direction, and while the surface on one side of the sheet S is guided by a guide face 21*a* forming the sheet stacking tray 21, the sheet is transported so as to fall with a sheet front end S1 down and a sheet rear end S2 up, and is halted when the sheet front end is struck by the regulation stopper 26 (FIG. 5A). At this point, a position of the regulation stopper 26 is disposed so that the first fold position of the sheet S with the sheet front end S1 struck is a position opposed to the folding blade 23. The folding blade 23 is disposed in the position for pushing out the sheet S toward the folding roller pair 22 from the side of the guide face 21*a* of the sheet stacking tray 21. In other words, the guide face 21*a* of the sheet stacking tray 21 and the folding roller pair 22 are disposed in positions that correspond to each other with the sheet S therebetween.

Figure 6B:
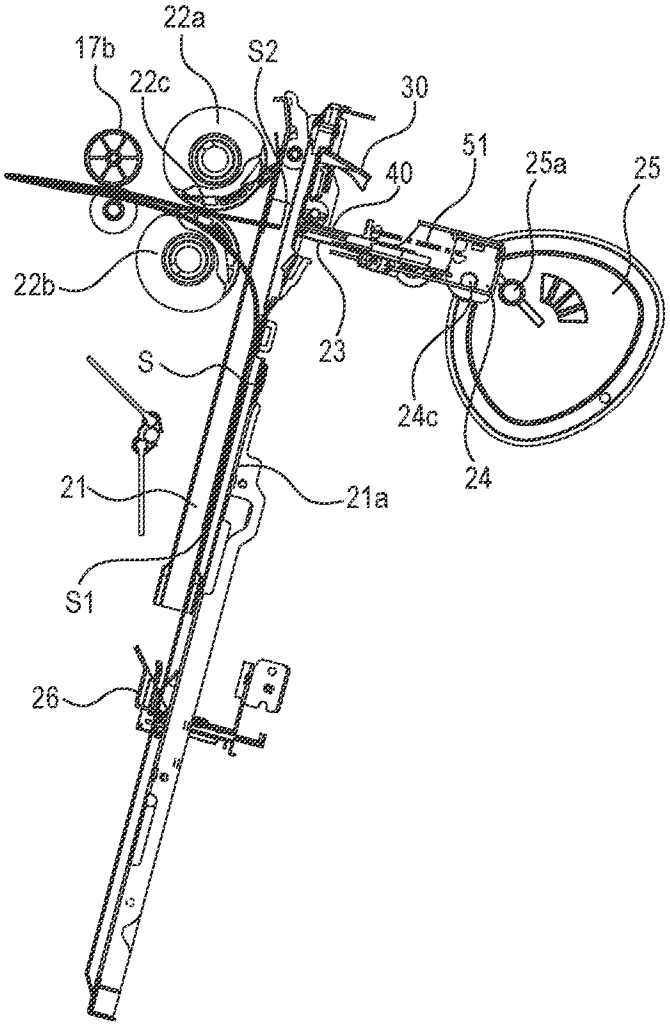
FIGS. 6A and 6B are cross-sectional explanatory views of inward three-fold operation on the sheet.
Figure 6A:
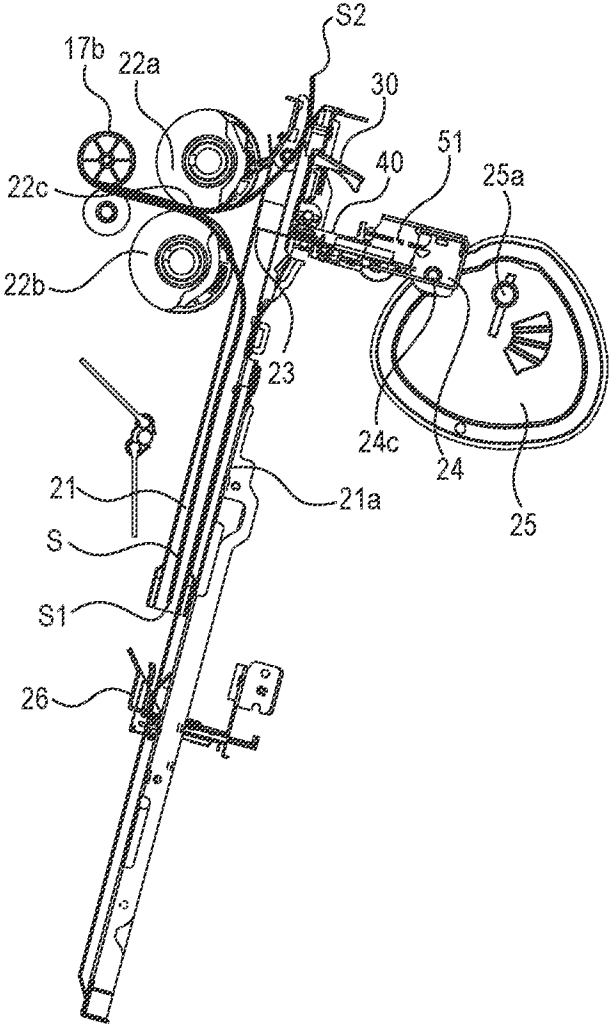

After aligning the positions in the sheet width direction by the sheet side-portion alignment members 28*a*, 28*b* described previously in this state, the folding blade 23 is operated to fold the sheet S in two, and pushes out the folded portion to the nip portion 22*c* of the folding roller pair 22 (FIG. 5B). In synchronization with push operation of the folding blade 23, the folding roller pair 22 and discharge roller 17*b* are driven to rotate forward, and draw the sheet S into the folding roller pair 22 and discharge roller 17*b*. By this means, the sheet S is pressed by the nip portion of the folding roller pair 22, and the first folding processing is performed (FIG. 6A).

Figure 7B:
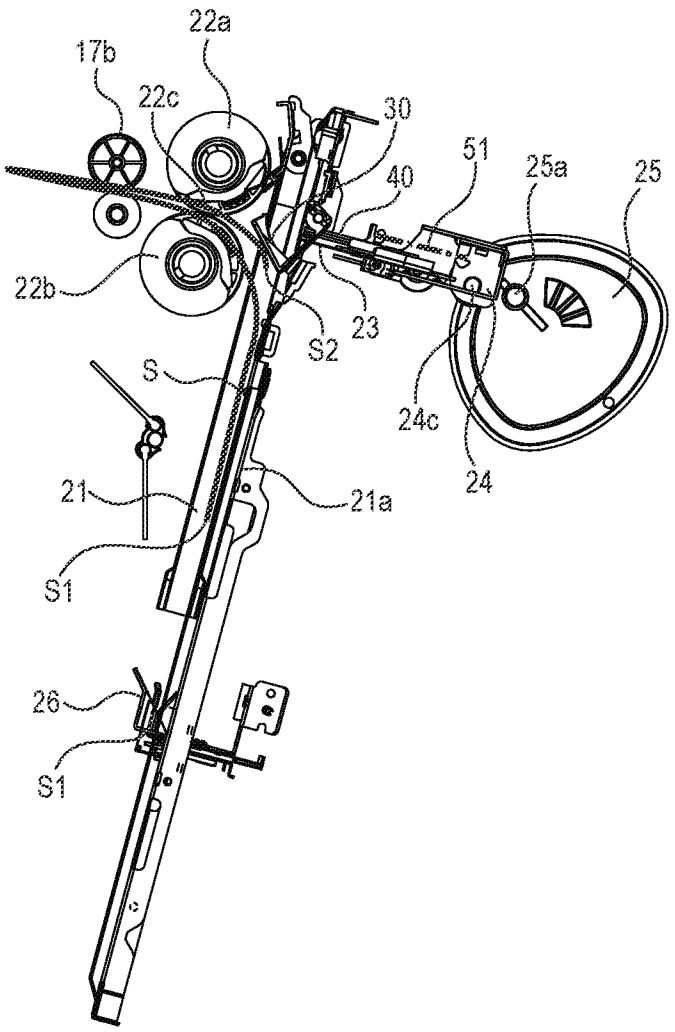
FIGS. 7A and 7B are cross-sectional explanatory views of inward three-fold operation on the sheet.
Figure 7A:
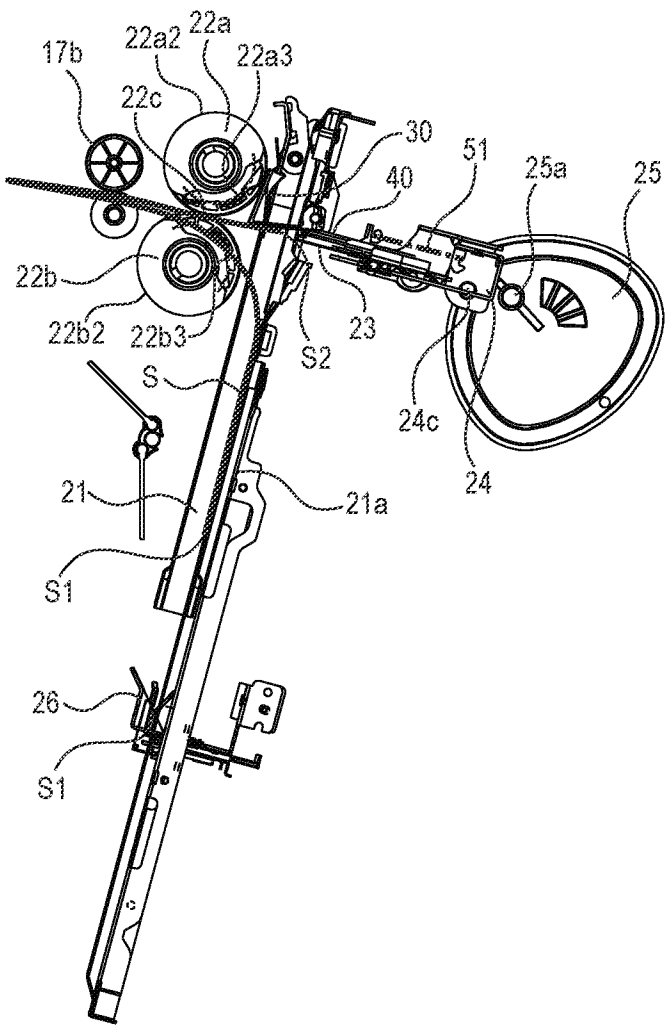
Figure 8B:
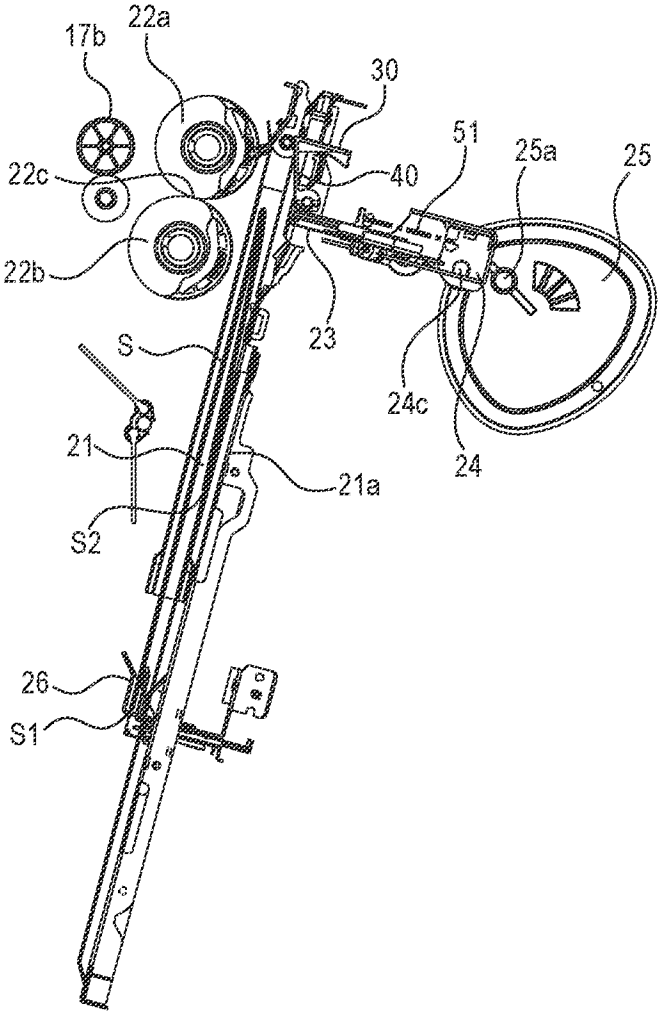
FIGS. 8A and 8B are cross-sectional explanatory views of inward three-fold operation on the sheet.
Figure 8A:
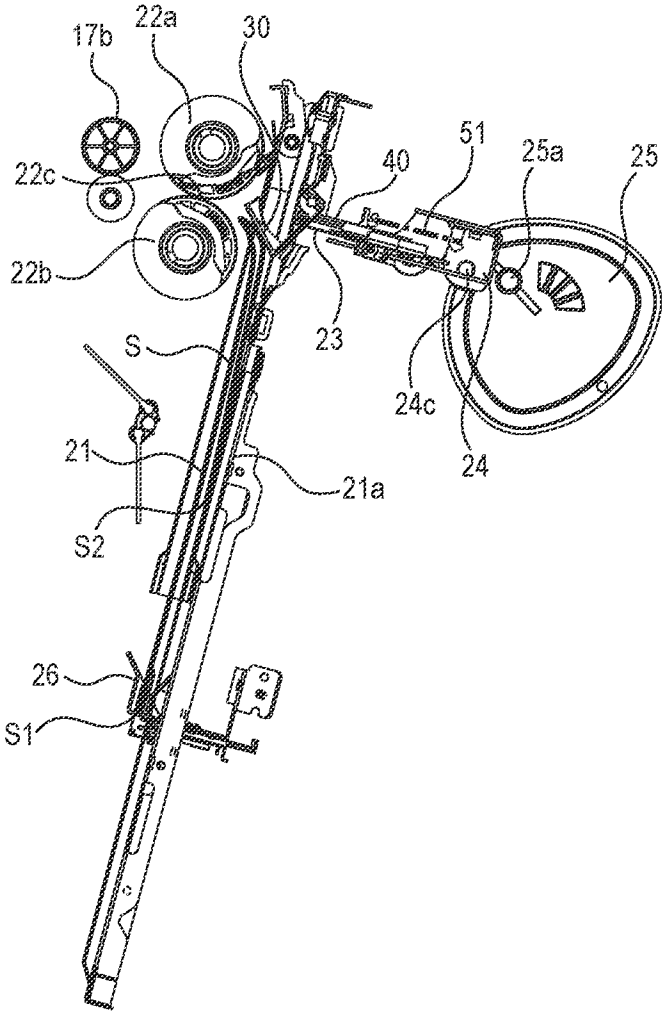

In order to perform the second folding processing next, sheet transport is halted at the time the sheet rear end S2 subjected to the first folding processing arrives at a predetermined position (FIG. 6B), and the folding roller pair 22 and discharge roller 17*b* are driven to rotate backward to execute switchback-transport processing. In performing the inward three-fold processing on the sheet, the sheet rear end S2 is an end portion (hereinafter, referred to as "fold-in end portion") which is folded inside the sheet folded by the second folding processing. Then, in performing the switchback-transport processing, the fold-in end portion S2 is pressed downward (direction of the sheet stacking tray 21 where the sheet front end S1 exists) by an L-shaped press guide member 30 (FIG. 7A), and the press guide member 30 guides the sheet S which is again transported in the direction of the sheet stacking tray 21 where the regulation stopper 26 is disposed (FIG. 7B). In addition, the configuration and operation of the press guide member 30 will be described later in detail.

Figure 9B:
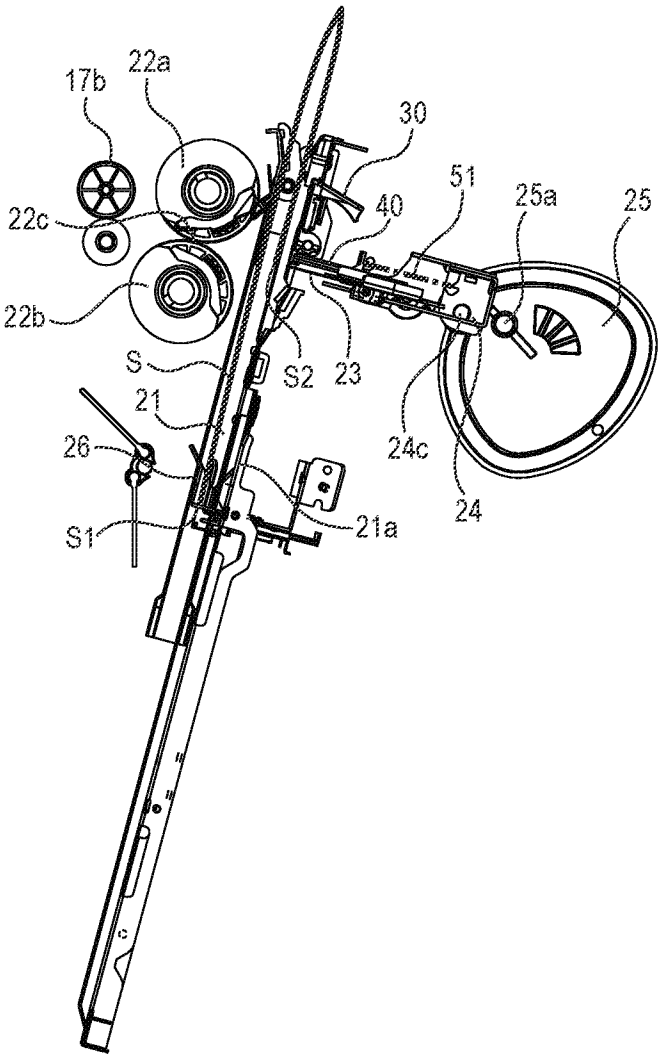
FIGS. 9A and 9B are cross-sectional explanatory views of inward three-fold operation on the sheet.
Figure 9A:
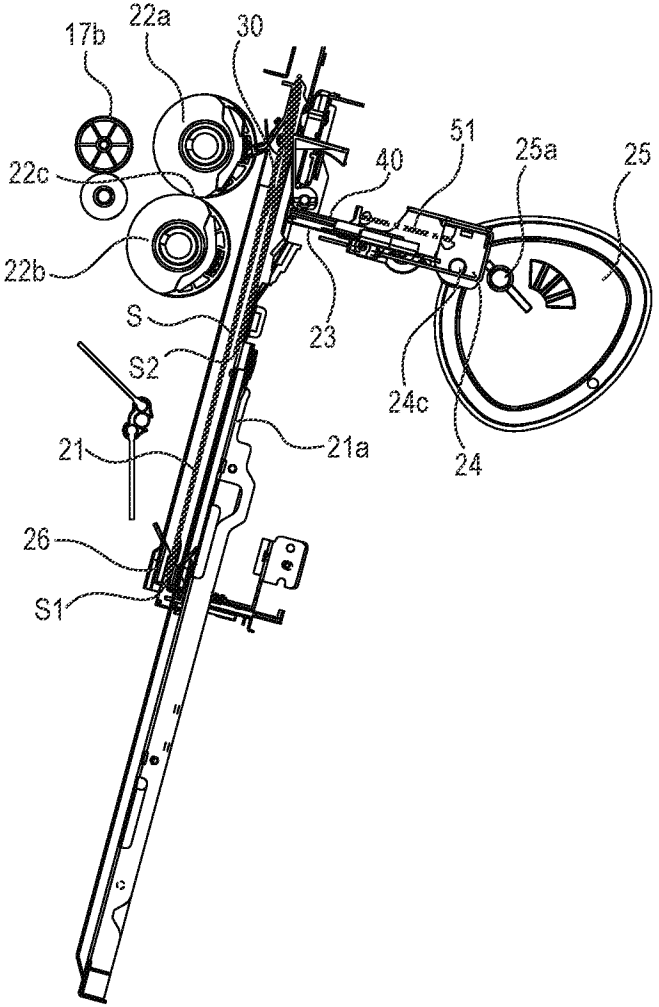

When the front end of the sheet S arrives at the regulation stopper 26 that is shifted beforehand to a sheet receiving position, by switchback-transport (FIG. 8A), the press guide member 30 is returned to a retract position, and then, is shifted to a backward transport guide position (FIG. 8B), and the regulation stopper 26 is shifted to a position such that a second fold position is opposed to the folding blade 23 (FIG. 9A). Then, after completing the shift, the press guide member 30 is shifted to a guide position parallel with the guide face 21*a* of the sheet stacking tray 21 (FIG. 9B).

Figure 10B:
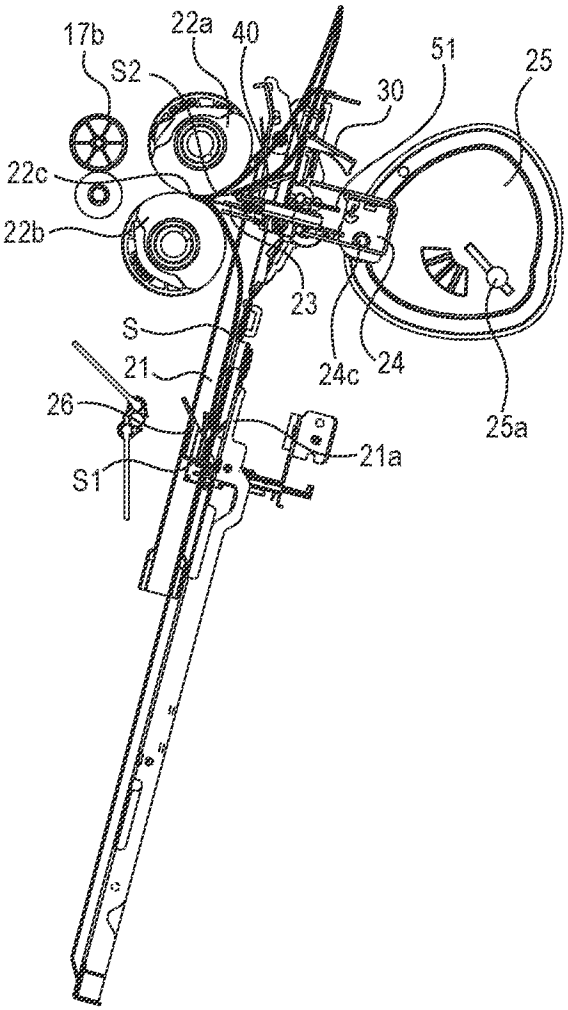
FIGS. 10A and 10B are cross-sectional explanatory views of inward three-fold operation on the sheet.
Figure 10A:
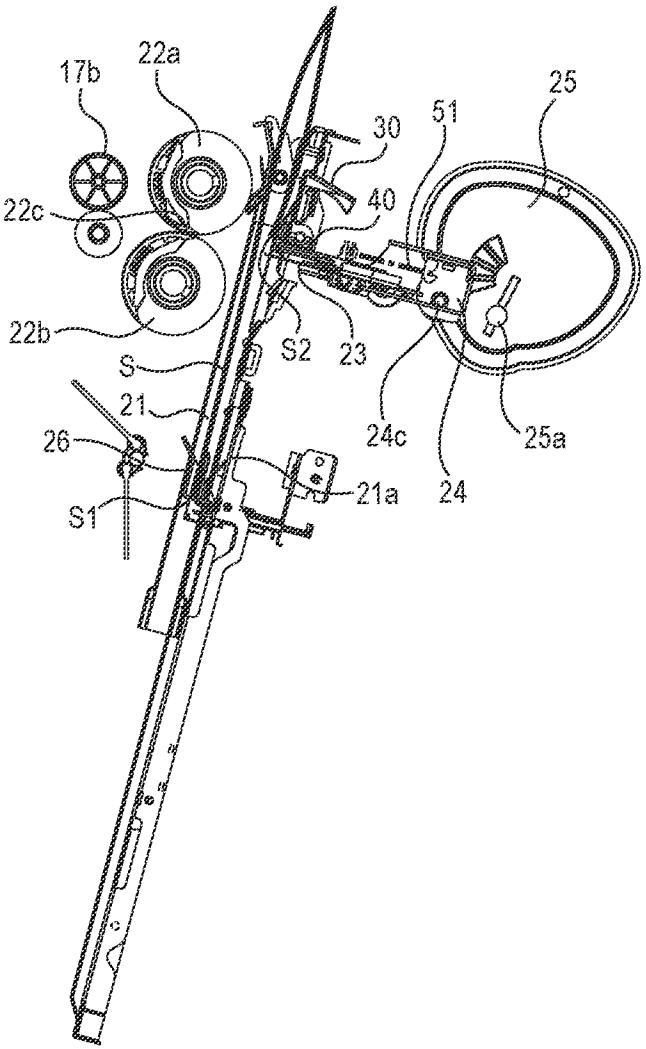

Next, the folding blade 23 is operated again to push the sheet S to the nip portion 22*c* of the folding roller pair 22 (FIG. 10A). At this point, a blade guide member 40 that is a push guide member disposed above the folding blade 23 protrudes, and the fold-in end portion S2 of the sheet is thereby guided to be pushed into the nip portion 22*c* (FIG. 10B). In addition, the configuration and operation of the blade guide member 40 will be described later also in detail.

Figure 11B:
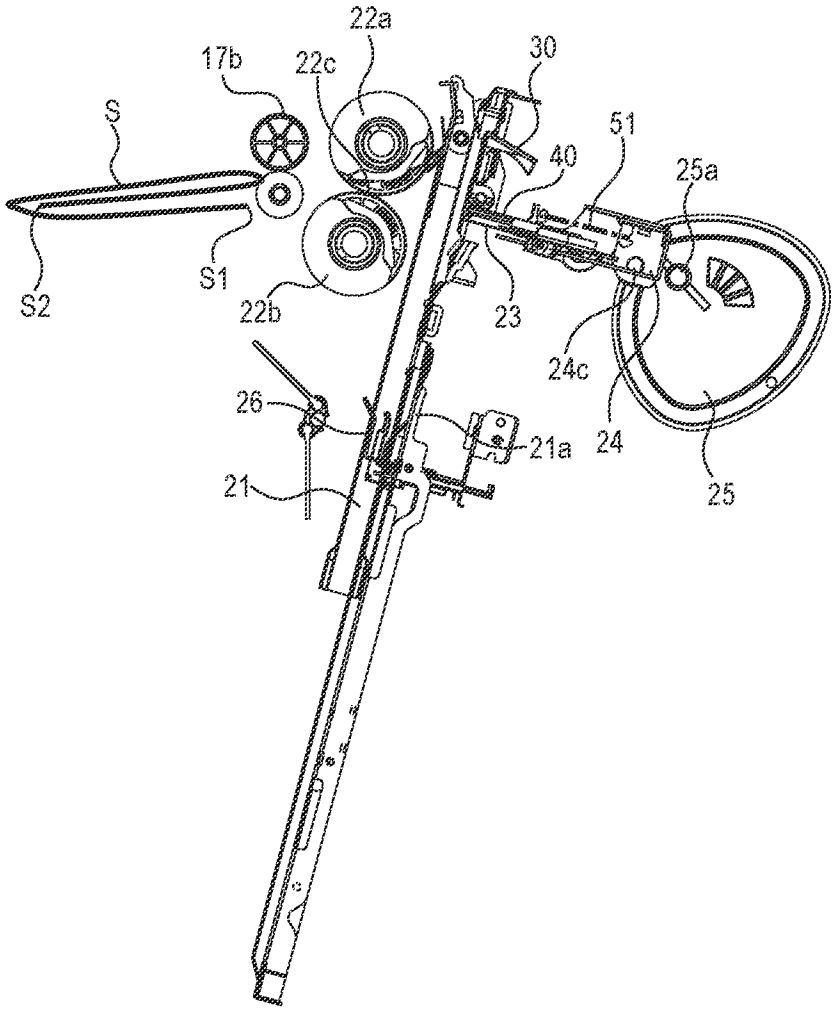
FIGS. 11A and 11B are cross-sectional explanatory views of inward three-fold operation on the sheet.
Figure 11A:
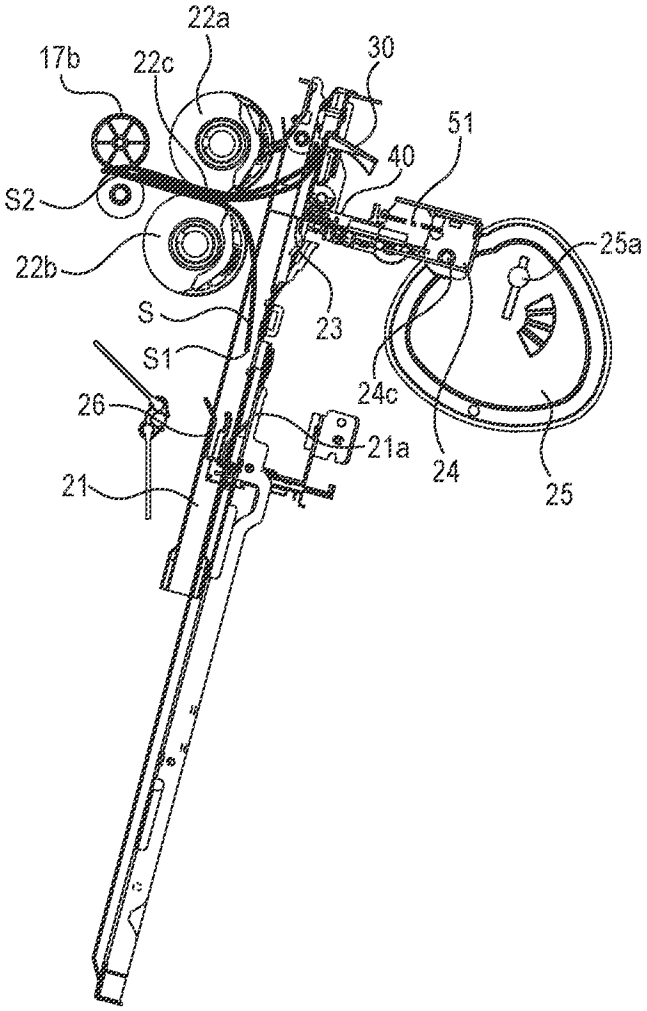

The sheet S fed to the folding roller pair 22 by push of the folding blade 23 passes through the nip portion 22*c* and is thereby subjected to the second folding processing (FIG. 11A), and the inward three-folded sheet S is discharged by the discharge roller 17*b* (FIG. 11B).

<Press Guide Member>

Figure 12:
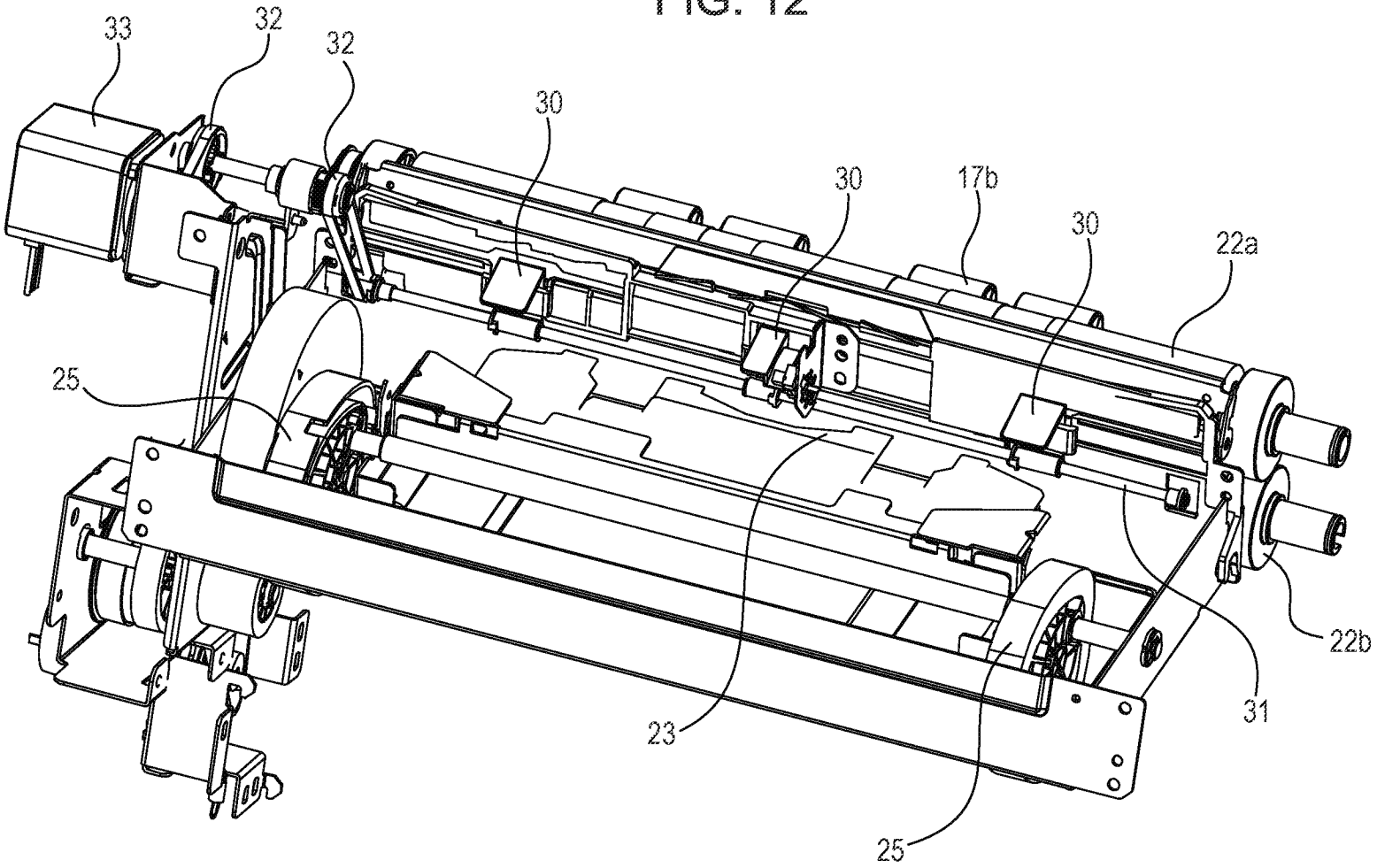
FIG. 12 is a perspective view of a part of the sheet folding processing apparatus.
Figure 13:
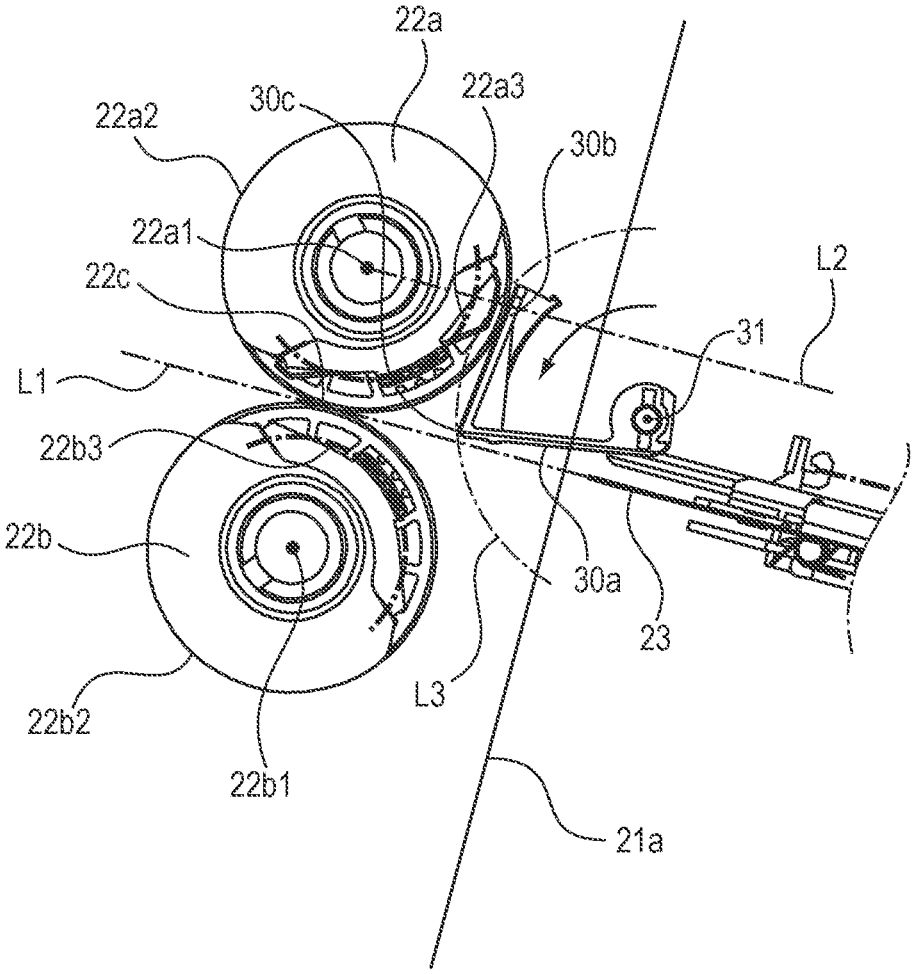
FIG. 13 is an arrangement explanatory view of a folding roller pair, folding blade and press guide member.
Figure 14A:
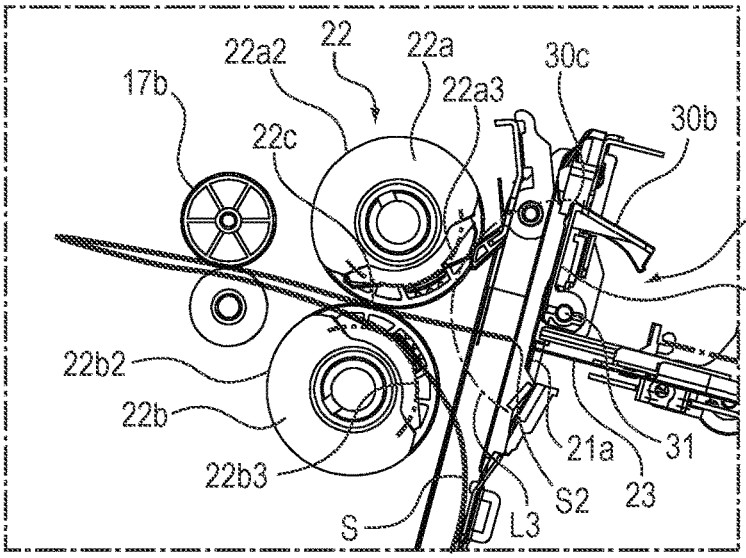
FIGS. 14A, 14B and 14C are operation explanatory views of the press guide member.
Figure 14B:
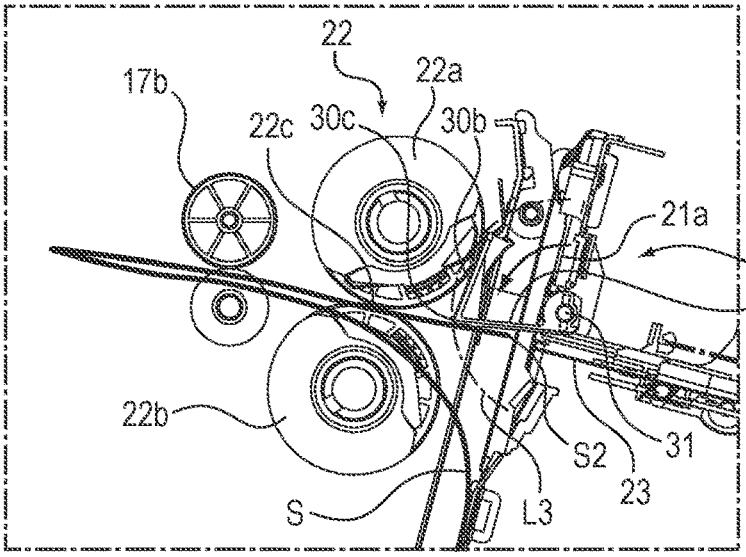
Figure 14C:
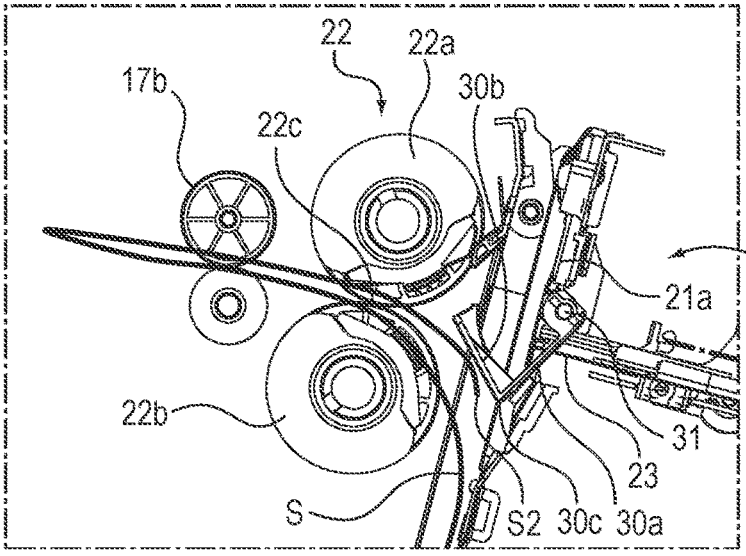

The press guide member 30 that is the press member described previously will be described next with reference to FIGS. 12 to 14C. In addition, FIG. 12 is a perspective view of the folding processing apparatus F in a state in which the press guide member 30 is exposed, and FIG. 13 is a view illustrating a relationship between a rotation locus of the press guide member 30 and another member. FIGS. 14A to 14C contain operation explanatory views of the press guide member 30.

(Shape of the Press Guide Member)

The press guide member 30 presses the fold-in end portion S2 of the sheet downward, and guides to transport to the sheet stacking tray 21, in switchback-transporting the sheet with the first folding processing executed. In other words, the press guide member 30 is also a direction change member to change the direction of the fold-in end portion S2 of the sheet to the direction of the sheet stacking tray 21 where the sheet front end S1 exists, in switchback-transporting the sheet with the first folding processing executed.

As shown in FIG. 12 (and see FIG. 4), the press guide member 30 is disposed on the side opposite to the side on which the folding roller pair 22 is disposed with the sheet S guided to the guide face 21*a* of the sheet stacking tray 21 therebetween. Then, in this Embodiment, three members are attached, at approximately regular intervals, to a rotation shaft 31 that is a support member disposed in the sheet width direction. Two members on opposite sides are disposed in positions for enabling the members to come into contact with opposite end portions of the sheet S transported in the sheet stacking tray 21, and one member in the center is disposed in a position for enabling the member to come into contact with substantially the center of the transported sheet in the width direction.

The above-mentioned press guide member 30 is capable of shifting by a shift section. In this Embodiment, the rotation shaft 31 is coupled to a press guide motor 33 via a drive transfer member 32 such as a drive belt, and it is configured that the rotation shaft 31 is rotated by drive of the press guide motor 33, and that integrally therewith, three press guide members 30 are capable of rotating.

As shown in FIG. 13, the press guide member 30 has a rotation portion 30*a* capable of rotating around the rotation shaft 31 as the center, and a guide portion 30*b* that is a first guide face for guiding the sheet S undergoing switchback-transport, and is comprised of a member of L-shaped cross section where the guide portion 30*b* is coupled at an approximately right angle, while being continued to the rotation portion 30*a*. Then, a portion between the rotation portion 30*a* and the guide portion 30*b* i.e. a corner portion of the shape of an L that is the front end of the rotation portion 30*a* is formed as a press portion 30*c* for pressing the sheet S.

A notch is formed in the guide face 21*a*, and the press guide member 30 is provided to be exposed from the notch. Then, when the sheet S is carried in the sheet stacking tray 21, the member retracts to a retract position (see FIG. 5A). When the member is in the retract position, the rotation portion 30*a* is provided to be substantially the same plane as the guide face 21*a*. Therefore, the rotation portion 30*a* functions as a part of the guide face 21*a*, and acts as a guide face (second guide face) for guiding the sheet carried in the sheet stacking tray 21. Then, it is essential only that the guide portion 30*b* does not protrude from the guide face 21*a* when the press guide member 30 is in the retract position, and it is thereby possible to reduce storage space of the press guide member 30 in the retract state.

(Position of the Rotation Center)

As shown in FIG. 13, the rotation shaft 31 that is the rotation center of the press guide member 30 of this Embodiment is disposed on the upstream side from a nip line L1 for connecting between the nip portion 22*c* of the folding roller pair 22 and the front edge portion of the folding blade 23, in the transport direction in which the sheet S is carried in the sheet stacking tray 21, and is disposed on the side opposite to the side on which the folding roller pair 22 is disposed with the guide face 21 of the sheet stacking tray 21 therebetween. Further, the rotation shaft 31 of this Embodiment is disposed on the downstream side, in the transport direction, from a shaft line L2 which passes through the rotation shaft 22*a*1 of the folding roller disposed on the upstream side from the nip line L1 in the sheet transport direction in the folding rollers 22*a*, 22*b* i.e. the folding roller 22*a* existing on the side closer to the rotation shaft 31, and which is parallel with the nip line L1.

Then, the rotation portion 30*a* is configured to rotate in a direction in which the press portion 30*c* presses the sheet S to the side for switchback-transport.

Accordingly, in switchback-transporting the sheet S with the first folding processing executed thereon, as shown in FIG. 14A, when the press guide member 30 in the retract position rotates, as shown in FIG. 14B, the press portion 30*c* presses the fold-in end portion S2 of the sheet down from above the fold-in end portion S2 to below. By this means, the fold-in end portion S2 is guided to the downstream side (downward) in the sheet stacking tray 21 in the sheet transport direction, in which the sheet S is received in the sheet stacking tray 21 before the first folding processing is performed, while being switchback-transported. In other words, the press portion 30*c* changes the direction of the fold-in end portion S2 of the sheet to the direction of the sheet stacking tray 21 where the sheet front end S1 exists. After changing the direction of the fold-in end portion S2, the press guide member 30 stays in the position without changing, and is thereby capable of guiding the fold-in end portion S2 to the downstream side in the sheet transport direction, in which the sheet S is received in the sheet stacking tray 21 before the first folding processing is performed.

Further, as shown in FIG. 14C, when the press portion 30*c* rotates to a guide position where the portion is rotated to a position of the guide face 21*a*, the press portion 30*c* comes into contact with the sheet, then presses the fold-in end portion S2 of the sheet down so as to draw into the guide face 21*a* side from the nip portion 22*c* side, and guides the portion in a direction of the sheet stacking tray 21 where the regulation stopper 26 is disposed. Therefore, even when the fold-in end portion S2 of the sheet is curled upward, the sheet des not proceed toward above in the sheet stacking tray 21, and is reliably transported toward below.

(Rotation Region of the Rotation Portion)

A length of the rotation portion 30*a* of the press guide member 30 of this Embodiment i.e. a length from the rotation shaft 31 that is a rotation support to the press portion 30*c* is configured to be longer than the shortest distance to the first roller surface 22*a*2 in the folding roller 22*a* on the side closer to the rotation shaft 31, and be shorter than the shortest distance to the second roller surface 22*a*3, in two folding rollers 22*a*, 22*b*, as shown in FIG. 13.

As described above, even when the length of the rotation portion 30*a* is set to be longer than the shortest distance to the first roller surface 22*a*2, by halting the folding roller pair 22 so that the second roller surfaces 22*a*3, 22*b*3 are opposed to the rotation portion 30*a* in switchback of the sheet, in rotating the rotation portion 30*a*, the portion does not interfere with the folding roller pair 22. Then, since it is possible to set the rotation portion 30*a* to be longer than the shortest distance to the first roller surface 22*a*2 that is the large-diameter portion of the folding roller 22*a*, with respect to the sheet undergoing switchback-transport, the press portion 30*c* presses in a position nearer the nip portion 22*c*, and guides to the sheet stacking tray 21 with more reliability.

In addition, in the case of making the rotation portion 30*a* long, in order for the rotating press guide member 30 not to interfere with the folding blade 23, the rotation shaft 31 should be disposed in a position apart from the folding blade 23 in the sheet transport direction. In this case, as a result, the rotation shaft 31 should be disposed in a position also apart from the folding roller pair 22. In this respect, in this Embodiment, as described previously, since the rotation shaft 31 is configured to be disposed between the nip line L1 and the rotation shaft line L2 in the sheet transport direction, without increasing the length of the rotation portion 30*a* unnecessarily, it is possible to bring the position for the press portion 30*c* to press the sheet undergoing switchback-transport closer to the nip portion 22*c*.

Herein, for the folding roller pair, as well as using the rollers with different diameters having the first roller surfaces 22*a*2, 22*b*2 and second roller surfaces 22*a*3, 22*b*3 with the diameters being different as in this Embodiment, it is also possible to use a roller pair with certain roller diameters, and in this case, it is necessary to make the length of the rotation portion 30*a* shorter than the shortest distance to the outer region of the folding roller on the side closer to the rotation shaft.

Further, as shown in FIG. 13, the press guide member 30 of this Embodiment is in the shape that the guide portion 30*b* is inside a rotation locus L3 of the rotation portion 30*a*, and does not protrude outside the region. By this means, as described previously, even when the rotation portion 30*a* configured to be long rotates, the guide portion 30*b* does not interfere with the folding roller pair 22.

In switchback-transporting the sheet subjected to the first folding processing as described above, the sheet is returned to the sheet stacking tray 21, while being guided by the press guide member 30. After the sheet comes into contact with the regulation stopper 26 and switchback-transport is completed, the press guide member 30 is returned to the retract position. At this point, the member is shifted to the backward transport guide position protruding to the sheet transport path side slightly more than the guide face 21*a*, so that the rotation portion 30*a* that is the second guide face of the press guide member 30 is a guide of the sheet S transported in the reverse direction in the sheet stacking tray 21 (see FIG. 8B).

After the press guide member 30 shifts to the above-mentioned backward transport guide position, the regulation stopper 26 is moved up, and the sheet is transported backward so that the second fold position is in the position opposed to the folding blade 23. At this point, the sheet S is guided by the rotation portion 30*a* of the press guide member 30, and therefore, is transported, without being caught in the notch for attachment of the press guide member formed in the guide face 21*a*, and the like (see FIG. 9A).

<Blade Guide Member>

As described above, after the second fold position of the sheet subjected to the switchback-transport shifts to the position opposed to the folding blade 23, the press guide member 30 is shifted to the retract position, and the folding blade 23 is operated to execute second folding operation. At this point, it is configured that the blade guide member 40 provided above the folding blade 23 guides the fold-in end portion S2 of the sheet (see FIG. 10B).

The configuration and operation of the blade guide member 40 will specifically be described next with reference to FIGS. 15A to 19B. In addition, FIGS. 15A and 15B contain rotation explanatory views of the blade guide member 40, and FIGS. 16A to 19B contain views illustrating operation of the folding blade 23 and blade guide member 40 in executing the second folding processing on the sheet.

(Configuration of the Blade Guide Member)

Figure 15A:
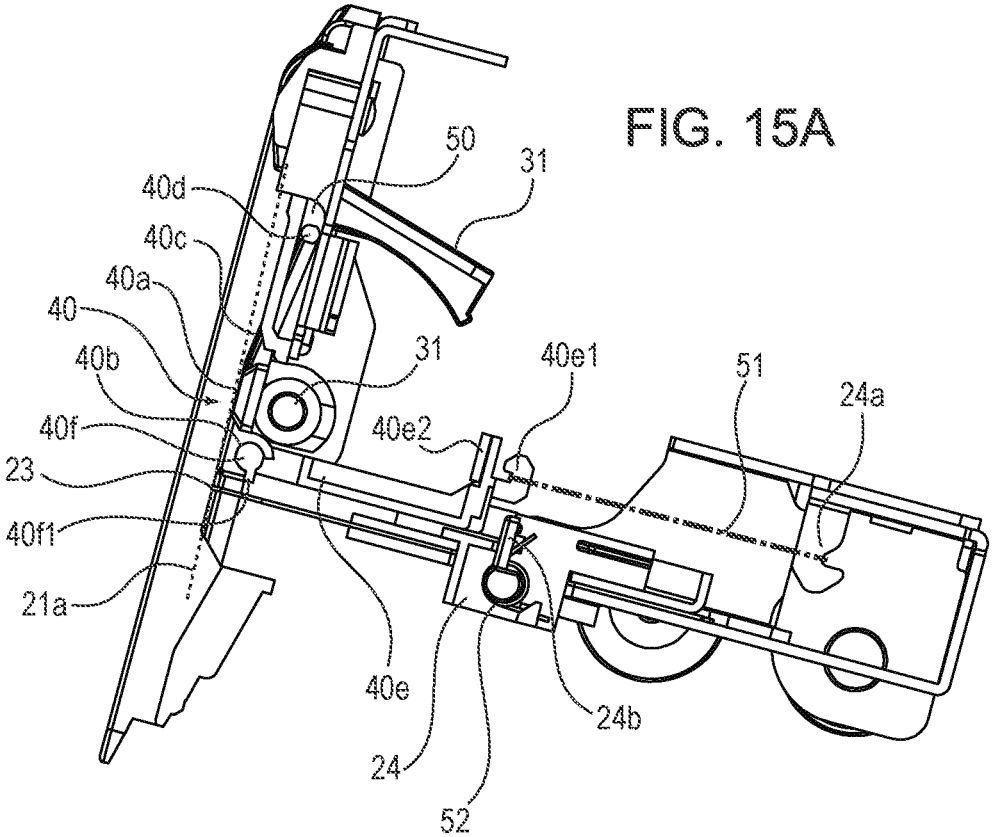
FIGS. 15A and 15B are cross-sectional explanatory views of operation of the folding blade and blade guide member.
Figure 15B:
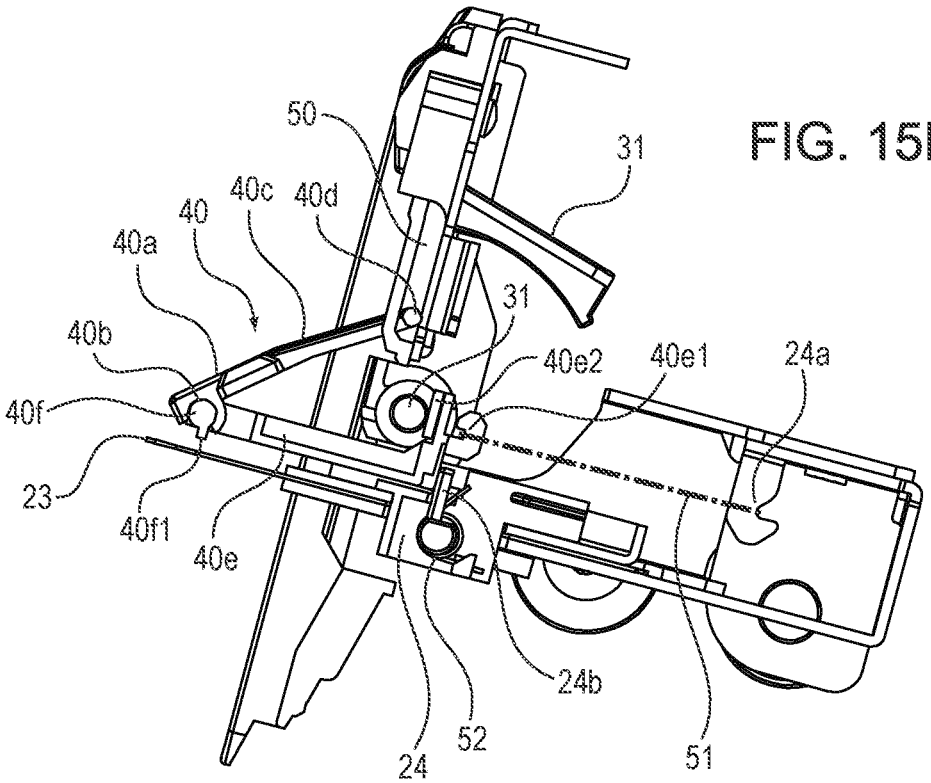

In executing the second folding processing on the sheet S, the blade guide member 40 is to shift in a push direction of the folding blade 23, and with respect to the folding blade 23, to guide, in the push direction, the sheet end portion on the fold side formed by the first folding processing i.e. the sheet fold-in end portion S2 so as to guide to the nip portion 22*c* of the folding roller pair 22. Therefore, as shown in FIGS. 15A and 15B, the blade guide member 40 has a contact portion 40*a* for coming into contact with the sheet rear end, and a fit hole portion 40*b* having a partial notch is formed in an end portion on one side of the contact portion 40*a*, and is fitted rotatably into a shaft portion 40*f* formed in a base portion 40*e*. Further, in an end portion on the other side of the contact portion 40*a*, an arm portion 40*c* is formed integrally, and an engagement protruding portion 40*d* is formed in an end portion of the arm portion 40*c*. Then, the engagement protruding portion 40*d* is engaged slidably in a long hole 50 formed in a frame of the sheet processing apparatus B. The long hole 50 is formed substantially parallel with the guide face 21*a* of the sheet stacking tray 21 in the upper vicinity of the blade carrier 24.

The above-mentioned base portion 40*e* is attached to the blade carrier 24 slidably in a direction parallel to a shift direction of the blade carrier 24. Then, a tensile spring 51 is attached to between a locking portion 40*e*1 formed in the base portion 40*e* and a locking portion 24*a* formed in the blade carrier 24.

The blade carrier 24 is provided with a press protruding portion 24*b* capable of coming into contact with the base portion 40*e* to press. The press protruding portion 24*b* is provided in the blade carrier 24 rotatably, and is biased in a counterclockwise direction in FIGS. 15A and 15B by a coil spring 52 attached to the rotation shaft. By this means, when the blade carrier 24 shifts in the blade push direction, the press protruding portion 24*b* comes into contact with the base portion 40*e* to press the base portion 40*e*, and the blade guide member 40 shifts integrally with the blade carrier 24. In addition, the coil spring 52 provided in the press protruding portion 24*b* acts as the so-called torque limiter, and rotates clockwise when a predetermined force or more in the clockwise direction is applied to the press protruding portion 24*b*.

(Change in Angle of the Contact Portion with Respect to the Shift Direction of the Folding Blade)

In the above-mentioned configuration, as shown in FIG. 15A, when the blade carrier 24 is in a home position, the blade guide member 40 is pulled by the coil spring 51, and is in a position such that the contact portion 40*a* is brought into contact with the rotation shaft 31 that is the rotation support of the press guide member 30. This state is the home position of the blade guide member 40. At this point, the contact portion 40*a* stands to be substantially the same plane as the guide face 21*a*. Then, when the blade carrier 24 shifts in the blade push direction, the blade guide member 40 is pressed by the press protruding portion 24*b* to shift together with the blade carrier 24 from the home position, and as shown in FIG. 15B, shifts until a butt portion 40*e*2 formed to stand in the rear end of the base portion 40*e* comes into contact with the rotation shaft 31.

As described above, when the blade guide member 40 shifts in the blade push direction, the engagement protruding portion 40*d* is guided by the long hole 50 to slide downward, and the contact portion 40*a* rotates around a shaft portion 40*f* as the center. The shaft portion 40*f* is provided in one end of the contact portion 40*a* closer to the folding blade 23. The one end refers to a region between the center of the contact portion 40*a* and the end portion closer to the folding blade 23. In other words, the shaft portion 40*f* is provided in any region closer to the folding blade 23 side than the center of the contact portion 40*a*. Accordingly, in a state of FIG. 15A in which the blade guide member 40 is in the home position, an angle with respect to the shift direction of the blade carrier 24 i.e. the shift direction of the folding blade 23 is an approximately right angle, and the contact portion 40*a* is in the standing state. Then, as the blade carrier 24 shifts in a direction in which the folding blade 23 is pushed, as shown in FIG. 15B, the other end of the contact portion 40*a* shifts so as to approach a shift locus of the shaft portion 40*f* that is the rotation center thereof i.e. so as to fall to the upstream side in the push direction of the folding blade 23. Thus, as the blade carrier 24 shifts, it is configured that the angle of the contact portion 40*a* with respect to the shift direction of the carrier 24 changes to an acute angle (the angle on the upstream side in the push direction is decreased). As described above, one end of the contact portion 40*a* is configured to be rotatable around the shaft portion as the center, while the end portion of the arm portion 40*c* provided to extend in the other end of the contact portion 40*a* is configured to be slidable along the long hole 50, and the blade guide member 40 is thereby capable of changing the angle with respect to the shift direction in conjunction with the shift of the blade guide member 40, without being provided with any particular drive section.

Further, as shown in FIG. 15A, a protruding portion 40*f*1 is formed in the shaft portion 40*f* that is a rotation axis of the contact portion 40*a*. On the other hand, the notch formed in the fit hole portion 40*b* fitted into the shaft portion 40*f* is formed to be wider than a width of the protruding portion 40*f*1, and the blade guide member 40 is capable of rotating in a range of the notch.

In the above-mentioned configuration, when the blade carrier 24 shifts to the home position, the base portion 40*e* is pulled by the tensile spring 51. At this point, the notch face of the fit hole portion 40*b* comes into contact with the protruding portion 40*f*1, and further rotation of the contact portion 40*a* is regulated. Therefore, in a state in which the contact portion 40*a* is brought into contact with the rotation shaft 31, further shifts are regulated in the blade guide member 40, and the contact portion 40*a* maintains the standing state in the home position.

Further, in the blade guide member 40 of this Embodiment, the contact portion 40*a* and arm portion 40*c* are comprised of linear members in cross section, and the arm portion 40*c* is formed at a predetermined angle with respect to the contact portion 40*a*. By this means, also in the case of configuring that the contact portion 40*a* is substantially the same plane as the guide face 21*a* when the blade guide member 40 is in the home position, the end portion on the side provided with the engagement protruding portion 40*d* of the arm portion 40*c* is in the position apart from the guide face 21*a* on the side opposite to the side on which the folding roller pair 22 exits. In other words, the end portion is in the position apart from the guide face 21*a* on the side of the direction for returning the folding blade 23 from the nip portion 22*c* side to the home position. Therefore, it is possible to arrange the long hole 50 in which the engagement protruding portion 40*d* engages apart from the guide face 21*a* on the side opposite to the side on which the folding roller pair 22 exists, and to arrange in the position of not interfering with the guide face 21*a*. Accordingly, in the state in which the blade guide member 40 is in the home position, it is possible to configure so that the contact portion 40*a* functions as a guide portion of a sheet transported in the sheet stacking tray 21.

(Operation of the Folding Blade and Blade Guide Member)

Described next is operation of the blade guide member 40 when the folding blade 23 is operated so as to execute the second folding operation on the sheet, with reference to FIGS. 16A to 19B.

Figure 16A:
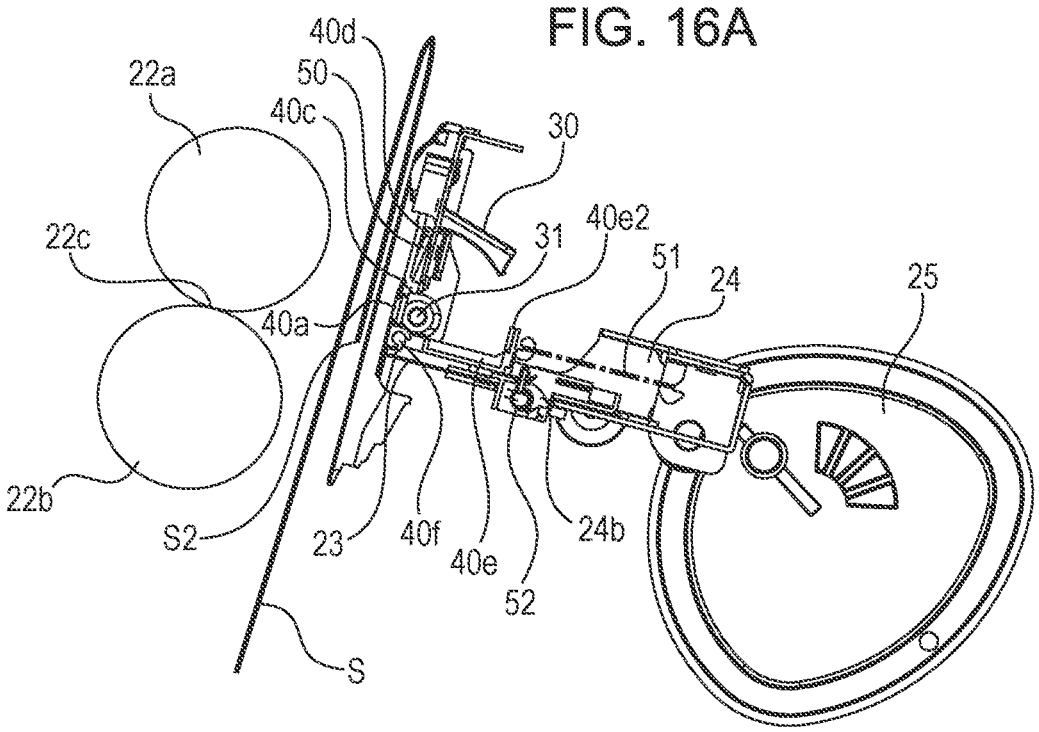
FIGS. 16A and 16B are cross-sectional explanatory views of operation of the folding blade and blade guide member.

FIG. 16A illustrates a state in which the blade carrier 24 is in the home position, and at this point, the blade guide member 40 is also in the state of the home position. In addition, in the following description, the "push direction" refers to a direction in which the blade carrier 24 pushes out the folding blade 23 to the nip portion 22*c* of the folding roller pair 22 from the position of the home position, and "return direction" refers to a direction in which the blade is returned to the home position from the nip portion 22*c* side.

In the case of being in the above-mentioned home position, the front edge of the folding blade 23 is substantially the same plane as the guide face 21*a*, or on the return-direction side than the guide face 21*a* (first position), and is separated from the sheet S in the sheet stacking tray 21. Therefore, the sheet, which is guided by the guide face 21*a* and is transported in the sheet stacking tray 21, is not caught in the blade front edge. In addition, also in a state in which the front edge of the folding blade 23 protrudes to the folding roller 22 side than the guide face 21*a*, unless the sheet transported to the sheet stacking tray 21 by another guide member is caught in the blade front edge, it is said that the blade front edge retracts from the sheet transport path, and therefore, this state may be a first position. Further, when the blade guide member 40 is in the home position, the contact portion 40*a* of the blade guide member 40 is in a position in contact with the rotation shaft 31. At this point, the press protruding portion 24*b* is separated from the base portion 40*e*.

Figure 16B:
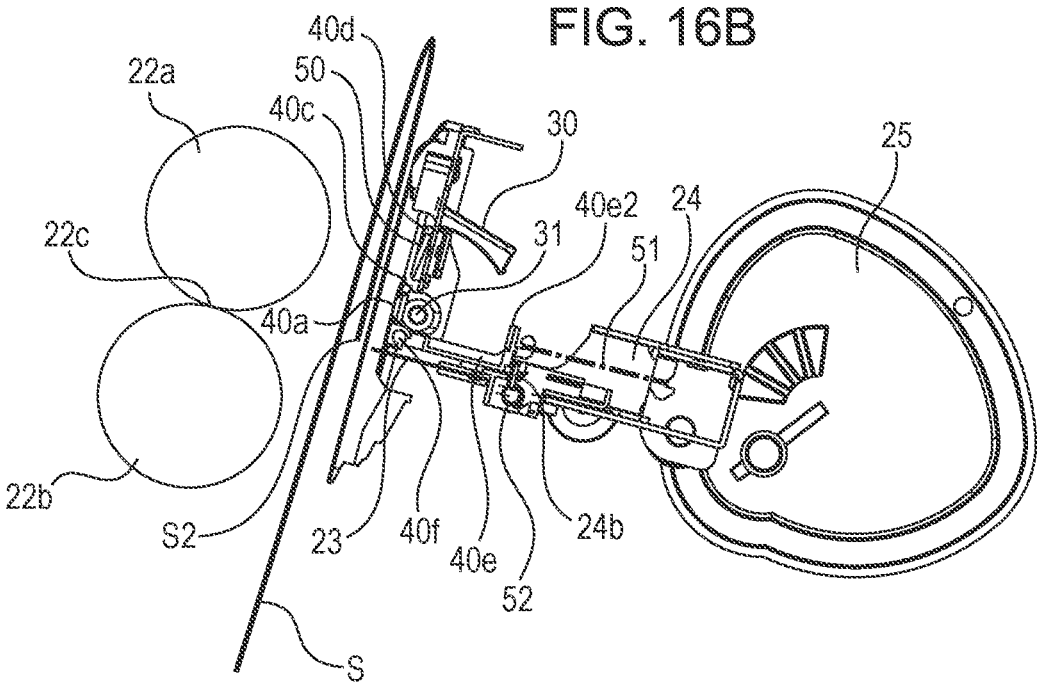

Next, in order to push the folding blade 23, when the cam drive motor is driven, the cam member 25 is rotated to shift the blade carrier 24 in the push direction. Then, the press protruding portion 24*b* comes into contact with the base portion 40*e*, and the blade guide member 40 shifts in the push direction integrally with the blade carrier 24 and folding blade 23 (FIG. 16B). At this point, it is configured that the front edge portion of the folding blade 23 protrudes to the push direction more than the front end portion of the blade guide member 40.

Figure 17A:
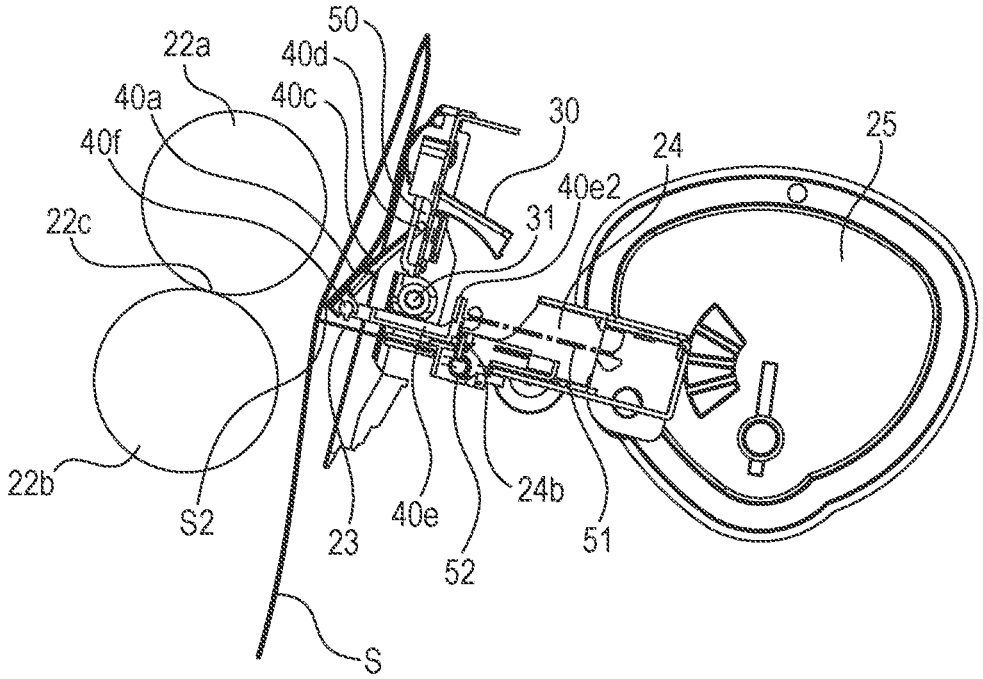
FIGS. 17A and 17B are cross-sectional explanatory views of operation of the folding blade and blade guide member.

When the blade carrier 24 shifts further in the push direction, the folding blade front edge portion protrudes by a predetermined amount. Then, as shown in FIG. 17A, the front edge of the folding blade 23 comes into contact with the sheet S which is subjected to the first folding processing and is halted in the sheet stacking tray 21 with the second fold position opposed to the folding blade 23 (second position). At this point, since the front edge of the folding blade 23 protrudes in the push direction more than the blade guide member 40 as described previously, the folding blade 23 comes into contact with the fold position of the sheet S faster than the blade guide member 40. Therefore, by pushing by the folding blade 23, the folding blade front edge opposed to the fold position of the sheet is accurately brought into contact, without being displaced from the fold position of the sheet, and the folding processing is executed in the proper fold position.

In addition, the folding blade front edge does not need to always protrude with respect to the blade guide member 40, and when the folding blade front edge is essentially in the same position as the blade guide member 40 in the push direction, it is possible to suppress displacement when the blade front edge comes into contact with the fold position of the sheet.

When the blade carrier 24 shifts in the push direction in the above-mentioned state, the second fold position of the sheet S is pushed toward the nip portion 22*c* of the folding roller pair 22 by the folding blade 23. Concurrently therewith, the contact portion 40*c* of the blade guide member 40 comes into contact with the fold-in end portion S2 of the sheet subjected to the first folding, and guides so as to push the fold-in end portion S to the nip portion 22*c* (FIG. 17B).

As described above, since the blade guide member 40 guides the fold-in end portion S2 of the sheet to the nip portion 22*c*, the fold-in end portion S2 of the sheet travels to the nip portion 22*c*, without being turned up. Further, in approaching the nip portion 22*c*, there is the risk that the pushed blade guide member 40 interferes with outer regions of the folding rollers 22*a*, 22*b*. At this point, in the blade guide member 40 of this Embodiment, as described previously, as the member shifts in the push direction, the angle of the contact portion 40*a* with respect to the push direction changes to an acute angle (changes from the state of FIG. 17A to the state of FIG. 17B). Therefore, the contact portion 40*a* is capable of further entering the vicinity of the nip portion 22*c*, and it is possible to reliably guide the fold-in end portion S2 of the sheet to the nip portion.

Figure 17B:
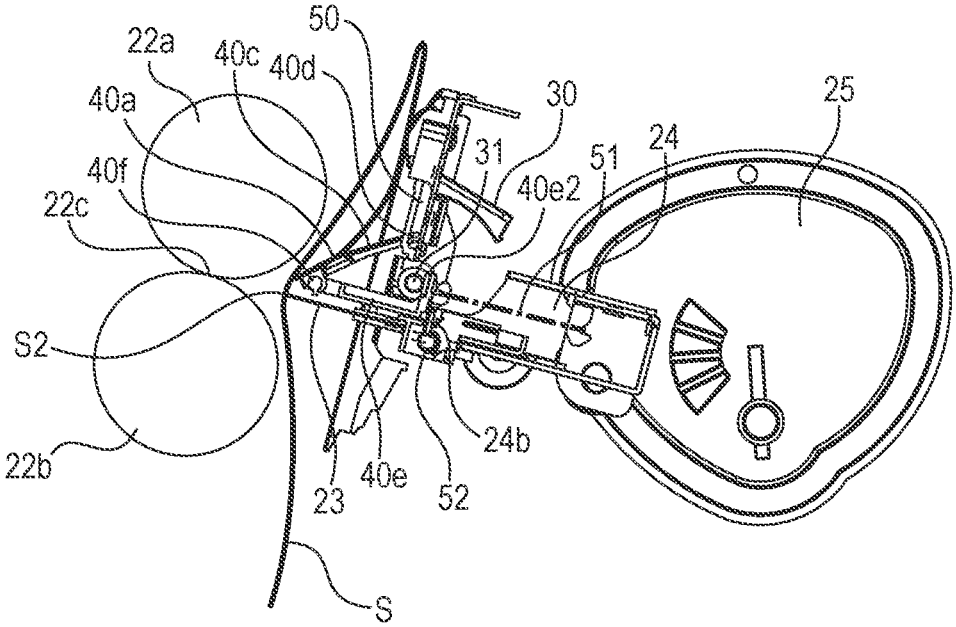
Figure 18A:
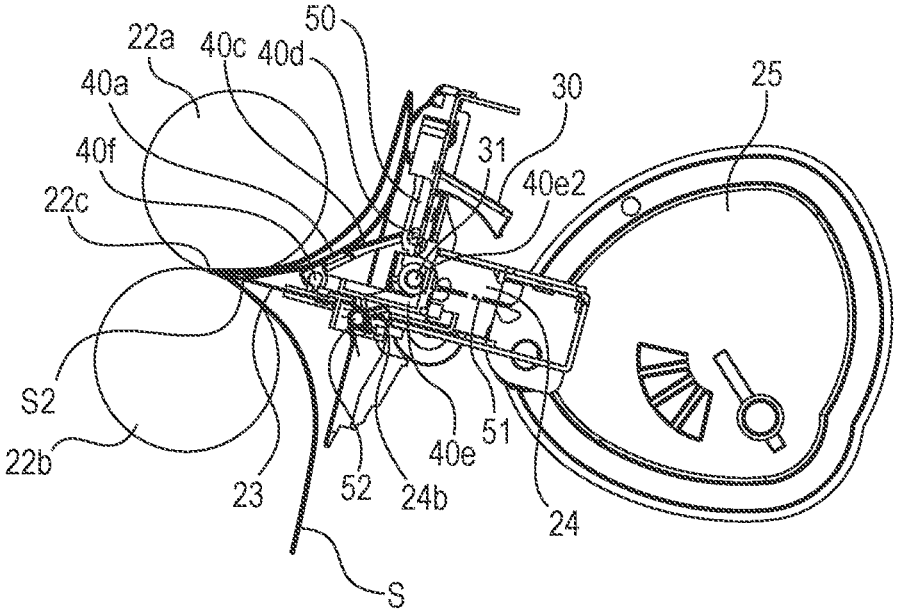
FIGS. 18A and 18B are cross-sectional explanatory views of operation of the folding blade and blade guide member.

When the blade carrier 24 further shifts in the push direction, and as shown in FIG. 17B, the butt portion 40*e*2 comes into contact with the rotation shaft 31, the blade guide member 40 is regulated not to further shift in the push direction. In addition, in a state in which the blade guide member 40 shifts in the push direction most, the front end (end portion on the folding roller pair 22 side with respect to the push direction) of the blade guide member 40 protrudes to the nip portion 22*c* side more than the tangent line (of two folding rollers 22*a*, 22*b*) for connecting between outer regions of the folding roller 22*a* and folding roller 22*b* on the sheet stacking tray 21 side. On the other hand, when the blade carrier 24 is pushed in the push direction by rotation of the cam member 25, as shown in FIG. 18A, since a certain force or more is applied to the coil spring 52, the press protruding portion 24*b* rotates clockwise against the biasing force of the coil spring 52, and moves into a lower portion of the base portion 40*e*. By this means, the press protruding portion 24*b* does not press the blade guide member 40, while the blade guide member 40 is halted, only the folding blade 23 shifts in the push direction, and the blade front edge protrudes maximally to shift to a position (third position) for pushing the sheet S to the nip portion 22*c*. The front edge of the folding blade 23 at this point protrudes more significantly than the front end of the contact portion 40*a* of the blade guide member 40. In other words, a distance from the blade front edge to the contact portion front end in the third position is longer than the distance from the blade front edge to the contact portion front end in the second position. By this means, the sheet is reliably drawn into the nip portion 22*c* of rotating folding roller pair 22 in a state of being folded in the second fold position, and the sheet front end S1 is also drawn into the nip portion 22*c*, and is in a three-fold state.

In addition, when the folding blade 23 pushes the sheet i.e. during the shift of the folding blade front edge from the second position to the third position, in the case where a large load is imposed on the blade guide member 40 in the return direction, for example, in the case of performing the folding processing in a state in which a plurality of sheets is stacked and the like, a large load is imposed on the blade guide member 40 at the time of the folding processing when rigidity of the sheet is high. In this case, when a certain load or more is imposed, the blade guide member 40 is capable of shifting relatively in the return direction with respect to the folding blade 23, against the frictional force with the press protruding portion 24*b* in press-contact with the bottom of the base portion 40*e* by the biasing force of the coil spring 52. By this means, in the case where a large load is imposed on the blade guide member 40 at the time of the folding processing on the sheet, the blade guide member 40 is not broken.

Figure 18B:
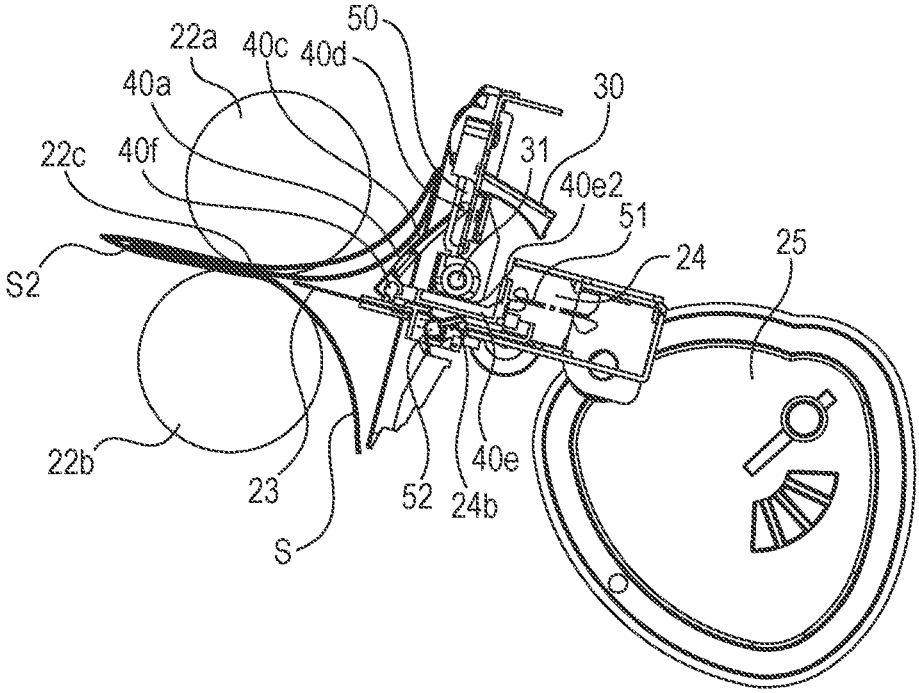

After the folding blade front edge arrives at the third position, when the cam member 25 further rotates, the blade carrier 24 shifts in the return direction together with the folding blade 23 (FIG. 18B). At this point, as described previously, since the press protruding portion 24*b* is brought into press-contact with the base portion 40*e* of the blade guide member 40 by the biasing force of the coil spring 52, the blade guide member 40 also shifts in the return direction integrally with the blade carrier 24 i.e. concurrently with the folding blade 23 by the friction force between the press protruding portion 24*b* and the bottom of the base portion 40*e*.

Figure 19A:
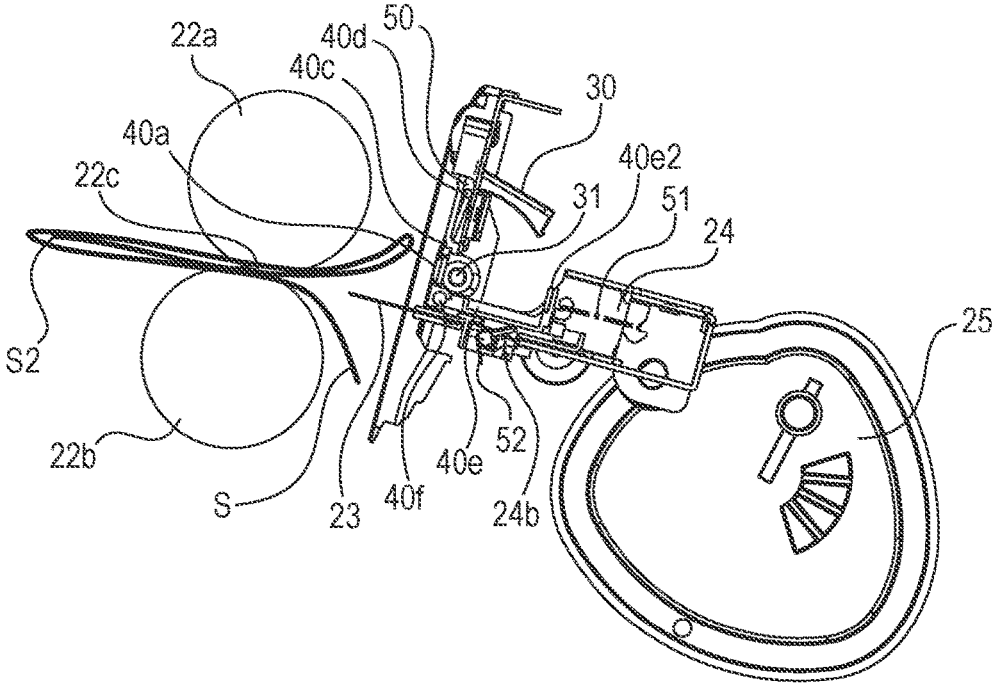
FIGS. 19A and 19B are cross-sectional explanatory views of operation of the folding blade and blade guide member.
Figure 19B:
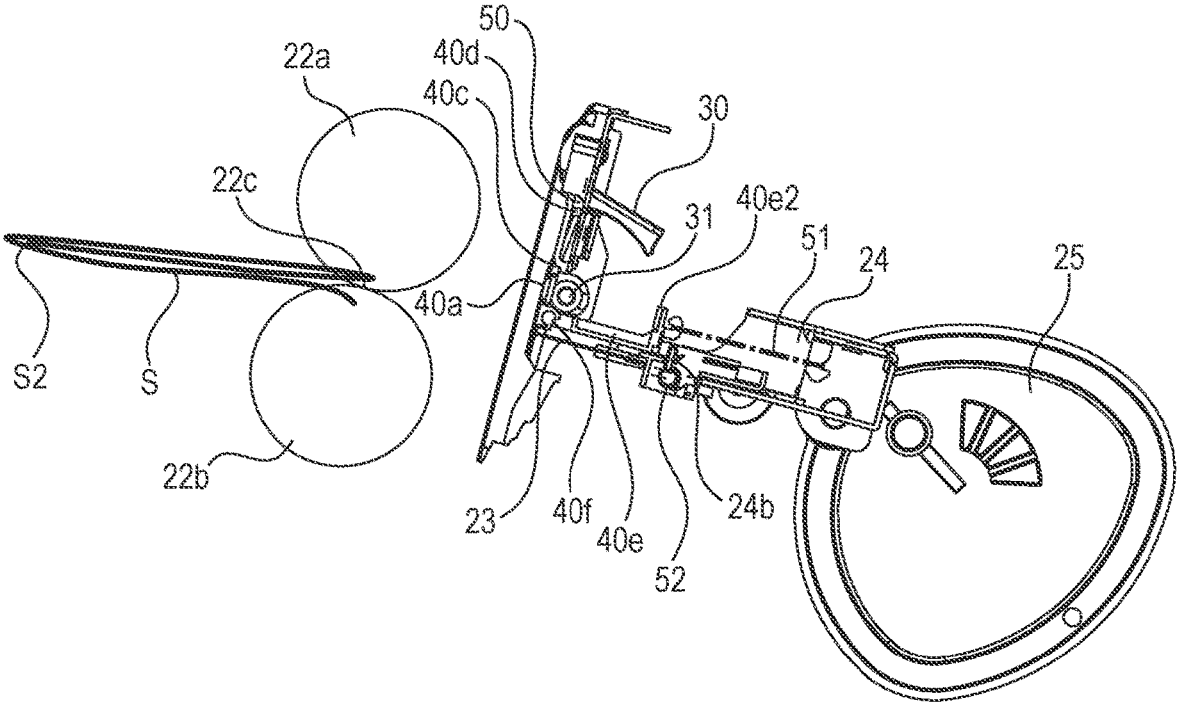

When the cam member 25 further rotates and the blade carrier 24 shifts in the return direction, the contact portion 40*a* of the blade guide member 40 comes into contact with the rotation shaft 31, and the blade guide member 40 returns to the home position. Then, the blade guide member 40 is regulated not to further shift in the return direction (FIG. 19A). When the cam member 25 further rotates, in a state in which the blade guide member 40 does not shift, only the folding blade 23 shifts in the return direction, and returns to the home position (FIG. 19B).

As described above, when the blade carrier 24 shifts in the return direction, the folding blade 23 and blade guide member 40 shift in the return direction at the same time, and before the blade carrier 24 and folding blade 23 return to the home positions, the blade guide member 40 returns to the home position. In other words, the blade guide member 40 retracts from the sheet drawn by the folding roller pair 22 and discharge roller 17*b* faster than the folding blade 23. Therefore, a transport load by the blade guide member 40 is reduced on the sheet S drawn by the discharge roller 17*b* and the like.

(Arrangement Relationship Between the Blade Guide Member and the Press Guide Member)

In this Embodiment, as shown in FIG. 4 that is a plan schematic view of the folding processing apparatus F, the blade guide member 40 is disposed in two predetermined positions in the sheet width direction. In the folding blade 23 of this Embodiment, the push front edge portion 23*a* is formed in six portions to protrude substantially at regular intervals in the sheet width direction on the push side. The push front edge portion 23*a* pushes out the sheet, the sheet is thereby pushed to the nip portion 22*c* of the folding roller pair 22, and the folding processing is executed. Then, the blade guide members 40 are disposed above the push front edge portions 23*a*1 among the six push front edge portions 23*a* i.e. on the upstream side in a carry-in direction of the sheet carried in the sheet stacking tray 21. Accordingly, in the sheet S pushed by the folding blade 23, the fold-in end portion S2 is guided by the blade guide members 40 on the opposite sides in the width direction.

In order to guide the fold-in end portion S2 of the sheet to the nip portion 22*c*, it is desirable that the blade guide member 40 is disposed above all the push front edge portions 23*a* (23*a*1) formed in the six portions, but when the member is disposed above all the portions, the number of parts increases. In contrast thereto, in this Embodiment, as described previously, since the blade guide member 40 is disposed in positions of two push front edge portions 23*a*1 formed on the opposite end portion sides in the sheet width direction, it is possible to decrease the number of parts. Then, in the fold-in end portion S2 of the sheet pushed by the folding blade 23 in the second folding processing, since the vicinity of the end portion is easier to turn up than the center portion in the sheet width direction, by guiding this portion by the blade guide member 40 to the nip-portion direction, it is possible to effectively prevent the turn-up from occurring.

In addition, the two blade guide members 40 are not disposed in the opposite end portions in the sheet width direction of the minimum-width sheet capable of being transported to the sheet stacking tray 21, but are disposed above the push front edge portions 23*a*1 formed closer to the center slightly than the opposite end portions. This is because it is effective to push portions closer to the center slightly than the end portions in the width direction of the sheet, in pushing out the sheet by the push front edge portions 23*a*, and the blade guide member 40 is disposed corresponding to the position of the push front edge portion 23*a*1.

With respect to the position of the above-mentioned blade guide member 40, the press guide members 30 of this Embodiment are disposed on the outer sides than the two blade guide members 40 in the sheet width direction. Specifically, two press guide members 30 are disposed substantially at the same distance as the width of the minimum-size sheet capable of being processed in the folding processing apparatus F, and in performing the folding processing on the minimum-size sheet, are disposed in positions for enabling opposite ends of the sheet in the width direction to be pressed and guided. In addition, in this Embodiment, as well as the two press guide members 30 capable of pressing and guiding the opposite ends of the sheet, the press guide member 30 capable of pressing and guiding the center in the sheet width direction is provided, and total three press guide members 30 are provided. More specifically, the minimum-size sheet capable of being processed in the folding processing apparatus F in this Embodiment is A4, and a length of the width in the short direction of the general A4-size sheet is 210 mm. In the two press guide members 30 capable of pressing and guiding the opposite ends of the sheet in the width direction, a length in the sheet width direction is formed to be 18 mm, a length for connecting between respective end portions on the outer sides of the two press guide members 30 by a straight line is 226 mm longer than the sheet width of the A4-size sheet, and the end portion of the A4-size sheet in the width direction overlaps a part of the face of the press guide member 30 closer to the center in the width direction by 10 mm on each of the sides. The maximum-size sheet capable of being processed in the folding processing apparatus F is A3, and a length of the width in the short direction of the general A3-size sheet is 297 mm. By setting the length for connecting between respective end portions on the outer sides of the two press guide members 30 capable of pressing and guiding the opposite ends of the sheet in the width direction by the straight line to be longer than the sheet width of the minimum-size sheet, it is possible to also provide the end portions of the maximum-size sheet with the effect of the guide.

When the sheet with the first folding processing executed is feedback-transported, and as described previously, the press guide member 30 presses the fold-in end portion S2 of the sheet to guide so as to return to the sheet stacking tray 21, it is effective at preventing turn-up to press and guide the opposite end portions in the sheet width direction. Therefore, two press guide members 30 are disposed on the outer sides in the sheet width direction than the blade guide members 40. In this Embodiment, the press guide members 30 disposed on the opposite sides in the sheet width direction are disposed substantially at the same distance as the width of the minimum-size sheet, and the blade guide members 40 are disposed at a distance shorter than the width of the minimum-size sheet on the inner sides than the members 30.

In addition, in this Embodiment, push front edge portions 23*a*2 are disposed on outer sides of the press guide members 30, respectively. The push front edge portion 23*a*2 are to prevent a wrinkle from occurring in the sheet in pushing the sheet large in size in the sheet width direction, and are disposed on inner sides than the opposite end portions of the maximum-size sheet (it is not necessary to particularly provide in an apparatus where handling sheets are determined to be only the minimum size described above.) In other words, it is desirable that the press guide member 30 and blade guide member 40 are disposed in accordance with the minimum-size sheet, and when necessary, the push front edge portion 23*a*2 may be disposed additionally on the outer side of the press guide member 30. In other words, the blade guide members 40 are disposed on the inner sides of two press guide members 30 in the sheet width direction, the push front edge portions 23*a*1 are disposed corresponding to the positions of the blade guide members 40, and the push front edge portions 23*a*2 may further be disposed on the outer sides of two press guide members 30 corresponding to the sheet size to handle.

Further, in the case where a difference is large between the minimum size and the maximum size handled in the apparatus, it may be possible to provide the blade guide members 40 that correspond to the minimum size, push front edge portions 23*a*1 provided with the blade guide members 40 and two press guide members 30, and to provide the blade guide members 40 that correspond to the maximum size, push front edge portions 23*a*2 provided with the blade guide members 40 and two press guide members 30, respectively. In addition, this Embodiment illustrates the aspect where two push front edge portions 23*a*1 provided with the blade guide members 40 are provided with the center of the sheet S therebetween, and the configuration may be made using one push front edge portion 23*a*1 and one blade guide member 40.

In addition, in this Embodiment, the press guide member 30 is disposed between the push front edge portion 23*a*1 and the push front edge portion 23*a*2 so as not to interfere with the push front edge portions 23*a*1, 23*a*2 when the press guide member 30 shifts to the guide position. Accordingly, it is possible to arrange each member in saved space.

<Drive Control>

Figure 20:
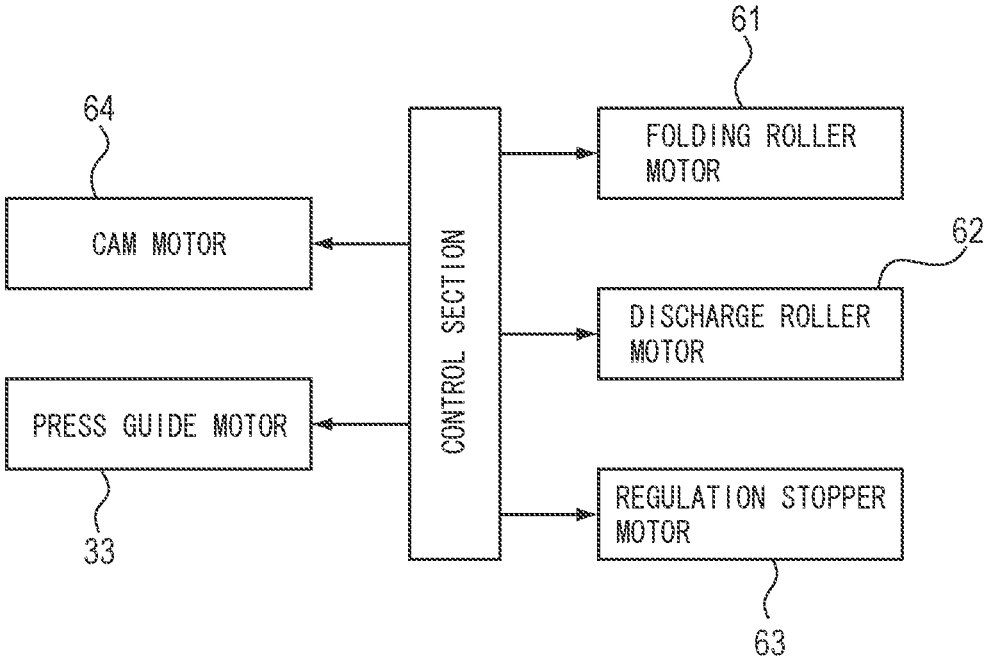
FIG. 20 is a control block diagram of folding operation in the sheet folding processing apparatus.

Described next is a control configuration of a drive system in performing the folding processing on the sheet. As shown in a block diagram shown in FIG. 20, in order to follow a procedure of flowcharts shown in FIGS. 21 and 22, a control section 60 controls drive of a folding roller motor 61 for driving and rotating the folding roller pair 22, a discharge roller motor 62 for driving and rotating the discharge roller 17*b*, and a regulation stopper motor 63 for operating the sheet up-and-down mechanism 27 to move the regulation stopper 26 up and down. Further, similarly, the control section 60 controls drive of a cam motor 64 for driving the cam member 25 to operate the blade carrier 24, and a press guide motor 33 for rotating the press guide member 30.

Figure 21:
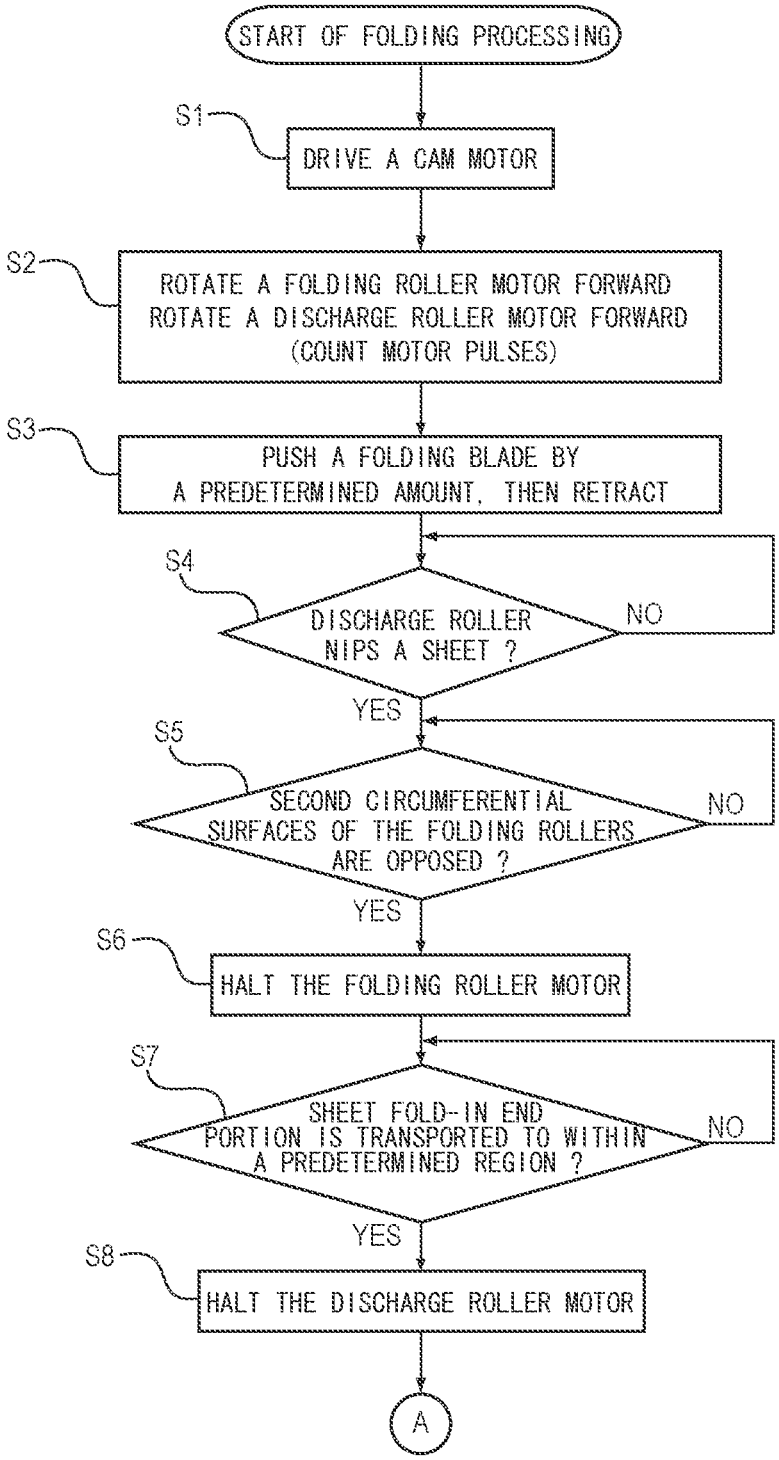
FIG. 21 is a flowchart of folding operation in the sheet folding processing apparatus.
Figure 22:
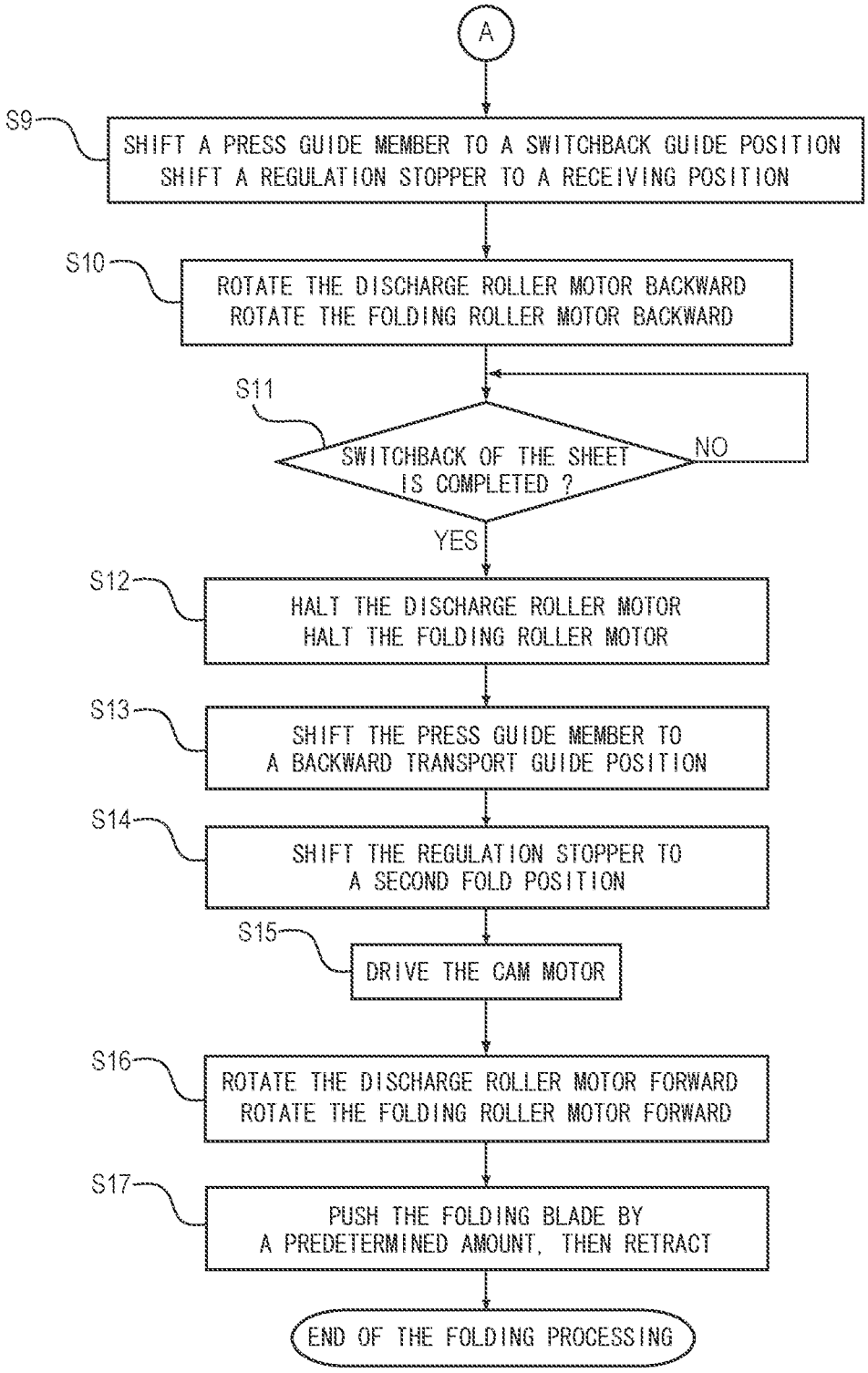
FIG. 22 is another flowchart of folding operation in the sheet folding processing apparatus.

FIGS. 21 and 22 are flowcharts showing a drive control procedure when the sheet S is transported to the sheet stacking tray 21, the sheet front end strikes the regulation stopper halted at a predetermined position, and the folding processing is executed from the state in which the first fold position is in the position opposed to the folding blade 23.

When the folding processing is executed, the cam motor 64 is driven to shift the blade carrier 24 in the push direction, and the folding blade 23 comes into contact with the first fold position of the sheet S to push to the nip portion 22*c* (S1). Concurrently therewith, the folding roller motor 61 and discharge roller motor 62 are driven to drive the folding roller pair 22 and discharge roller 17*b* to rotate forward (S2). Each of the motors uses a pulse motor, and when the motor is driven, the number of drive pulses thereof is counted.

By rotation of the cam member 25, when the folding blade 23 protrudes by a predetermined amount for pushing the first folding portion of the sheet S up to the nip portion 22*c* of the folding roller pair 22, the travel direction is reversed, and the blade 23 shifts in the return direction, and returns to the home position (S3).

The folding processing is performed on the sheet S pushed to the nip portion 22*c* of the folding roller pair 22 by push of the above-mentioned folding blade 23 for a period during which the sheet S is nipped and transported by the folding roller pair 22, and the sheet is transported by the discharge roller 17*b* constituting the sheet transport section together with the folding roller pair 22 without any modification. When the sheet is nipped and transported by the discharge roller 17*b* (S4), the folding roller motor 61 is halted when the second roller surfaces 22*a*3, 22*b*3 of the folding rollers 22*a*, 22*b* are opposed to each other (S5, S6). By this means, the folding roller pair 22 does not nip the sheet, and the sheet is transported by the discharge roller 17*b*. At this point, the sheet is transported by the discharge roller 17*b*, while being guided by the second roller surfaces 22*a*3, 22*b*3 with a small coefficient of friction. In addition, in this Embodiment, it is determined whether the sheet is transported to the discharge roller 17*b*, or whether the second roller surfaces 22*a*3, 22*b*3 of the folding roller pair 22 are opposed to each other by a pulse count of the motor, and another configuration may be adopted, for example, where the sheet S is detected by a sensor, and corresponding to the detection result, drive of the motor is controlled.

Then, when the position of the fold-in end portion S2 of the transported sheet S arrives at within a predetermined region (S7), the drive of the discharge roller motor 62 is halted to halt sheet transport (S8). The predetermined region is a region between the rotation locus L3 of the press guide member 30 for the fold-in end portion S2 of the sheet S and the guide face 21*a* of the sheet stacking tray 21 (see FIG. 14A). By halting the sheet S so that the fold-in end portion S2 is within the region, when the press guide member 30 is rotated, it is possible to press the sheet S reliably in the direction for switchback-transport by the press portion 30*c* (see FIG. 14B), and further, it is possible to guide the fold-in end portion S2 undergoing the switchback-transport by the guide portion 30*b* (see FIG. 14C).

After halting the fold-in end portion S2 of the sheet S within the region, the press guide motor 33 is driven to rotate the press guide member 30 so as to arrive at a position (position shown in FIG. 14C) where the guide portion 30*b* of the press guide member 30 is capable of guiding the switchback-transported sheet S (S9). Further, together with rotation of the press guide member 30, the regulation stopper motor 63 is driven to shift the regulation stopper 26 to a position for enabling the switchback-transported sheet S to be received.

After the press guide member 30 rotates as described above, the discharge roller motor 62 and folding roller motor 61 are driven to rotate backward (S10). By this means, the discharge roller 17*b* and folding roller pair 22 rotate backward, and the sheet S is switchback-transported. At this point, as described previously, since the sheet is guided by the press guide member 30, the sheet does not generate a transport failure, and is switchback-transported in the direction of the sheet stacking tray 21 where the regulation stopper 26 is disposed.

When the discharge roller motor 62 and folding roller motor 61 are driven to switchback-transport the sheet S, the sheet S passing through the nip portion 22*c* of the folding roller pair 22 falls until the sheet comes into contact with the regulation stopper 26, and the switchback-transport is completed (S11), drive of the discharge roller motor 62 and folding roller motor 61 is halted (S12). Herein, completion of the switchback-transport of the sheet S may be determined by counting the numbers of drive pulses of the discharge roller motor 62 and folding roller motor 61 to recognize that the sheet S is transported by a predetermined amount.

Next, the press guide motor 33 is driven to return the press guide member 30 to the retract position. At this point, a velocity at which the press guide member 30 is returned to the retract position (see FIG. 14A) from the guide position (see FIG. 14C) is set to be faster than a velocity at which the press guide member 30 is shifted to the guide position from the retract position. In shifting the press guide member 30 to the guide position from the retract position, the velocity is decreased to rotate so as to press the sheet S halted for switchback-transport and change the direction. In contrast thereto, in shifting from the guide position to the retract position, by returning faster, it is possible to hasten the timing of executing next operation.

Then, after the press guide member 30 shifts to the backward transport guide position (see FIG. 9A) (S13), the regulation stopper motor 63 is driven to shift so that the second fold position of the sheet S is the position opposed to the folding blade 23 (S14). In this state, the cam motor 64, folding roller motor 61 and discharge roller motor 62 are driven to execute second folding operation (S15 to S17).

In addition, in this Embodiment, the motor to drive each member is provided individually, and it is also possible to drive each member by using a common motor and switching drive with a clutch and the like.

Another Embodiment

The Embodiment described previously illustrates the example where the angle of the contact portion 40*a* with respect to the base portion 40*e* is changed, by sliding the engagement protruding portion 40*d* of the blade guide member 40 in the long hole 50, when the folding blade 23 and blade guide member 40 are shifted relatively. However, without providing the link mechanism, the angle of the contact portion 40*a* with respect to the base portion 40*e* may be fixed not to change. Also in such a manner, the folding blade 23 is configured to be able to shift relatively with respect to the blade guide member 40, and after halting the shift of the blade guide member 40 in pushing, is still pushed to push the sheet to the nip portion 22*c*. By this means, without the blade guide member 40 interfering with the folding roller pair 22, it is possible to reliably push the sheet to the nip portion 22*c*. Then, by not providing the angle change mechanism, it is possible to simplify the configuration.

The Embodiment described previously illustrates the example of configuring the folding rollers 22*a*, 22*b* using rollers having the first roller surfaces 22*a*2, 22*b*2 which are circular outer surfaces with certain outside diameters, and second roller surfaces 22*a*3 and 22*b*3 with the outside diameters smaller than in the first roller surfaces. However, the folding rollers 22*a*, 22*b* may be configured using rollers with certain outside diameters, for example, circular rubber rollers and the like. In this case, when the sheet passes through the folding roller pair, since the sheet is always nipped by the nip portion of the folding roller pair, it is possible to manage a transport amount of the sheet by rotation of the folding roller pair. Accordingly, in the case of halting the fold-in end portion of the sheet in a predetermined position (see FIG. 7A), it is possible to control by a drive amount of the folding roller.

The Embodiment described previously illustrates the example where in starting a shift in the return direction when the folding blade front edge is in the third position, the folding blade 23 and blade guide member 40 are started at the same time. However, for example, the folding blade 23 and blade guide member 40 are configured to operate by different drive systems, and the shift in the return direction may be performed so that the folding blade 23 first starts the shift, and that the blade guide member 40 later starts the shift in the return direction.

Even in a state in which the folding blade front edge protrudes to the third position and the sheet folding portion is nipped by the folding roller pair 22, the fold-in end portion S2 is not nipped by the nip portion 22*c* yet (see FIG. 18A), and is nipped later. Also in this case, by returning the blade guide member 40 later than the folding blade 23 as described previously, when the folding blade 23 starts the shift in the return direction, the fold-in end portion S2 is guided by the blade guide member 40, and is thereby drawn to the nip portion 22*c* reliably.

Further, the Embodiment described previously illustrates the example of controlling a transport amount of the sheet and a rotation amount of the press guide member 30 by counting the number of pulses of the motor. As well as the motor pulse, for example, it may be configured that a photosensor for detecting the sheet or a photosensor for detecting the press guide member 30 is provided, and that by detecting that the sheet is transported to a predetermined position or the press guide member 30 is rotated to a predetermined angle using the sensor, the sheet transport or rotation of the press guide member is controlled.

Furthermore, the Embodiment described previously illustrates the example where the regulation stopper 26 with which the front end of the carried-in sheet in the transport direction is brought into contact to regulate is disposed in the lower end of the sheet stacking tray 21, and is provided to be able to move up and down along the sheet stacking tray 21 by the sheet up-and-down mechanism 27. In another Embodiment, a roller pair may be disposed which transports the sheet to the upstream side and downstream side of the sheet stacking tray 21 in the sheet transport direction with the folding blade 23 and folding roller pair 22 therebetween. In this case, in switchback-transporting the sheet S subjected to the first folding processing, it is possible to return the sheet to both the upstream side and the downstream side in the sheet transport direction of the sheet stacking tray 21 with the folding blade 23 and folding roller pair 22 therebetween.

<Modifications>

Figure 23:
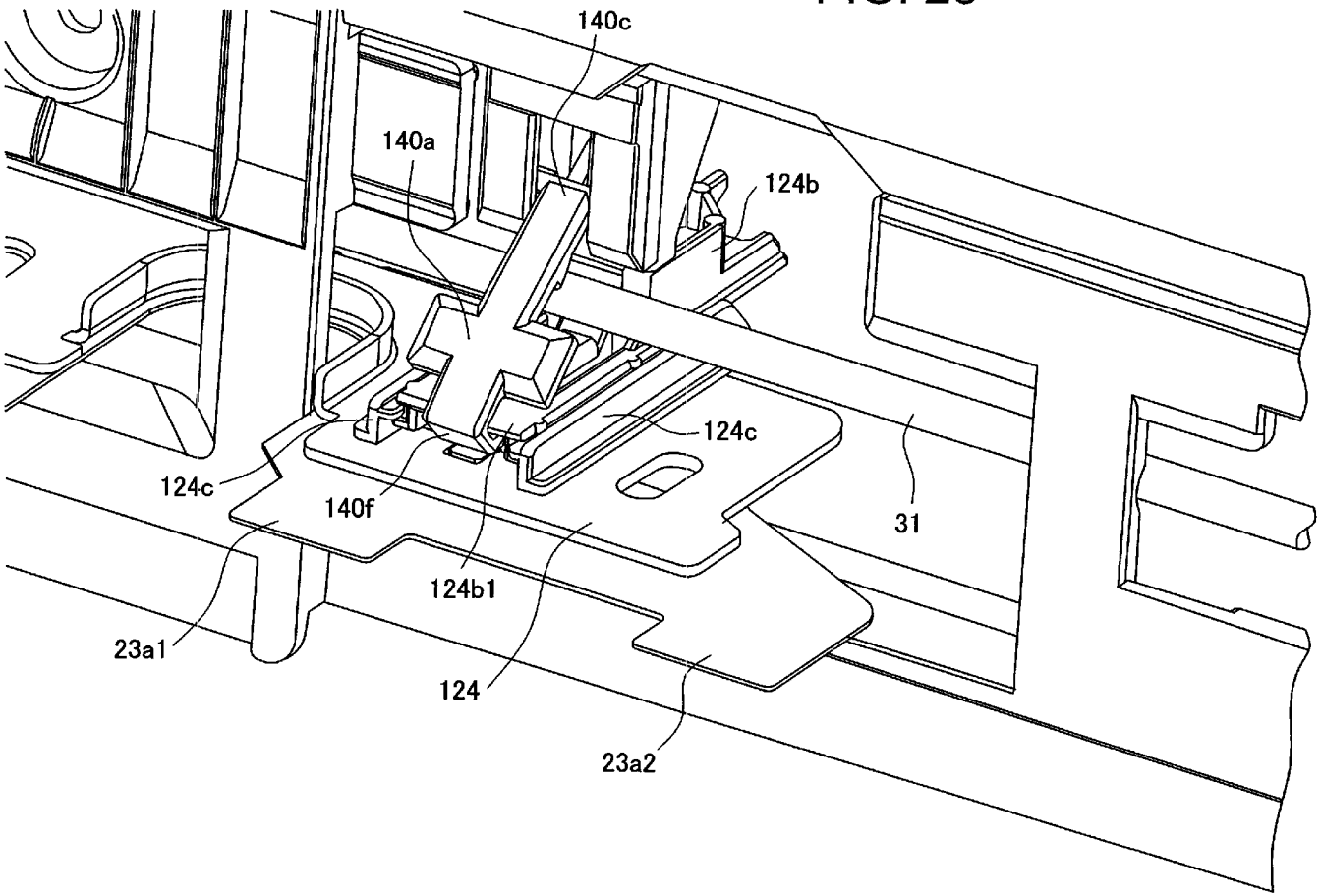
FIG. 23 is a perspective view of the blade guide member.

FIGS. 23 to 29 show modifications (blade guide member 140 and blade carrier 124) of the blade guide member 40 and blade carrier 24. In addition, the functions of the blade guide member 140 are the same as in the above-mentioned Embodiment, and further, members common to the above-mentioned Embodiment are assigned the same referential numerals to omit descriptions thereof. FIG. 23 is a perspective view illustrating a state in which the blade guide member 140 shifts in the push direction. In addition, in FIG. 23, the press guide member 30 is provided to the right of the blade guide member 140, but is omitted in the figure for convenience.

Figure 25:
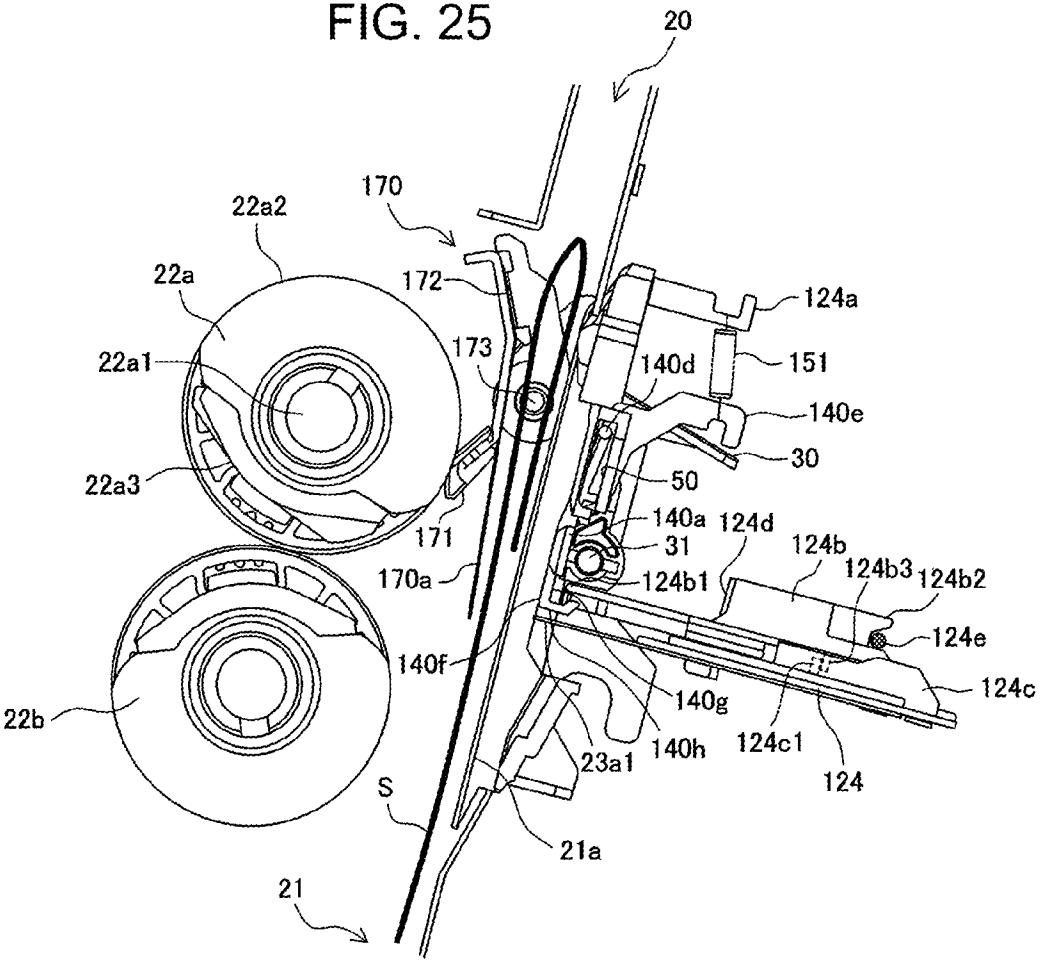
FIG. 25 is a cross-sectional explanatory view of operation of the folding blade and blade guide member.
Figure 26:
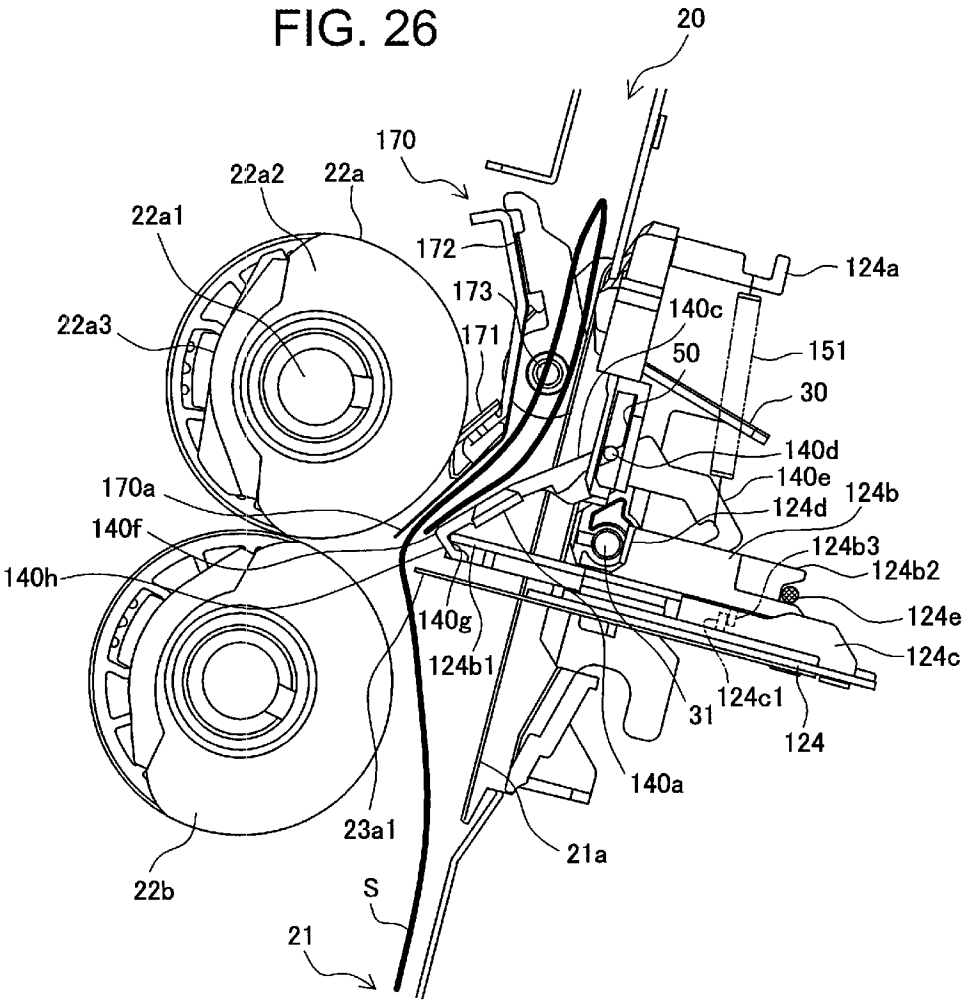
FIG. 26 is another cross-sectional explanatory view of operation of the folding blade and blade guide member.

The blade guide member 140 is comprised of a contact portion 140*a*, arm portion 140*c*, engagement protruding portion 140*d*, locking portion 140*e*, rotation support 140*f*, press-target portion 140*g*, and locking protruding portion 140*h*. The contact portion 140*a* is a member for coming into contact with the sheet to guide, the rotation support 140*f* is provided on one end side of the contact portion 140*a*, and on the other end side are provided the arm portion 140*c*, the engagement protruding portion 140*d* for slidably engaging in the long hole 50 provided in the frame of the sheet processing apparatus B, and the locking portion 140*e* formed to extend a tensile spring 151 between the portion 140*e* and a locking portion 124*a* formed in the frame of the sheet processing apparatus B. By the tensile spring 151, the blade guide member 140 is biased in an upward direction in FIG. 25. Then, in FIG. 25, on the backside (upstream side in the push direction) of the contact portion 140*a* is provided the press-target portion 140*g* with which a press protruding portion 124*b*1, described later, comes into contact, and it is configured that the press-target portion 140*g* is pushed in the push direction by the press protruding portion 124*b*1, and that the contact portion 140*a* thereby rotates around the rotation support 140*f* as the center in the clockwise direction in FIG. 25. In other words, the contact portion 140*a* is configured to be able to change the angle from the standing posture substantially perpendicular to the folding blade 23*a* as shown in FIG. 25 so that a portion on the side opposite to the rotation support 140*f* in the contact portion 140*a* falls toward the upstream side in the push direction around the rotation support 140*f* as the center as shown in FIG. 26. In addition, the locking protruding portion 140*h* bent from the rotation support 140*f* is a stopper to prevent the press-target portion 140*g* from being detached from the press protruding portion 124*b*1 when the press protruding portion 124*b*1 presses the press-target portion 140*g*.

The blade carrier 124 holds the folding blade 23 and slide rail 124*c*, and (as in the above-mentioned Embodiment) is configured to be able to shift integrally in the push direction and in the return direction by the cam 25. Then, the slide rail 124*c* holds a press member 124*b* slidably in the push direction and in the return direction. The press member 124*b* has the press protruding portion 124*b*1 formed in an end portion of the press member 124*b* on the downstream side in the push direction, a locking portion 124*b*2 formed in an end portion on the upstream side in the push direction to lock the spring 124*e*, and a contact portion 124*d* formed between the press protruding portion 124*b*1 and the locking portion 124*b*2.

Figures 24A, 24B, 24C:
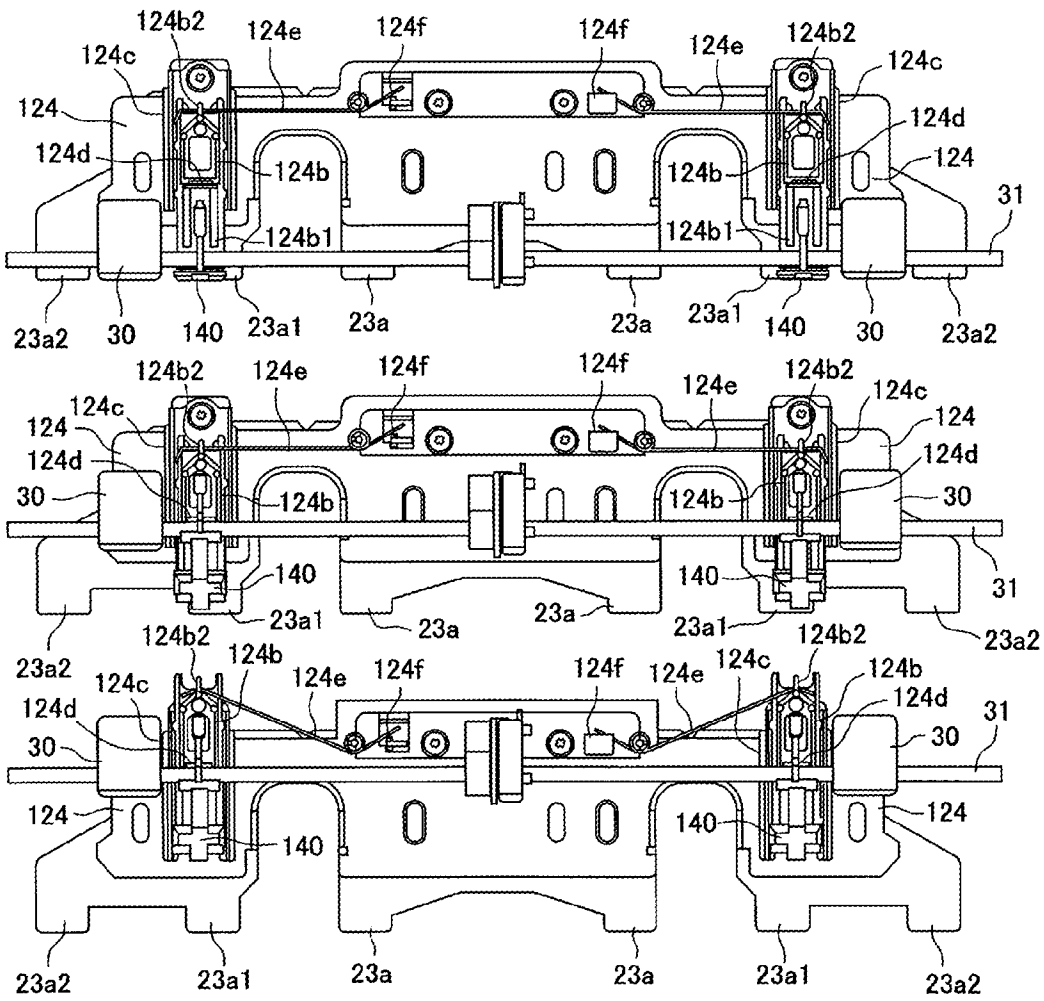
FIGS. 24A, 24B and 24C are top explanatory views of operation of the folding blade and blade guide member.

FIGS. 24A to 24C contain top views obtained by viewing the blade guide member 140 and blade carrier 124 from above. FIG. 24A illustrates a state where (the push front edge portion 23*a*1 is in the first position) the blade carrier 124 is in the home position, FIG. 24B illustrates a state where (the push front edge portion 23*a*1 is in the second position) the blade carrier 124 shifts in the push direction by a predetermined amount by the cam 25, and FIG. 24C illustrates a state where (the push front edge portion 23*a*1 is in the third position) the blade carrier 124 further shifts in the push direction, and the push front edge portion 23*a*1 maximally protrudes to push the sheet S to the nip portion 22*c*.

The blade carrier 124 is provided with the locking portion 124*f* to which one end of the spring 124*e* is attached. The other end of the spring 124*e* is attached to the locking portion 124*b*2 of the press member 124*b*, and by the spring 124*e*, the press member 124*b* is biased in the push direction (downward direction in FIGS. 24A to 24C) on the slide rail 124*c*.

Herein, referring to FIG. 25, the press member 124*b* and slide rail 124*c* are respectively provided with a protruding portion 124*b*3 and protruding portion 124*c*1. By the protruding portion 124*b*3 and protruding portion 124*c*1 engaging in each other, when the spring 124*e* biases the press portion 124*b* in the push direction in the home position, the shift in the push direction is regulated in the press member 124*b*. When the blade carrier 124 shifts in the push direction in this state, the slide rail 124*c* shifts in the push direction, and the protruding portion 124*c*1 provided in the slide rail 124*c* also shifts in the push direction. By the protruding portion 124*c*1 shifting, the press member 124*b* biased by the spring 124*e* also shifts in the push direction at the same time.

By the press member 124*b* shifting in the push direction from the state of FIG. 25, the press protruding portion 124*b*1 presses the press-target portion 140*g* of the blade guide member 140 to shift the contact portion 140*a* of the blade guide member 140 in the push direction. At this point, against the biasing force of the tensile spring 151, the blade guide member 140 rotates around the rotation support 140*f* as the center in the clockwise direction, while the engagement protruding portion 140*d* slides in the downward direction in the long hole 50.

When the blade carrier 124 shifts up to a state (the push front edge portion 23*a*1 is in the second position) of FIG. 26, the contact portion 124*d* of the press member 124*b* strikes the rotation shaft 31 of the press guide member 30, and the shift in the push direction is regulated in the press member

124*b*. By this means, even when the spring 124*e* biases the press member 124*b* in the push direction, the press member 124*b* is not able to shift in the push direction any more. In this position, the contact portion 140*a* of the blade guide member 140 guides the sheet to bring near to the folding roller pair 22 side, and the push front edge portion 23*a* comes into contact with the sheet to push the sheet to the folding roller pair side.

Figure 27:
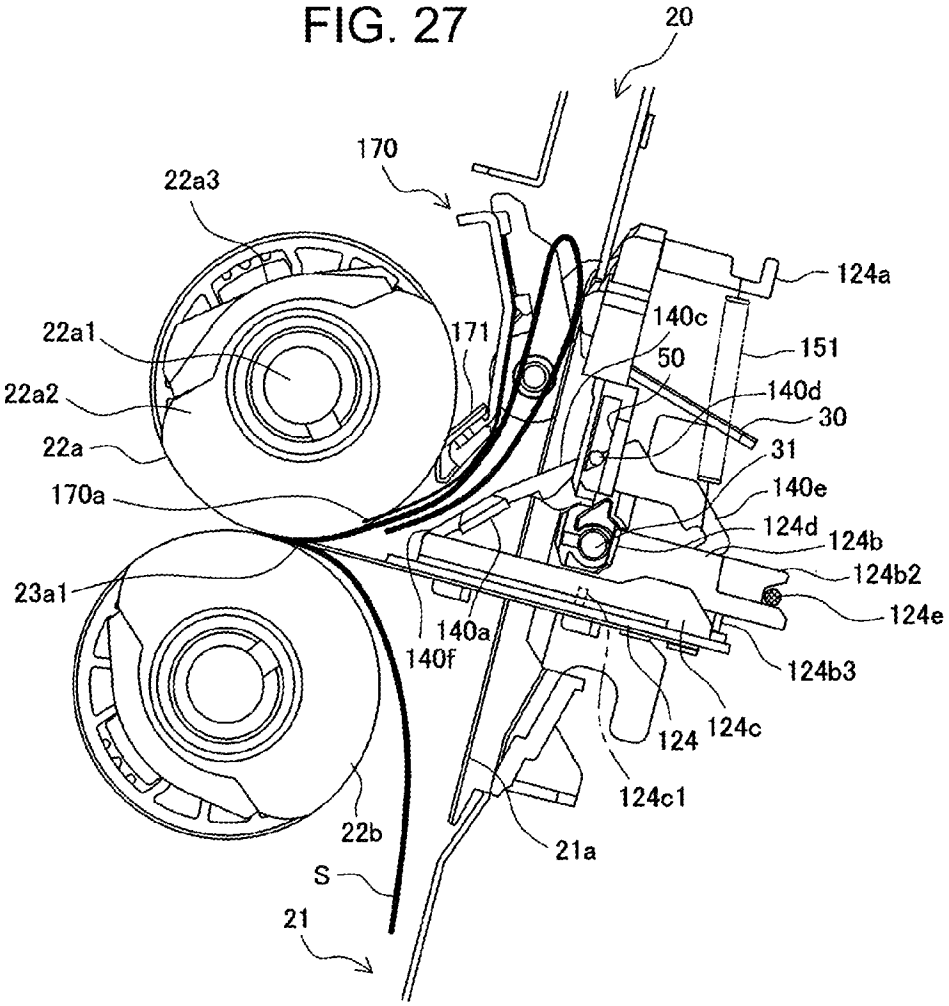
FIG. 27 is still another cross-sectional explanatory view of operation of the folding blade and blade guide member.

When the blade carrier 124 further shifts in the push direction, a state of FIG. 27 is obtained. In FIG. 27, while the blade guide member 140 halts in the position in FIG. 26, only the blade carrier 124, folding blade 23 (push front edge portion 23*a*) and slide rail 124*c* shift in the push direction, and the push front edge portion 23*a*1 maximally protrudes to shift to the position (third position) for pushing the sheet S to the nip portion 22*c*. At this point, the push front edge portion 23*a*1 of the folding blade 23 protrudes larger than the front end of the contact portion 140*a* of the blade guide member 140. In other words, a distance from the blade front edge in the third position to the contact portion front end is longer than a distance from the blade front edge in the second position to the contact portion front end. By this means, the sheet with the state of being folded in the second fold position is reliably drawn to the nip portion 22*c* of the rotating folding roller pair 22, the sheet front end S1 is also drawn to the nip portion 22*c*, and the sheet is in the state of being folded in three.

Figure 28:
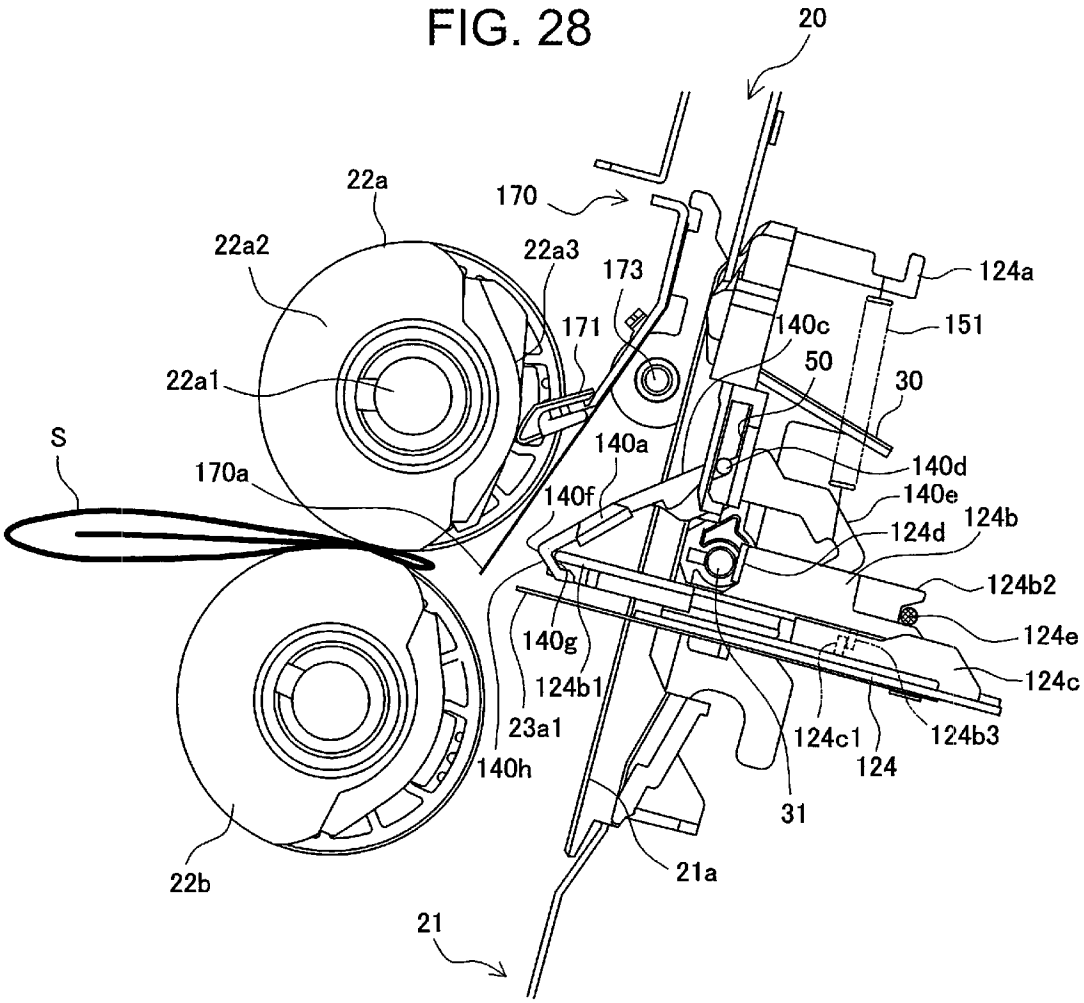
FIG. 28 is still another cross-sectional explanatory view of operation of the folding blade and blade guide member.
Figure 29:
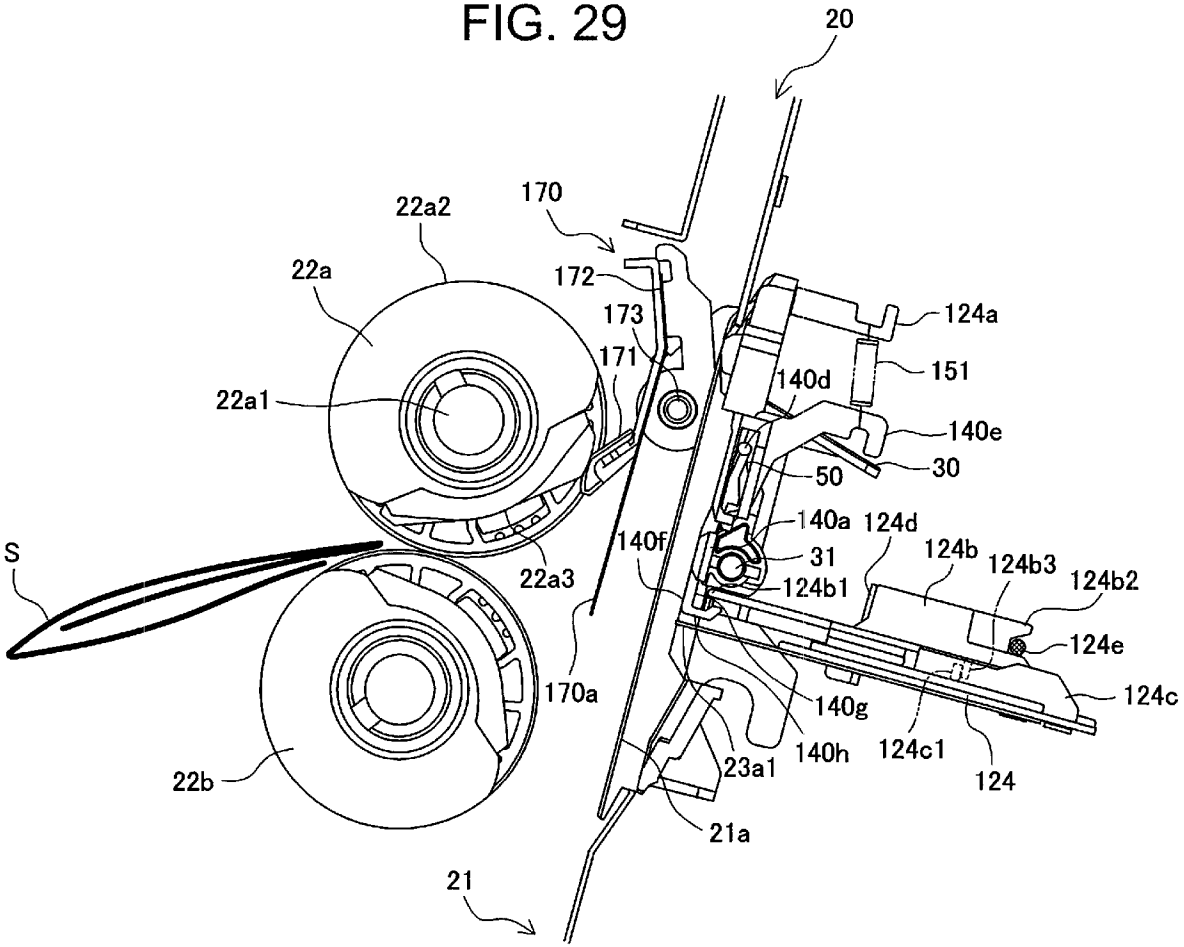
FIG. 29 is still another cross-sectional explanatory view of operation of the folding blade and blade guide member.

Subsequently, the blade carrier 124 shifts in the return direction. Also at this point, the press member 124*b* halts in the position in FIG. 26. FIG. 28 illustrates a state in which the push front edge portion 23*a*1 returns to the second position. At this point, the protruding portion 124*c*1 provided in the slide rail 124*c* engages in the protruding portion 124*b*3 provided in the press member 124*b*. When the blade carrier 124 is further shifted in the return direction in this state, the slide rail 124*c* and press member 124*b* concurrently shift in the return direction against the biasing force of the spring 124*e*. When the press member 124*b* shifts in the return direction more than the position in FIG. 28, since the press protruding portion 124*b*1 shifts in a direction of separating from the press-target portion 140*g* of the blade guide member 140, the blade guide member 140 changes the angle to the standing posture shown in FIG. 29 by the biasing force of the tensile spring 151.

In addition, when the folding blade 23 pushes the sheet i.e. during the shift of the push front edge portion 23*a*1 from the second position to the third position, in the case where a large load in the return direction is imposed on the blade guide member 140, for example, in the case of performing the folding processing in a state in which a plurality of sheets is stacked and the like, a large load is imposed on the blade guide member 140 at the time of the folding processing when rigidity of the sheet is high. In this case, when a certain load or more is imposed, the blade guide member 140 is capable of shifting in the return direction relatively with respect to the folding blade 23, against the spring 124*e*. As described above, since the blade guide member 140 is biased in the push direction by the spring 124*e* via the press member 124*b*, the blade guide member 140 is configured to be able to shift in the return direction along the slide rail 124*c* when a load more than the biasing force of the spring 124*e* is imposed on the blade guide member 140. By this means, in the case where a large load is imposed on the blade guide member 140 at the time of the folding processing on the sheet, the blade guide member 140 is not broken.

FIGS. 30A to 33 contain views to explain a deflection guide member 170 provided between the folding roller 22*a* and the guide face 21*a* of the sheet stacking tray 21. The deflection guide 170 has flexible guide members 170*a* (Mylar, etc.) for contacting the sheet S to guide the sheet S, and one end of the guide member 170*a* is fixed to a bracket 172. The bracket 172 has engagement pieces 171 protruding toward the folding roller 22*a*, and the engagement piece 171 is positioned by engaging in an engagement portion 22*d* (see FIG. 33) of the folding roller 22*a*. The engagement portion 22*d* of the folding roller 22*a* has the first roller surface 22*a*2 with the radius R1 being certain with the rotation shaft center of the rotation shaft 22*a*1 as the center, and the second roller surface 22*a*3 with the distance from the rotation shaft center of the rotation shaft smaller than the radius R1 of the first roller surface 22*a*2. By the folding roller 22*a* rotating with the engagement piece 171 engaged in such an engagement portion 22*d*, the bracket 172 for holding the guide member 170*a* is configured to be rotatable around a rotation shaft 173 as the center. A surface of the engagement portion 22*d* in which the engagement piece 171 is engaged is formed of plastic resin materials with a low coefficient of friction, and the like.

Figure 30B:
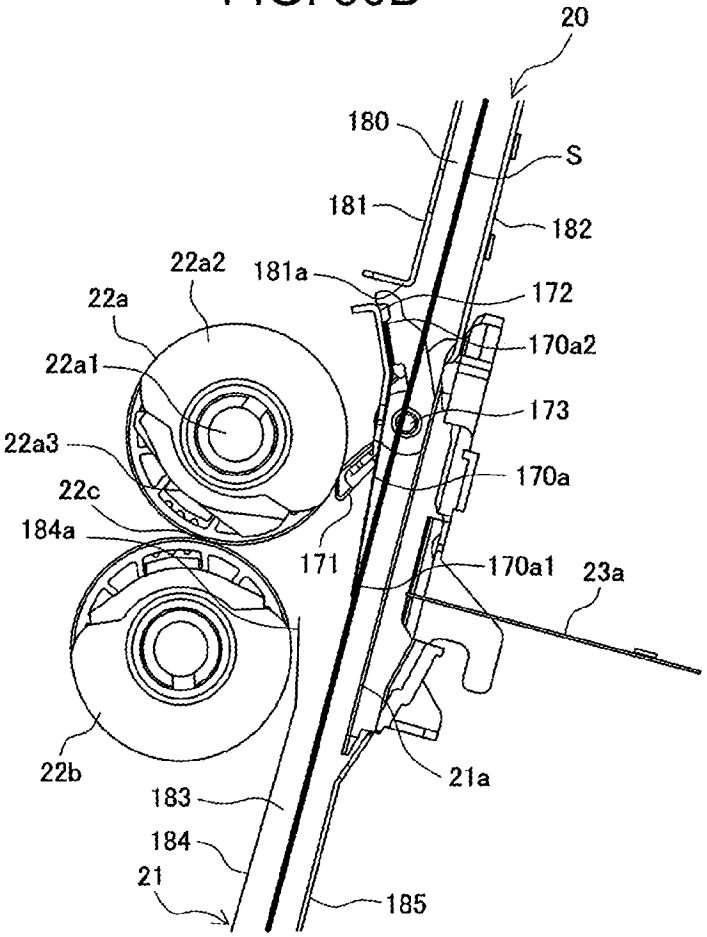
FIGS. 30A and 30B are cross-sectional explanatory views of a deflection guide member.
Figure 30A:
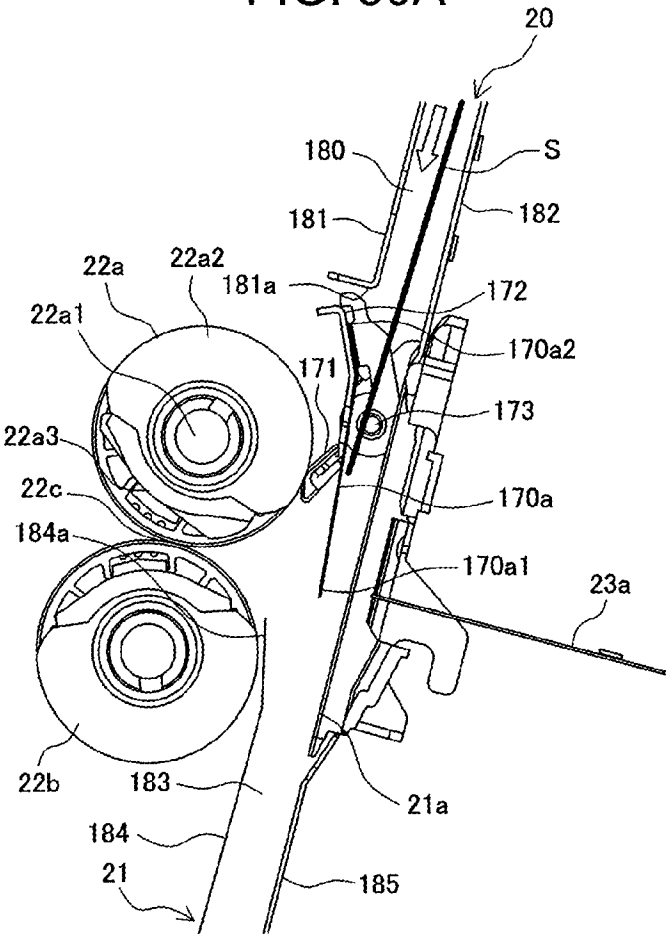

In this Embodiment, the guide member 170*a* is provided with a guide region for enabling the transported sheet S to be guided, a lower end in FIGS. 30A and 30B of the guide region is called a first end portion 170*a*1, and an upper end is called a second end portion 170*a*2. In the case where the bracket 172 is also able to guide the sheet S, a sheet guide region of the bracket 172 is also considered a part of the guide member 170*a*, and the second end portion 170*a*2 is an upper end in the guide region of the bracket 172.

Further, in this Embodiment, a space sandwiched between a first transport guide member 181 and a second transport guide member 182 constituting the sheet transport path 20 is called a guide space 180, and a space sandwiched between a first stacking guide member 184 and a second stacking guide member 185 constituting the sheet stacking tray 21 is called a storage space 183.

Figure 31B:
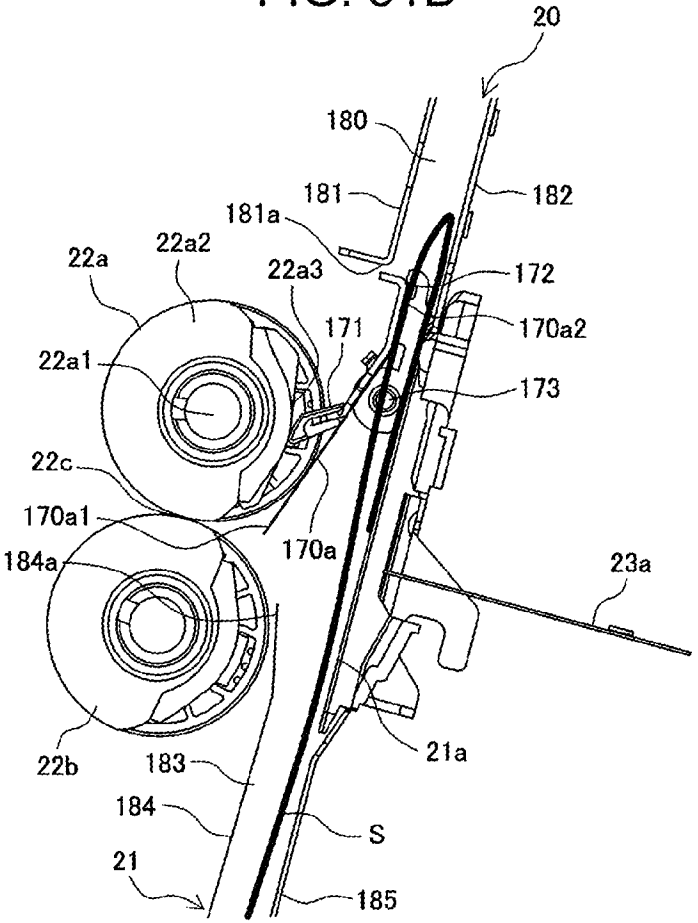
FIGS. 31A and 31B are cross-sectional explanatory views of the deflection guide member.
Figure 31A:
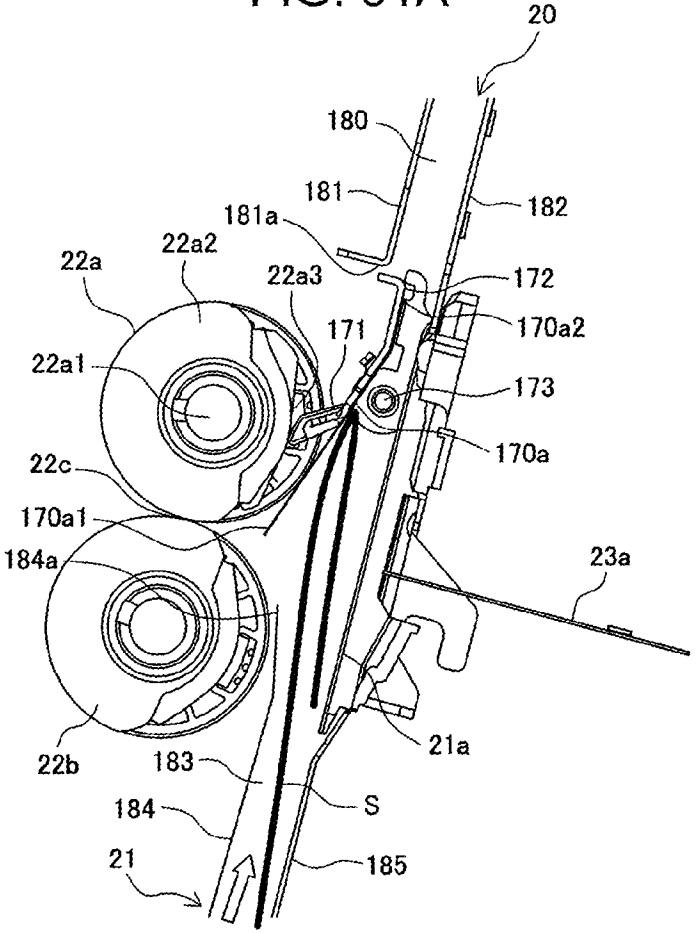

FIGS. 30A and 30B illustrate a manner where the sheet S is transported from the guide space 180 to the storage space 183 (this direction is referred to as a first transport direction) in a state in which the engagement piece 171 is engaged in the first roller surface 22*a*2 and the guide member 170*a* is positioned in a first guide position. FIGS. 31A and 31B illustrate a manner where the sheet S (in this figure, the sheet S once provided with the folding processing) is transported from the storage space 183 to the guide space 180 (this direction is referred to as a second transport direction) in a state in which the engagement piece 171 is engaged in the second roller surface 22*a*3 and the guide member 170*a* is positioned in a second guide position.

Figure 32B:
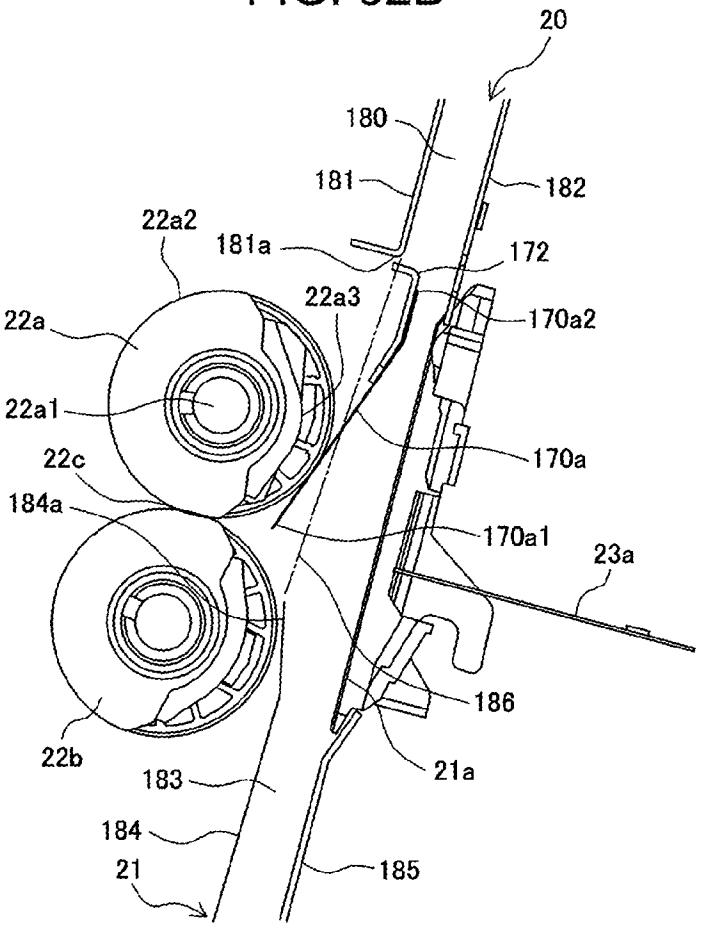
FIGS. 32A and 32B are cross-sectional explanatory views of the deflection guide member.
Figure 32A:
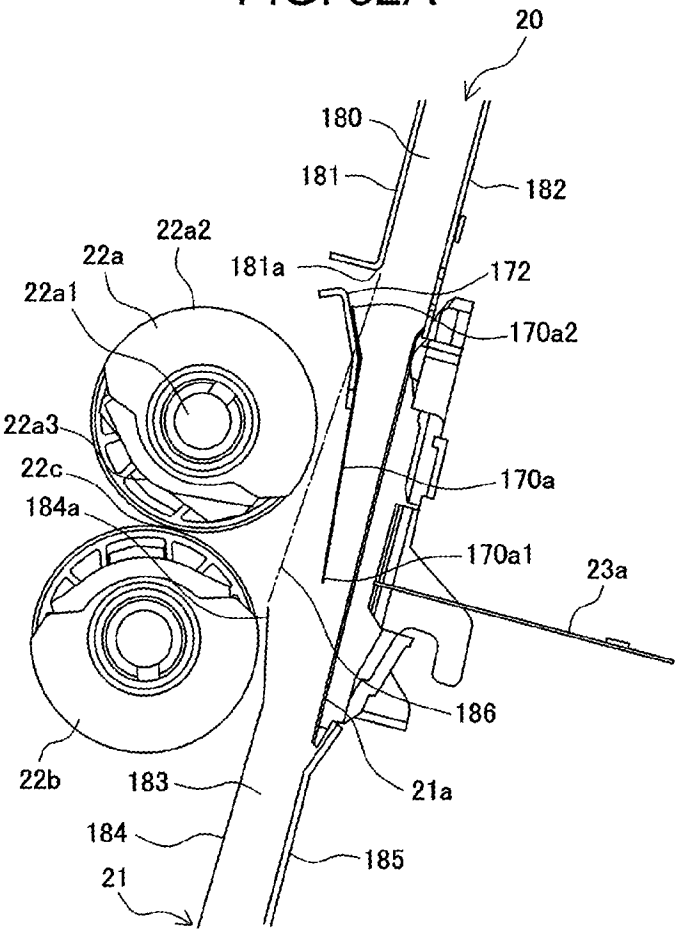

FIG. 32A illustrates a state in which the guide member 170*a* is positioned in the first guide position, and FIG. 32B illustrates a state in which the guide member 170*a* is positioned in the second guide position. The alternate long and short dashed lines 186 in the figure are a line (hereinafter, referred to as virtual line 186) joining a transport guide end portion 181*a* that is the end portion of the first transport guide member 181 on the downstream side in the first transport direction and a stacking guide end portion 184*a* that is the end portion of the first stacking guide member 184 on the downstream side in the second transport direction.

As shown in FIG. 32A, in the state in which the guide member 170*a* is positioned in the first guide position, the first end portion 170*a*1 of the guide member 170*a* is positioned on the side (guide face 21*a* side) opposite to the folding roller 22*a* in a thickness direction of the transported sheet S more than the virtual line 186. Then, the second end portion 170*a*2 is positioned on the folding roller 22*a* side in the thickness direction of the sheet S more than the virtual line 186. By this means, when the sheet S is transported in the first transport direction as shown in FIGS. 30A and 30B, it is possible to guide the front end (end portion on the downstream side in the first transport direction) of the sheet S from the guide space 180 to the storage space 183.

On the other hand, as shown in FIG. 32B, in the state in which the guide member 170*a* is positioned in the second guide position, the first end portion 170*a*1 of the guide member 170*a* is positioned on the folding roller 22*a* side in the thickness direction of the transported sheet S more than the virtual line 186. Then, the second end portion 170*a*2 is positioned on the side (guide face 21*a* side) opposite to the folding roller 22*a* in the thickness direction of the sheet S more than the virtual line 186. By this means, when the sheet S is transported in the second transport direction as shown in FIGS. 31A and 31B, it is possible to guide the front end (end portion on the downstream side in the second transport direction) of the sheet S from the storage space 183 to the guide space 181.

Figure 33:
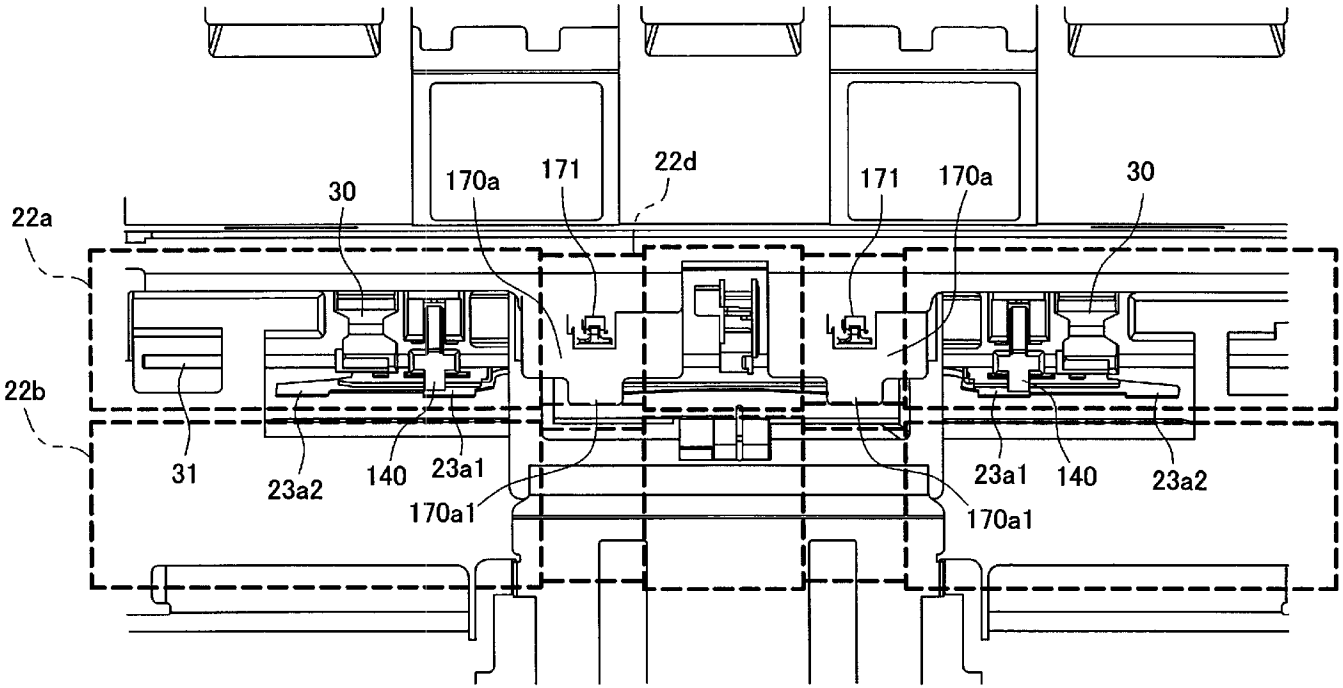
FIG. 33 is a plan view illustrating a sheet folding processing apparatus.

As shown in FIG. 33, a plurality of guide members 170*a* is provided in the width direction of the sheet S. In this Embodiment, two guide members 170*a* are disposed on opposite sides with the center in the sheet width therebetween inside the sheet width of the minimum-size sheet in the sheet width direction. The dashed lines in FIG. 33 indicate the folding rollers 22*a* and 22*b*, and the engagement piece 171 is provided in a position that corresponds to the engagement portion 22*d* of the folding roller 22*a*. Further, the guide members 170*a* are disposed in positions that correspond to two inside push front edge portions 23*a* among six push front edge portions 23*a*, 23*a*1 and 23*a*2.

The guide member 170*a* guides the sheet S, not only the time of transporting the sheet S in the first transport direction and in the second transport direction, but also in push operation of the folding blade 23. As described above, FIG. 25 illustrates the state in which the fold position of the sheet S is positioned in the position opposed to the folding blade 23 in performing the folding processing. In FIG. 25, the guide member 170*a* is positioned in the first guide position.

When the folding blade 23 is shifted in the push direction in this state, since a position of the sheet S is stable between the guide member 170*a* and the contact portion 140*a* of the blade guide member 140, it is possible to suppress misregistration of the sheet at the time of the folding processing. As described above, since the guide member 170*a* is formed of flexible Mylar or the like, when the sheet S comes into contact with the member 170*a*, the guide member 170*a* guides the sheet S in a state of being warped in the push direction.

After the push front edge portion 23*a*1 of the folding blade 23 pushes the sheet S into the nip portion 22*c* of the folding roller pair 22, when the folding roller pair 22 is rotated a predetermined amount, the engagement piece 171 engages in the second roller surface 22*a*3, and the guide member 170*a* is positioned in the second guide position (see FIG. 28). This is because a transport load of the sheet S due to the folding roller pair 22 is large when the guide member 170*a* continues to bias the sheet S in the return direction also after the fold-in end portion S2 of the sheet S is inserted into the nip portion 22*c*, and it is desirable to shift the guide member 170*a* to the second guide position to guide the sheet S to the nip portion 22*c*, when the fold position of the sheet S arrives at the nip portion 22*c* of the folding roller pair 22 and the fold-in processing by the folding roller pair 22 is started.

As described above, the guide member 170*a* of the deflection guide 170 is positioned in the first guide position to guide the sheet S from the guide space 180 to the storage space 183, in transporting the sheet S in the first transport direction (sheet transport to receive the sheet S in the sheet stacking tray 21). In transporting the sheet S in the second transport direction (sheet transport in the case of transporting the sheet S received in the sheet stacking tray 21 to the binding processing unit 17*a*, and in the case of making the second fold position of the sheet S opposed to the folding blade 23 to perform the second folding processing after finishing the first folding processing), the guide member 170*a* is positioned in the second guide position to guide the sheet S from the storage space 183 to the guide space 180.

Further, in performing the folding processing, the guide member 170*a* is positioned in the first guide position, and guides the sheet S so that the fold position is not displaced until the folding blade 23 pushes the sheet S into the nip portion 22*c* of the folding roller pair 22. After the fold position of the sheet S arrives at the nip portion 22*c*, the member 170*a* is positioned in the second guide position, and guides the sheet S to the nip portion 22*c*, while reducing the transport load.

In addition, in this Embodiment, in order to shift the guide member 170*a* to the first guide position and the second guide position, the guide member 170*a* is shifted by bringing the engagement piece 171 into contact with the circumferential surface (contact portion 22*d*) of the folding roller 22*a* with different diameters, and may be shifted using a different drive source. Further, the Embodiment shows the aspect where the guide member 170*a* is disposed between the folding roller 22*a* and the guide face 21*a*, and the member 170*a* may be disposed between the folding roller 22*b* and the guide face 21*a*, or disposed in both positions.

Further, this Embodiment shows the aspect where the first guide position of the guide member 170*a* in the sheet transport is the same as the first guide position of the guide member 170*a* in the folding processing, and the positions do not need to be completely the same position, and are capable of being modified as appropriate. Furthermore, also with respect to the second position, as a matter of course, the position is capable of being modified as appropriate.

Moreover, all of the above-mentioned Embodiments show the aspect where the folding processing is performed on the sheet S twice to make the inward three-fold, and also in the folding processing once (first folding processing of the inward three-fold, folding processing in two-fold), when the above-mentioned blade guide members 40 and 140 are provided, it is possible to suitably guide the sheet S in the folding processing.

In addition, this application claims priority from Japanese Patent Application No. 2019-236598 and Japanese Patent Application No. 2020-212475 incorporated herein by reference.

The invention claimed is:

1. A sheet processing apparatus for performing first folding processing on a sheet, subsequently performing second folding processing in a position different from a fold formed by the first folding processing, and performing folding processing so that one end of the sheet folded by the first folding processing exists inside the sheet folded, comprising:

a transport path including a guide face to guide a transported sheet;

a rotating body pair adapted to nip the sheet transported to the transport path by a nip portion to rotate, and thereby draw the sheet to perform folding processing;

a folding blade including a front edge portion for pushing the sheet transported to the transport path to the nip portion of the rotating body pair, and shifting among a first position in which the front edge portion is retracted from the transport path, a second position at a moment in which the front edge portion protrudes to the transport path from the first position, and a third position in which the front edge portion pushes the sheet to the nip portion of the rotating body pair;

a blade guide member including a guide portion for pushing the one end of the sheet folded by the first folding processing so as to bring near to the rotating body pair, when the folding blade pushes the sheet to the nip portion in executing the second folding processing; and a shift section to shift the folding blade and the blade guide member in a push direction for pushing to the nip portion and in a return direction opposite to the push direction, wherein in the second position, the front edge portion of the folding blade protrudes in the push direction more than the guide portion, and wherein the shift section shifts the folding blade and the blade guide member relatively so that a distance from the front edge portion in the third position to the guide portion is longer than a distance from the front edge portion in the second position to the guide portion.

2. The sheet processing apparatus according to claim 1, wherein in the first position, the front edge portion is in a same position or in a position in the return direction as/than the guide portion in the return direction.

3. The sheet processing apparatus according to claim 1, wherein in starting to shift the folding blade in the return direction, the shift section shifts the blade guide member in the return direction at the same time.

4. The sheet processing apparatus according to claim 1, wherein in starting to shift the folding blade in the return direction, the shift section starts to shift the blade guide member in the return direction later than the folding blade.

5. The sheet processing apparatus according to claim 1, wherein when a predetermined or more load in the return direction is imposed on the blade guide member in a state in which the folding blade exists between the second position and the third position, the shift section shifts the blade guide member in the return direction relatively with respect to the folding blade.

6. The sheet processing apparatus according to claim 1, further comprising another guide member for guiding the sheet in the return direction when the front edge portion moves from the first position to the second position.

7. An image forming system comprising:

an image forming apparatus adapted to form an image on a sheet; and a sheet processing apparatus adapted to perform folding processing on the sheet fed from the image forming apparatus, wherein the sheet processing apparatus is the sheet processing apparatus according to claim 1.

8. A sheet processing apparatus for performing folding processing on a sheet, comprising:

a transport path including a guide face to guide a transported sheet;

a rotating body pair adapted to nip the sheet transported to the transport path by a nip portion to rotate, and thereby draw the sheet to perform folding processing;

a folding blade including a front edge portion for pushing the sheet transported to the transport path to the nip portion of the rotating body pair, and shifting among a first position in which the front edge portion is retracted from the transport path, a second position at a moment in which the front edge portion protrudes to the transport path from the first position, and a third position in which the front edge portion pushes the sheet to the nip portion of the rotating body pair;

a blade guide member including a guide portion for pushing the sheet so as to bring near to the rotating body pair, when the folding blade pushes the sheet to the nip portion in executing the folding processing; and a shift section to shift the folding blade and the blade guide member in a push direction for pushing to the nip portion and in a return direction opposite to the push direction, wherein in the second position, the front edge portion of the folding blade protrudes in the push direction more than the guide portion, and wherein the shift section shifts the folding blade and the blade guide member relatively so that a distance from the front edge portion in the third position to the guide portion is longer than a distance from the front edge portion in the second position to the guide portion.

9. The sheet processing apparatus according to claim 8, further comprising another guide member for guiding the sheet in the return direction when the front edge portion moves from the first position to the second position.

10. An image forming system comprising:

an image forming apparatus adapted to form an image on a sheet; and a sheet processing apparatus adapted to perform folding processing on the sheet fed from the image forming apparatus, wherein the sheet processing apparatus is the sheet processing apparatus according to claim 8.

11. A sheet processing apparatus for performing first folding processing on a sheet, subsequently performing second folding processing in a position different from a fold formed by the first folding processing, and performing folding processing so that one end of a folded sheet folded by the first folding processing exists inside the sheet folded, comprising:

a transport path including a guide face to guide a transported sheet to be transported in a predetermined transport direction;

a rotating body pair adapted to nip the sheet transported to the transport path by a nip portion to rotate, and thereby draw the sheet to perform folding processing;

a folding blade including a front edge portion for pushing the sheet transported to the transport path to the nip portion of the rotating body pair, and shifting among a first position in which the front edge portion is retracted from the transport path, a second position in which the front edge portion protrudes to the transport path by a predetermined amount, and a third position in which the front edge portion pushes the sheet to the nip portion of the rotating body pair;

a blade guide member including a guide portion for pushing the one end of the sheet folded by the first folding processing so as to bring near to the rotating body pair, when the folding blade pushes the sheet to the nip portion in executing the second folding processing; and a shift section to shift the folding blade and the blade guide member in a push direction for pushing to the nip portion and in a return direction opposite to the push direction, wherein in a state where the folded sheet is positioned in the transport path in executing the second folding processing, the guide portion is positioned more than the front edge portion to a folding line side formed by the first folding processing in the transport direction, and wherein the shift section shifts the folding blade and the blade guide member relatively so that a distance from the front edge portion in the third position to the guide portion is longer than a distance from the front edge portion in the second position to the guide portion.

12. The sheet processing apparatus according to claim 11, further comprising another guide member for guiding the sheet in the return direction when the front edge portion moves from the first position to the second position.

* * * * *